US009056482B2

(12) United States Patent
Nozawa et al.

(10) Patent No.: US 9,056,482 B2
(45) Date of Patent: Jun. 16, 2015

(54) PRINTING MATERIAL SUPPLY SYSTEM AND CARTRIDGE

(71) Applicant: SEIKO EPSON CORPORATION, Tokyo (JP)

(72) Inventors: Izumi Nozawa, Nagano (JP); Atsushi Kobayashi, Nagano (JP); Tadahiro Mizutani, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/935,854

(22) Filed: Jul. 5, 2013

(65) Prior Publication Data

US 2014/0009539 A1 Jan. 9, 2014

(30) Foreign Application Priority Data

Jul. 6, 2012 (JP) ..... 2012-152290

(51) Int. Cl.
*B41J 2/175* (2006.01)
*B41J 2/14* (2006.01)

(52) U.S. Cl.
CPC ..... *B41J 2/17553* (2013.01); *B41J 2/1753* (2013.01)

(58) Field of Classification Search
USPC ..... 347/49, 85, 86, 87
See application file for complete search history.

(56) References Cited

U.S. PATENT DOCUMENTS

| | | | | |
|---|---|---|---|---|
| 6,152,555 | A * | 11/2000 | Nozawa et al. | 347/49 |
| 6,203,148 | B1 | 3/2001 | Kishida | |
| 6,220,701 | B1 * | 4/2001 | Umemura | 347/86 |
| 6,302,535 | B1 * | 10/2001 | Sturgeon et al. | 347/86 |
| 6,502,917 | B1 * | 1/2003 | Shinada et al. | 347/19 |
| 6,705,715 | B2 * | 3/2004 | Morita et al. | 347/87 |
| 7,278,721 | B2 * | 10/2007 | Shimizu et al. | 347/86 |
| 2005/0041076 | A1 | 2/2005 | Katayama | |
| 2008/0309739 | A1 | 12/2008 | Takahashi | |

FOREIGN PATENT DOCUMENTS

| | | | |
|---|---|---|---|
| JP | 10-095129 | A | 4/1998 |
| JP | 2008-100435 | A | 5/2008 |
| JP | 2009-018566 | A | 1/2009 |

* cited by examiner

*Primary Examiner* — Anh T. N. Vo
(74) *Attorney, Agent, or Firm* — Global IP Counselors, LLP

(57) ABSTRACT

The cartridge comprises a plurality of printing material supply ports. The plurality of printing material supply ports are projecting from a first surface in a −Z axial direction to correspond to each of a plurality of printing material supply pipes provided on the printing device. A groove section is provided to be concave more to a +Z axial direction side than the first surface, and provided between two of the printing material supply ports adjacent to each other. The groove section receives the partition plate when the printing material supply ports are connected to the printing material supply pipes.

8 Claims, 41 Drawing Sheets

F22-F22

PRINTING MATERIAL SUPPLY SYSTEM AND CARTRIDGE

CROSS-REFERENCE TO RELATED APPLICATIONS

This application claims priority to Japanese Patent Application No. 2012-152290 filed on Jul. 6, 2012. The entire disclosure of Japanese Patent Application No. 2012-152290 is hereby incorporated herein by reference.

BACKGROUND

1. Technical Field

The present invention relates to a printing material supply system and a cartridge thereof.

2. Related Art

In a printing material supply system, a cartridge is mounted on a printing device, the cartridge supplies a printing material to the printing device, and the printing device executes printing using the printing material. Such a cartridge comprises a printing material containing section and a printing material supply port, the printing material is contained in the printing material containing section, and the printing material is supplied to the printing device through the printing material supply port. A cartridge provided with a plurality of printing material supply ports is proposed in the Patent Document 1.

Japanese Laid-open Patent Publication No. 10-95129 (Patent Document 1) is an example of the related art.

SUMMARY

In the cartridge in the citation document 1, the plurality of printing material supply ports are simply arranged in one row on the bottom surface of the cartridge and there is not sufficient consideration given to positional deviation of the plurality of printing material supply ports to the printing device when the cartridge is mounted on the printing device and positional deviation of the plurality of printing material supply ports after the cartridge is mounted on the printing device. When at least one of the plurality of printing material supply ports is deviated to the predetermined position in the printing device, generation of various faults are considered such as, for example, defects in the supply of the printing material, supplying of a type of printing material which is not intended, and damage to the printing device or the cartridge. As a result, a technique for preventing the positional deviation of printing material supply port is desired in regard to the cartridge provided with the plurality of printing material supply ports.

Other than this, reductions in size, lowering of costs, reduction in the use of resources, increasing the ease of manufacture, and improvements in usability and the like are desired in cartridges. Here, the problems described above are not limited to printing material supply systems supplying a printing material from a cartridge to a printing device but are common to liquid supply systems supplying other liquids from a cartridge to a liquid consumption device.

The invention has been carried out in order to solve at least a portion of the problems described above and is able to be realized in the following aspects.

(1) According to an aspect of the invention, a cartridge which supplies a printing material to a printing device is proposed. The cartridge comprises a first surface and a second surface opposing each other; a third surface and a fourth surface which intersect with the first surface and the second surface and opposing each other; a fifth surface and a sixth surface which intersect with each surface of the first surface to the fourth surface and opposing each other; a printing material containing section containing the printing material; a plurality of printing material supply ports projecting from the first surface in a −Z axial direction and supplying the printing material from the printing material containing section; and a groove section provided to be concave more in a +Z axial direction opposite to the −Z axial direction than the first surface, and provided between two of the printing material supply ports adjacent to each other. According to the cartridge of the aspect, it is not possible to mount the cartridge on the printing device due to the cartridge abutting against the partition plate, when the groove section in the cartridge deviated from a position of a partition plate in the printing device. As a result, it is possible to prevent position deviation of the plurality of printing material supply ports to the printing device when the cartridge is mounted on the printing device. In addition, according to the cartridge of the aspect, the plurality of printing material supply ports are provided to the printing device when the partition plate in the printing device is inserted in the groove section of the cartridge. As a result, it is possible to prevent positional deviation of the plurality of printing material supply ports after the cartridge has been mounted on the printing device.

(2) In the cartridge of the aspect described above, there may further comprise an inclined surface linking between the first surface and the third surface and being inclined to the first surface and the third surface; a circuit board with cartridge side terminals provided on the inclined surface; and a latching section provided on at least one of the third surface and the fourth surface, wherein the circuit board and the latching section may be provided at positions which cut across a plane CX, the plane CX passes through the center of a length of one of the plurality of printing material supply ports along a Y axis which is parallel to the arrangement of the plurality of printing material supply ports, and the plane CX is orthogonal to the Y axis. According to the cartridge of the aspect, it is possible to suppress an action that pressing forces from the printing device side to the printing material supply ports and the cartridge side terminals which intersects with the plane CX work as forces which make the cartridge inclined in a Y axial direction, due to the latching section which intersects with the plane CX. As a result, it is possible to prevent positional deviation of the cartridge side terminals to the printing device in addition to positional deviation of the plurality of printing material supply ports to the printing device.

(3) In the cartridge of the aspect described above, the latching section may include a board side latching section provided in a position which cuts across the plane CX in the third surface, the board side latching section has a latching surface which faces the +Z axial direction. According to the cartridge of the aspect, it is possible to more effectively prevent positional deviation of the cartridge side terminals to the printing device due to the board side latching section positioned closer to the cartridge side terminals than the printing material supply ports.

(4) In the cartridge of the aspect described above, the board side latching section may be provided at a position adjacent to the circuit board. According to the cartridge of the aspect, it is possible to further prevent positional deviation of the cartridge side terminals to the printing device.

(5) In the cartridge of the aspect described above, the latching section may include a supply port side latching section provided in a position which cuts across the plane CX in the fourth surface, the supply port side latching section has a latching surface which faces the +Z axial direction. According to the cartridge of the aspect, it is possible to more effectively prevent positional deviation of the printing material supply ports to the printing device due to the supply port side latching section positioned closer to the printing material supply ports than the cartridge side terminals.

(6) In the cartridge of the aspect described above, there may further comprise another supply port side latching section provided on the fourth surface, the another supply port side latching section has a latching surface which faces the +Z axial direction, wherein the another supply port side latching section may be provided at a position which cuts across another plane CX, the another plane CX passes through the center of a length of another printing material supply port along a Y axis, and the another plane CX is orthogonal to the Y axis. According to the cartridge of the aspect, it is possible to further suppress the action that pressing forces from the printing device side to the printing material supply ports and the cartridge side terminals which intersects with the plane CX work as forces which make the cartridge inclined in a Y axial direction, due to the other supply port side latching section which intersects with the other plane CX deviated in the Y axial direction to the plane CX.

(7) In the cartridge of the aspect described above, the printing material supply port which intersects with the plane CX may be provided at one end of the arrangement of the plurality of printing material supply ports and the other printing material supply port which intersects with the other plane CX may be provided at the other end the opposite side to the one end of the arrangement of the plurality of printing material supply ports. According to the cartridge of the aspect, it is possible to further effectively suppress the action where pressing forces from the printing device side to the printing material supply ports and the cartridge side terminals which intersects with the plane CX work as forces which make the cartridge inclined in a Y axial direction, due to the other supply port side latching section which intersects with the other plane CX deviated in the Y axial direction to the plane CX.

(8) In the cartridge of the aspect described above, the plurality of printing material supply ports may include three or more of the printing material supply ports, the printing material supply port which intersects with the plane CX may be provided at the center of the arrangement of the plurality of printing material supply ports, the another printing material supply port may include two another printing material supply ports respectively provided at both ends of the arrangement of the plurality of printing material supply ports and the another supply port side latching section may include two another supply port side latching sections, each of the two another supply port side latching sections provided at the position which cut across the another plane CX. According to the cartridge of the aspect, it is possible to further effectively suppress the action, where pressing forces from the printing device side to the printing material supply ports and the cartridge side terminals which intersects with the plane CX work as forces which make the cartridge inclined in a Y axial direction, due to the two edge section supply port side latching sections which intersect with the two other planes CX deviated in two directions along the Y axial direction to the plane CX.

(9) In the cartridge of the aspect described above, there may further comprise another supply port side latching section provided on the fourth surface, the another supply port side latching section has a latching surface which faces the +Z axial direction, wherein the other supply port side latching section may be provided at a position which cuts across another plane CX, the another plane CX passes through the center of a length of another one of the printing material supply ports along a Y axis, and the another plane CX is orthogonal to the Y axis, and the length of the supply port side latching section along the Y axis may be larger than the length of the other supply port side latching section along the Y axis. According to the cartridge of the aspect, it is possible to prevent inclination of the cartridge in the Y axial direction due to the other supply port side latching section without lowering operability when mounting the cartridge on the printing device while preventing positional deviation of the cartridge along the Y axis due to the supply port side latching section.

(10) In the cartridge of the aspect described above, there may further comprise an optical element adapted to optically detect the printing material in the printing material containing section from the outside of the cartridge, wherein the optical element may be provided on the first surface in a position which cuts across the plane CX. According to the cartridge of the aspect, it is possible to prevent positional deviation of the optical element to the printing device in addition to positional deviation of the plurality of printing material supply ports and the cartridge side terminals to the printing device.

The plurality of constituent elements of each of the aspects of the invention described above are not all essential and it is possible to appropriately perform modification, deletion, replacement with other new constituent elements, and deletion of a portion of limited content to a portion of the plurality of constituent elements in order to solve a portion or all of the problems described above or to achieve a portion or all of the effects described in the specifications. In addition, it is possible to make an independent aspect of the invention by combining a portion or all of one technical aspect described above with a portion or all of the technical characteristics included in the other embodiments of the invention described above in order to solve a portion or all of the problems described above or to achieve a portion or all of the effects described in the specifications.

For example, one aspect of the invention may be realized as a device provided with one or more of the elements out of the nine elements of the first surface, the second surface, the third surface, the fourth surface, the fifth surface, the sixth surface, the printing material containing section, the plurality of printing material supply ports, and the groove section. That is, the device of the invention may or do not have the first surface. In addition, the device of the invention may or do not have the second surface. In addition, the device of the invention may or do not have the third surface. In addition, the device of the invention may or do not have the fourth surface. In addition, the device of the invention may or do not have the fifth surface. In addition, the device of the invention may or do not have the sixth surface. In addition, the device of the invention may or do not have the printing material containing section. In addition, the device of the invention may or do not have the plurality of printing material supply ports. In addition, the device of the invention may or do not have the groove section.

The printing material containing section may be configured, for example, as a printing material containing section containing the printing material. The plurality of printing material supply ports may be configured as a plurality of printing material supply ports projecting from the first surface in the −Z axial direction to correspond to each of the plurality of printing material supply pipes provided on the printing device and supplying the printing material from the printing material containing section to the printing material supply pipes when the printing material supply ports is connected to the printing material supply pipes. The groove section may be configured, for example, as a groove section provided to be concave more in the +Z axial direction opposite to the −Z axial direction than the first surface, and provided between two of the printing material supply ports adjacent to each other to correspond to the partition plate, projecting in a plate shape between two of the printing material supply pipes adjacent to each other out of the plurality of printing material supply pipes in the printing device, and which receives the partition plate when the printing material supply ports are connected to the printing material supply pipes.

It is possible to realize such a device, for example, as a cartridge and as a device other than the cartridge. According to such an aspect, it is possible to solve at least one of the various problems such as reductions in size, lowering of costs, reduction in the use of resources, increasing the ease of manufacture, and improvements in usability of the device. It is possible to apply a portion, all or any of the technical characteristics of each of the aspects of the cartridge described above to such a device.

It is possible to realize the invention as various aspects other than the cartridge. For example, it is possible to realize the invention as aspects such as a printing material supply system comprised of a cartridge and a printing device, a printing device where a cartridge is mounted, a cartridge for supplying a liquid different to the printing material, and a method for supplying a liquid from a cartridge.

BRIEF DESCRIPTION OF THE DRAWINGS

Referring now to the attached drawings which form a part of this original disclosure.

DETAILED DESCRIPTION OF EXEMPLARY EMBODIMENTS

Below, a printing material supply system where the invention has been applied will be described.

A. First Embodiment

A-1. Overall Configuration of Printing Material Supply System

Figure 1:
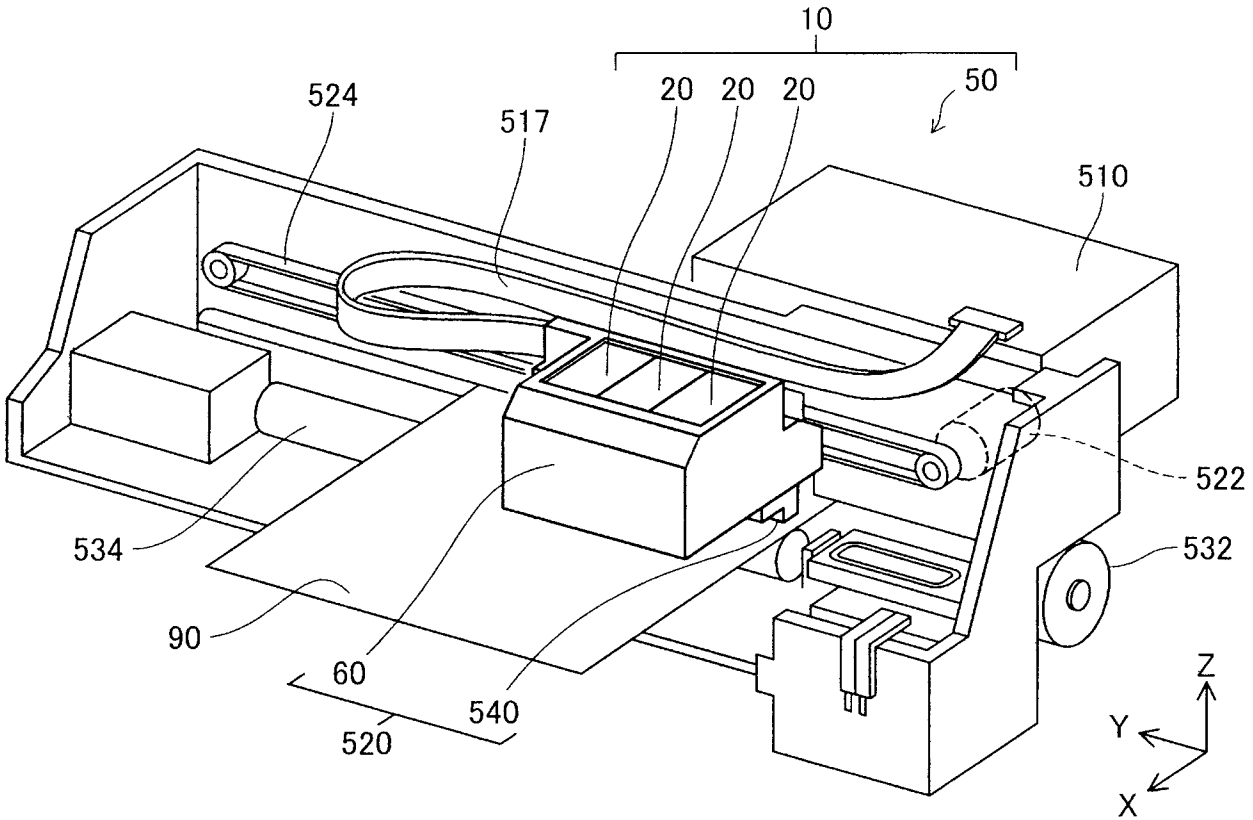
FIG. 1 is a perspective diagram illustrating a configuration of a printing material supply system.

FIG. 1 is a perspective diagram illustrating a configuration of a printing material supply system 10. X, Y, and Z axes are drawn to be orthogonal to each other in FIG. 1. The X, Y, and Z axes in FIG. 1 correspond to the X, Y, and Z axes in the other diagrams. In the embodiment, the Z axial direction is the vertical direction.

The printing material supply system 10 includes a cartridge 20 and a printer (a printing device) 50. In the printing material supply system 10, the cartridge 20 is mounted on a holder (a cartridge mounting section) 60 of the printer 50, the cartridge 20 supplies ink (a printing material) to the printer 50, and printing is executed using the ink.

The cartridge 20 of the printing material supply system 10 is a device which has a function of containing ink and is also called an ink cartridge. The cartridge 20 is configured to be attached and detached by the user to the holder 60 of the printer 50. The ink in the cartridge 20 is supplied to a head 540 of the printer 50 from a printing material supply port described later which is provided on the cartridge 20 via a printing material supply pipe described later which is provided on the holder 60. Detailed configurations of the cartridge 20 and the holder 60 will be described later.

In the embodiment, the holder 60 in the printer 50 is adapted to mount three cartridges 20. The number of the cartridges 20 which are mounted on the holder 60 is not limited to three, it is possible to arbitrarily change the number, and there may be three or less or there may be three or more.

In the embodiment, the ink in the cartridge 20 is black ink. In another embodiment, the ink in the cartridge 20 may be inks of various colors other than black such as yellow, magenta, light magenta, cyan, or light cyan or ink of a special glossy color (metallic gloss, white pearl, or the like) is added to these colors. In another embodiment, another type of ink may be employed.

The printer 50 of the printing material supply system 10 is an ink jet printer which is a device which prints using ink. Other than the holder 60 which holds the cartridge 20, the printer 50 comprises a control section 510, a carriage 520, and the head 540. The printer 50 adapted to supply the ink supplied from the cartridge 20 mounted on the holder 60 to the head 540, and print information such as text, a diagram, or an image is printed onto a printing medium 90 such as paper or a label with the ink being discharged from the head 540.

The control section 510 of the printer 50 controls each section of the printer 50. The carriage 520 of the printer 50 is configured to relatively move the head 540 to the printing medium 90. The head 540 of the printer 50 receives supply of the ink from the cartridge 20 which is mounted on the holder 60 and discharges the ink to the printing medium 90. The control section 510 and the carriage 520 are electrically connected via a flexible cable 517 and the head 540 executes discharge of the ink based on a control signal from the control section 510.

In the embodiment, the holder 60 is provided on the carriage 520 and the cartridge 20 is mounted on the carriage 520. Such a printer is referred to as an on-carriage printer.

In another embodiment, the holder 60 may provided on a portion which is different to the carriage 520 and the ink may be supplied from the cartridge 20 to the head 540 on the carriage 520 via a flexible tube. Such a type of printer is referred to as an off-carriage type.

In the embodiment, the printer 50 comprises a main scanning and feeding mechanism and a sub scanning and feeding mechanism for realizing printing to the printing medium 90 by relatively moving the carriage 520 and the printing medium 90. The main scanning and feeding mechanism of the printer 50 comprises a carriage motor 522 and a driving belt 524, and the carriage 520 is moved so as to reciprocate in the main scanning direction by motive force from the carriage motor 522 being transferred to the carriage 520 via the driving belt 524. The sub scanning and feeding mechanism of the printer 50 comprises a transport motor 532 and a platen 534, and the printing medium 90 is transported in the sub scanning direction which is orthogonal to the main scanning direction by motive force from the transport motor 532 being transferred to the platen 534. The carriage motor 522 of the main scanning and feeding mechanism and the transport motor 532 of the sub scanning and feeding mechanism are operated based on control signals from the control section 510.

In the embodiment, in the usage state of the printing material supply system 10, an axis along the sub scanning direction where the printing medium 90 is transported is set as the X axis, an axis along the main scanning direction where the carriage 520 is moved so as to reciprocate is set as the Y axis, and an axis along the direction of gravity is set as the Z axis. The X axis, the Y axis, and the Z axis are orthogonal to each other. Here, the usage state of the printing material supply system 10 is a state of the printing material supply system 10 which is arranged on a horizontal surface, and in the embodiment, the horizontal surface is a surface which is parallel to the X axis and the Y axis.

In the embodiment, the +X axial direction is toward the sub scanning direction and the opposite is the −X axial direction, and the +Z axial direction is from downward to upward in the direction of gravity and the opposite is the −Z axial direction. In the embodiment, the +X axial direction side is the front surface of the printing material supply system 10. In the embodiment, the +Y axial direction is toward the left side surface from the right side surface of the printing material supply system 10 and the opposite is the −Y axial direction. In the embodiment, the alignment direction of the plurality of cartridges 20 which are mounted on the holder 60 is a direction along the Y axis.

A-2. Configuration of Cartridge Mounted on Holder

Figure 2:
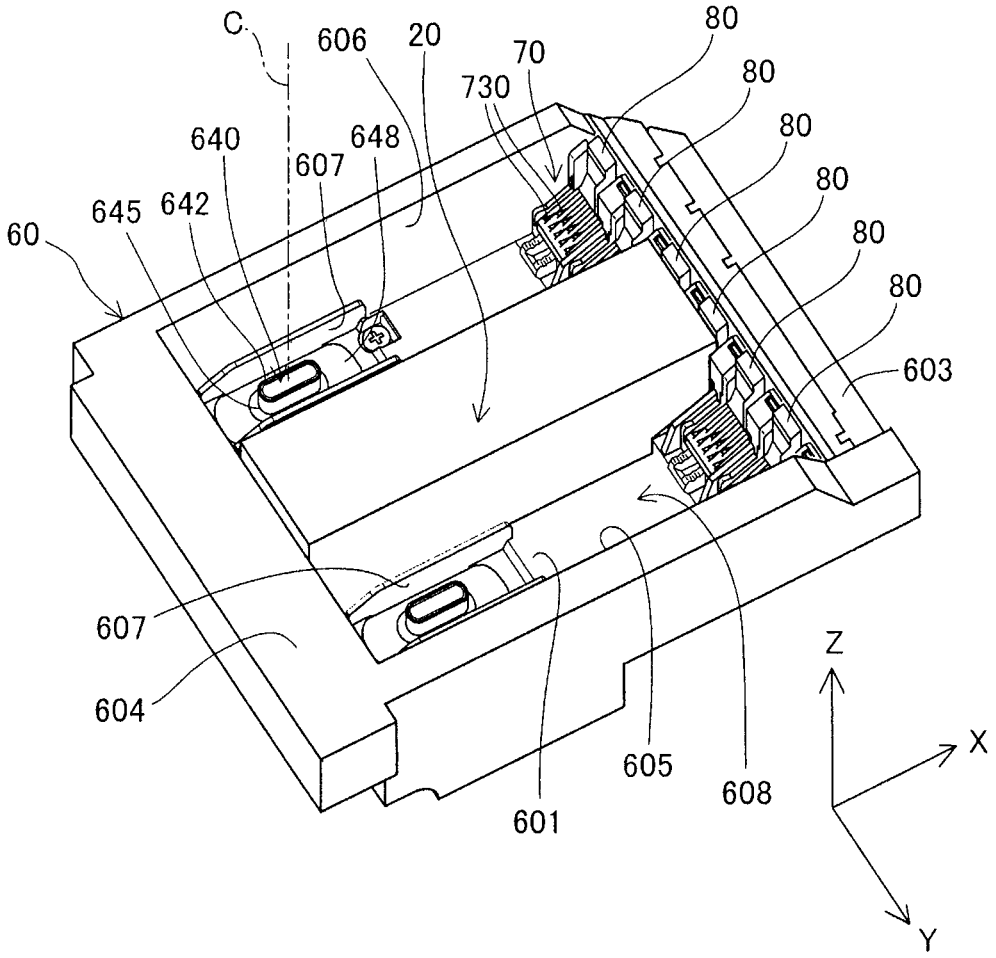
FIG. 2 is a perspective diagram illustrating a holder where a cartridge is mounted.
Figure 3:
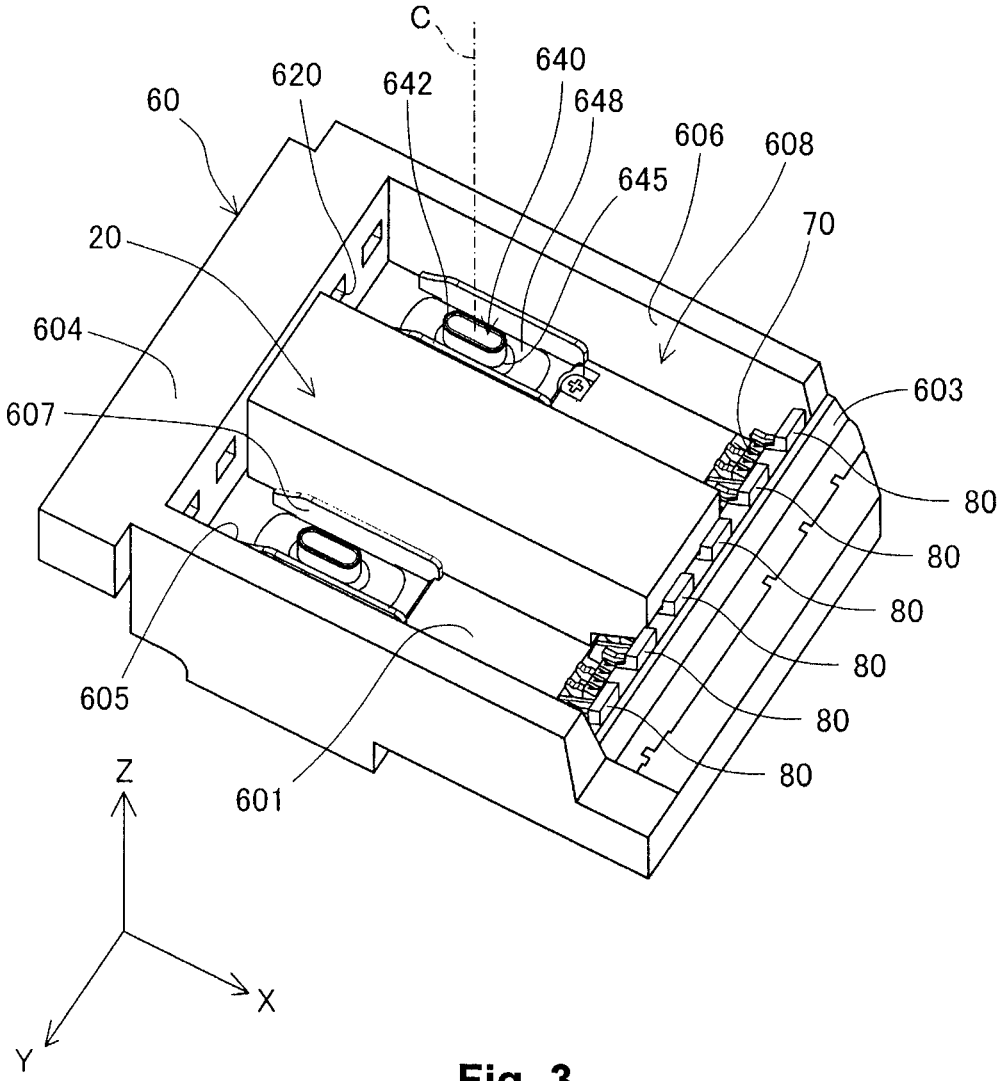
FIG. 3 is a perspective diagram illustrating a holder where a cartridge is mounted.
Figure 4:
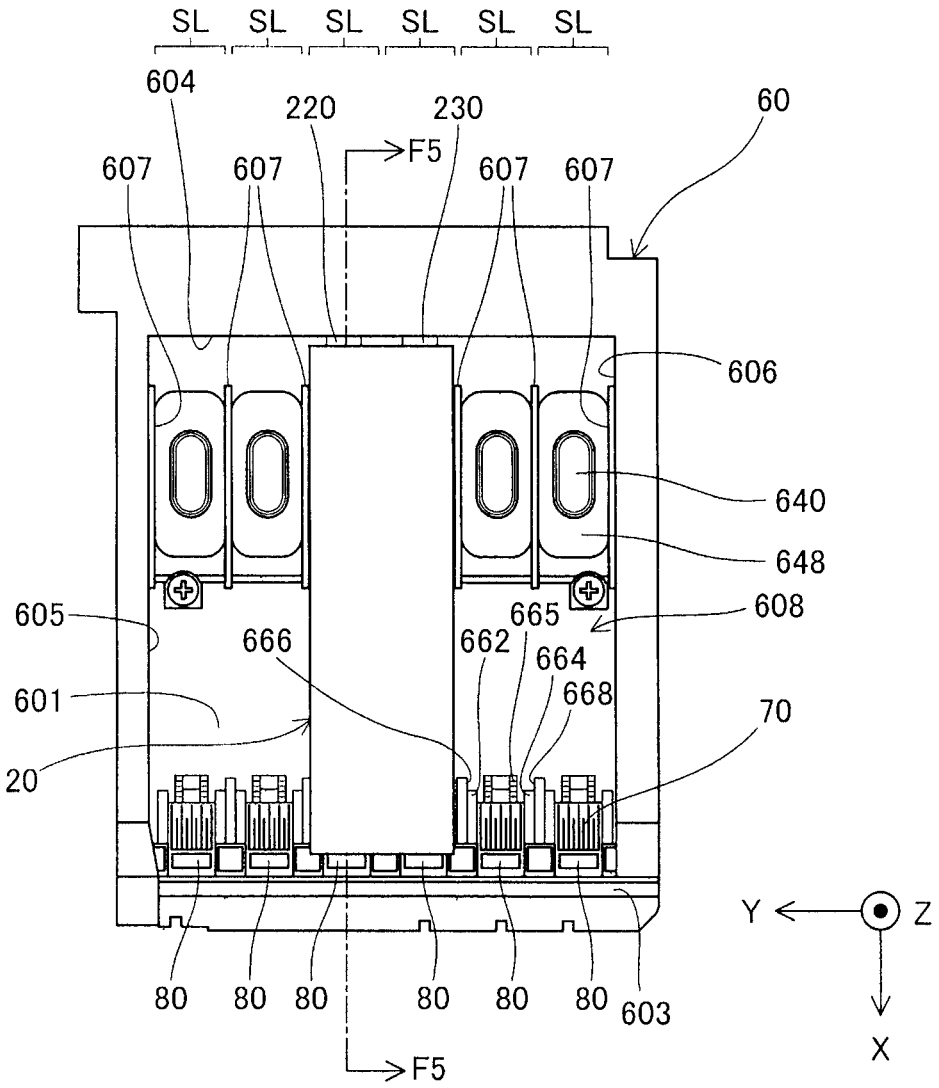
FIG. 4 is an upper surface diagram illustrating a holder where a cartridge is mounted.
Figure 5:
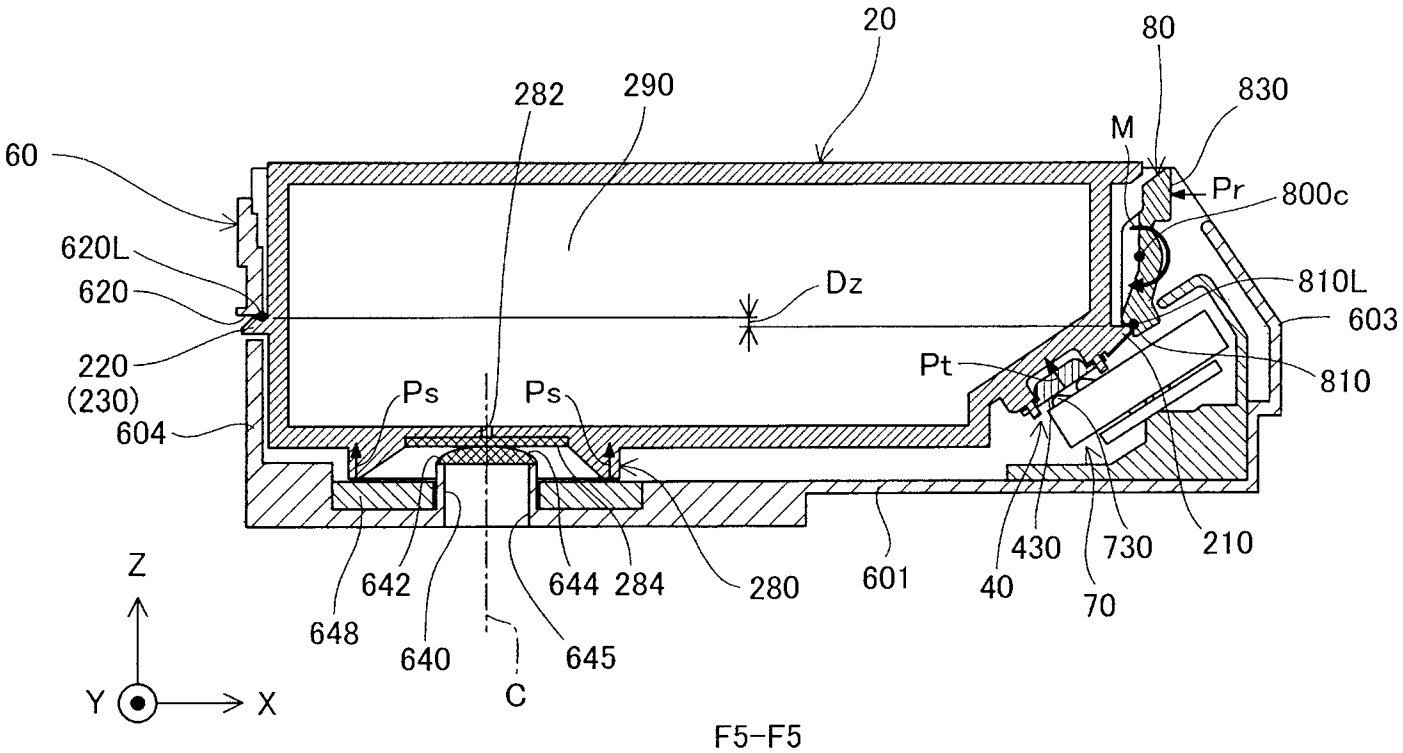
FIG. 5 is a cross-sectional diagram illustrating a cross section of a holder where a cartridge is mounted along an arrow in FIG. 4.
Figure 6:
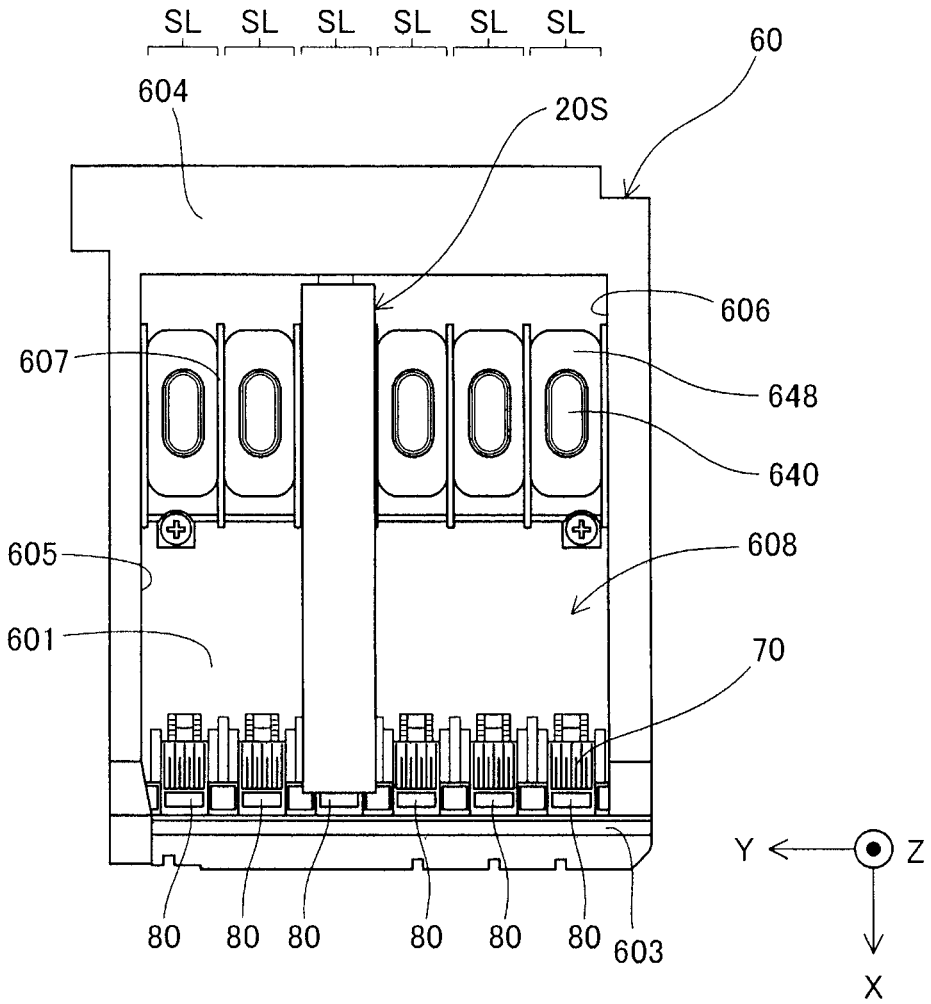
FIG. 6 is an upper surface diagram illustrating a holder where a different cartridge is mounted.

FIG. 2 and FIG. 3 are perspective diagrams illustrating the holder 60 where the cartridge 20 is mounted. FIG. 4 is an upper surface diagram illustrating the holder 60 where the cartridge 20 is mounted. FIG. 5 is a cross-sectional diagram illustrating a cross section of the holder 60 where the cartridge 20 is mounted along an arrow F5-F5 in FIG. 4. FIG. 6 is an upper surface diagram illustrating the holder 60 where a different cartridge 20S is mounted. FIG. 2 to FIG. 5 show a state where one of the cartridges 20 is correctly mounted in a designed mounting position on the holder 60. FIG. 6 shows a state where one of the cartridges 20S is correctly mounted in a designed mounting position on the holder 60.

The holder 60 of the printer 50 has a wall section 601, a wall section 603, a wall section 604, a wall section 605, a wall section 606, and the five wall sections form a cartridge mounting space 608 which is a space which receives the inputting of the cartridge 20. The wall section 601 defines the −Z axial direction side of the cartridge mounting space 608. The wall section 603 defines the +X axial direction side of the cartridge mounting space 608. The wall section 604 defines the −X axial direction side of the cartridge mounting space 608. The wall section 605 defines the +Y axial direction side of the cartridge mounting space 608. The wall section 606 defines the −Y axial direction side of the cartridge mounting space 608.

The printer 50 includes a plurality of ink supply pipes (printing material supply pipes) 640 in the cartridge mounting space 608 of the holder 60. The plurality of ink supply pipes 640 project toward the +Z axial direction from the wall section 601.

A partition plate 607 projects between the two of the ink supply pipes 640 which are adjacent to each other out of the plurality of ink supply pipes 640. In the embodiment, other than between the two of the ink supply pipes 640 which are adjacent to each other, the partition plates 607 are provided at both ends of the arrangement of the plurality of ink supply pipes 640 (that is, at the +Y axial direction side and the −Y axial direction side). In the embodiment, the partition plate 607 is a member with a plate shape parallel to the ZX plane which passes through the Z axis and the X axis. In the embodiment, the partition plate 607 extends from the wall section 601 in the +Z axial direction. In the embodiment, the partition plate 607 extends to the +Z axial direction side more than a tip end section 642 of the ink supply pipe 640. In the embodiment, the length of the partition plate 607 along the Z axis is larger than the length of the ink supply pipe 640 along the Z axis.

As shown in FIG. 4 and FIG. 6, the cartridge mounting space 608 is divided into a plurality of slots SL corresponding to the ink supply pipes 640 respectively by the partition sections 607. In the embodiment, as shown in FIG. 4, it is possible to mount one of the cartridges 20 in two of the slots SL which are adjacent to each other. As shown in FIG. 6, the cartridge 20S which has a substantially half width in the Y axial direction can be mounted in each of the slots SL of the holder 60, as well as the cartridge 20. As shown in FIG. 2 to FIG. 5, along with the ink supply pipes 640, the printer 50 comprises a terminal platform 70, a lever 80, a terminal platform side latching section 810, a supply pipe side latching section 620, and engaging sections 662, 664, 665, 666, and 668 in each of the slots SL in the holder 60.

As shown in FIG. 4 and FIG. 5, the cartridge 20 includes a circuit board 40, a board side latching section 210, supply port side latching sections 220 and 230, two ink supply ports (printing material supply ports) 280, an ink containing section (a printing material containing section) 290 to match with the two slots SL which are adjacent to each other in the holder 60. In the embodiment, an ink flow path 282 is formed to be linked in common with the ink containing section 290 in each of the two ink supply ports 280 of the cartridge 20 and it is adapted to supply the ink from the ink containing section 290 to the outside of the cartridge 20 via the ink flow path 282. In the embodiment, a resin foam body 284, which prevents careless leaking of the ink from the ink flow path 282, is provided at an exit port side of the ink flow path 282 in each of the ink supply ports 280.

The ink supply pipe 640 of the printer 50 is adapted to supply the ink supplied from the ink containing section 290 of the cartridge 20 to the head 540 by being connected to the ink supply port 280 of the cartridge 20. The ink supply pipe 640 has the tip end section 642 which is connected to the cartridge side. A base end section 645 of the ink supply pipe 640 is provided at the wall section 601 which is the bottom surface of the holder 60. In the embodiment, as shown in FIG. 5, a central axis C of the ink supply pipe 640 is parallel to the Z axis and a direction, which is from the base end section 645 of the ink supply pipe 640 toward the tip end section 642 along the central axis C, is the +Z axial direction.

In the embodiment, a porous filter 644 which filters the ink from the cartridge 20 is provided on the tip end section 642 of the ink supply pipe 640. As the porous filter 644, for example, it is possible to use a stainless steel mesh, a stainless steel non-woven fabric, or the like. In another embodiment, the porous filter may be omitted from the tip end section 642 of the ink supply pipe 640.

In the embodiment, an elastic member 648, which prevents leaking of the ink from the ink supply port 280 to the surroundings by tightly sealing the ink supply port 280 of the carriage 20, is provided on the surroundings of the ink supply pipe 640 as shown in FIG. 2 to FIG. 5. A pressing force Ps which includes components in the +Z axial direction is imparted from the elastic member 648 to the ink supply port 280 in the cartridge 20 when the cartridge 20 is mounted on the holder 60.

As shown in FIG. 5, the terminal platform 70 of the printer 50 is provided more to the +X axial direction side than the ink supply pipe 640. Device side terminals 730 are provided on the terminal platform 70 so as to be electrically connected to cartridge side terminals 430 which are provided on the circuit board 40 of the cartridge 20. A pressing force Pt which includes components in the +Z axial direction is imparted from the terminal platform 70 to the circuit board 40 in the cartridge 20 when the cartridge 20 is mounted on the holder 60. The details of the circuit board 40 and the terminal platform 70 will be described later.

The terminal platform side latching section 810 in the printer 50 is provided on the wall section 603 of the holder 60 as a portion of the lever 80 and latchs to the board side latching section 210 at a first latching position 810L. The first latching position 810L is positioned more to the +Z axial direction side and the +X axial direction side than a position where the circuit board 40 and the terminal platform 70 come into contact. The terminal platform side latching section 810 limits movement of the cartridge 20 in the +Z axial direction by latching to the board side latching section 210.

The supply pipe side latching section 620 in the printer 50 is provided on the wall section 604 of the holder 60 and is configured to latch to the supply port side latching sections 220 and 230 at a second latching position 620L. The second latching position 620L is positioned more to the +Z axial direction side and the −X axial direction side than the ink supply pipe 640. The supply pipe side latching section 620 limits movement of the cartridge 20 in the +Z axial direction by latching to the supply port side latching sections 220 and 230.

Attaching and detaching of the cartridge 20 is performed while the cartridge 20 is rotated along a plane which is parallel to the Z axis and the X axis with the vicinity of the supply port side latching section 220 and the supply pipe side latching section 620 as a rotation pivot during attaching and detaching of the cartridge 20 to the holder 60. The details of the attaching and detaching operation of the cartridge 20 to the holder 60 will be described later.

The lever 80 of the printer 50 has a rotation pivot 800*c* more to the +Z axial direction side and the +X axial direction side than the first latching position 810L where the terminal platform side latching section 810 is latched to the board side latching section 210. As a result, a rotation moment M is generated in a direction shown in FIG. 5 in the lever 80 when the cartridge 20 attempts to move in the +Z axial direction. As a result, it is possible to prevent careless releasing of the latching of the board side latching section 210 due to the terminal platform side latching section 810.

The lever 80 is configured so that the terminal platform side latching section 810 latches and releases the board side latching section 210 with the rotation of the terminal platform side latching section 810 from the first latching location 810L in the +X axial direction. An operation section 830, which is adapted to receive an operation force Pr toward the −X axial direction due to the user, is provided on the lever 80 more to the +Z axial direction side and the +X axial direction side than the rotation pivot 800*c*. When the operation force Pr is imparted to the operation section 830 by the user, the latching of the board side latching section 210 using the terminal platform side latching section 810 is released by the lever 80 being rotated so that the terminal platform side latching section 810 moves from the first latching location 810L in the +X axial direction. Accordingly, the cartridge 20 can be removed from the holder 60. The details of the lever 80 will be described later.

As shown in FIG. 5, when the cartridge 20 is mounted on the holder 60, the first latching position 810L is positioned more to the −Z axial direction side than the second latching position 620L with a distance Dz. As a result, the pressing forces Ps and Pt from the holder 60 to the cartridge 20 act in a direction which strengthens the latching of the board side latching section 210 and the terminal platform side latching section 810 (a direction which includes +X axial components and +Z axial components) in a relationship of balancing the moment with the second latching position 620L as the rotation pivot of the cartridge 20. Accordingly, it is possible to stably maintain the cartridge 20 in the designed mounting position.

The engaging sections 662, 664, 665, 666, and 668 of the printer 50 engage with each section of the cartridge 20. Accordingly, it is possible to prevent positional deviation of the circuit board 40 to the holder in the Y axial direction and it enables the cartridge side terminals 430 to come into contact with the device side terminals 730 in the correct position.

A-3. Detailed Configuration of Cartridge

Figure 7:
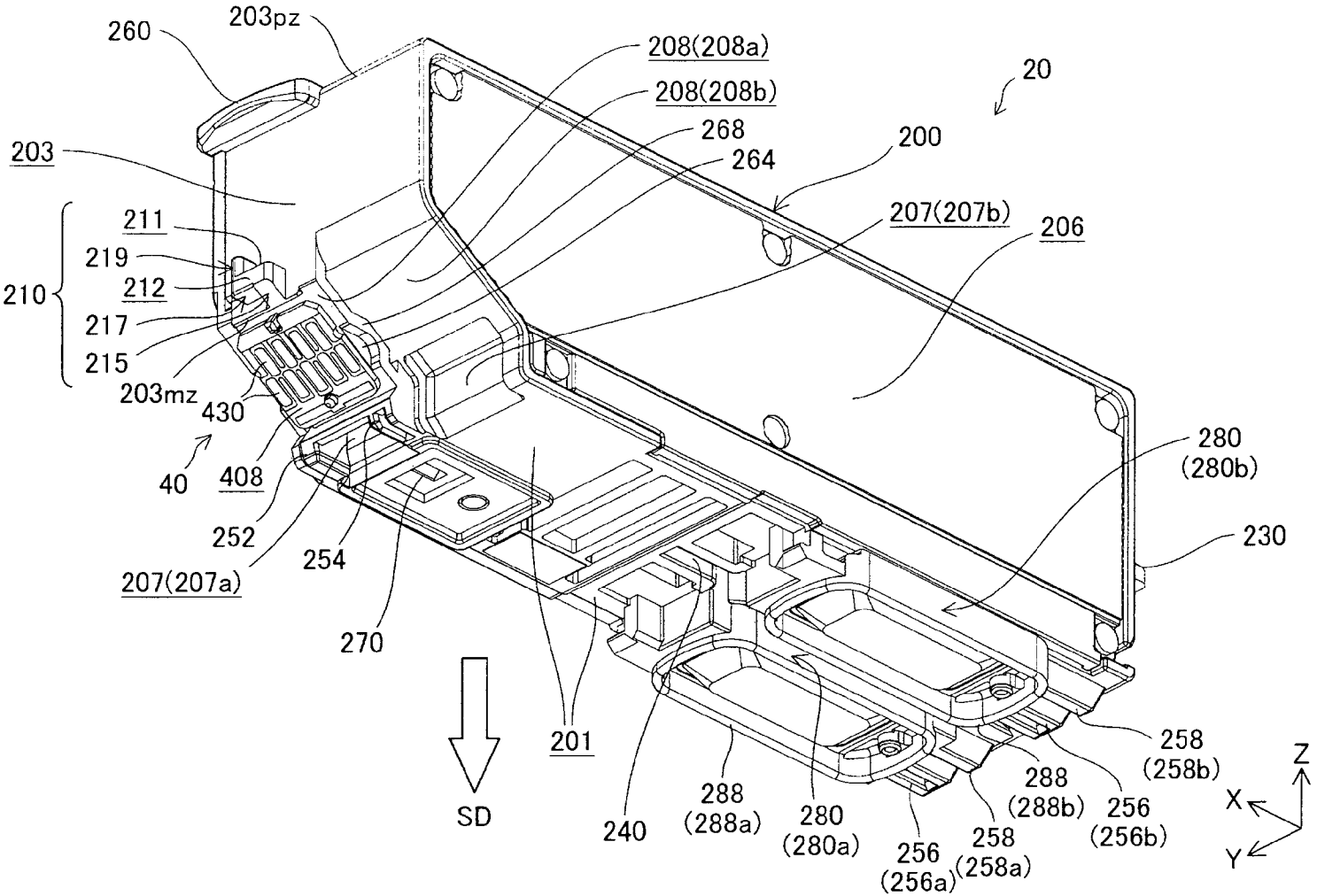
FIG. 7 is a perspective diagram illustrating a configuration of a cartridge.
Figure 8:
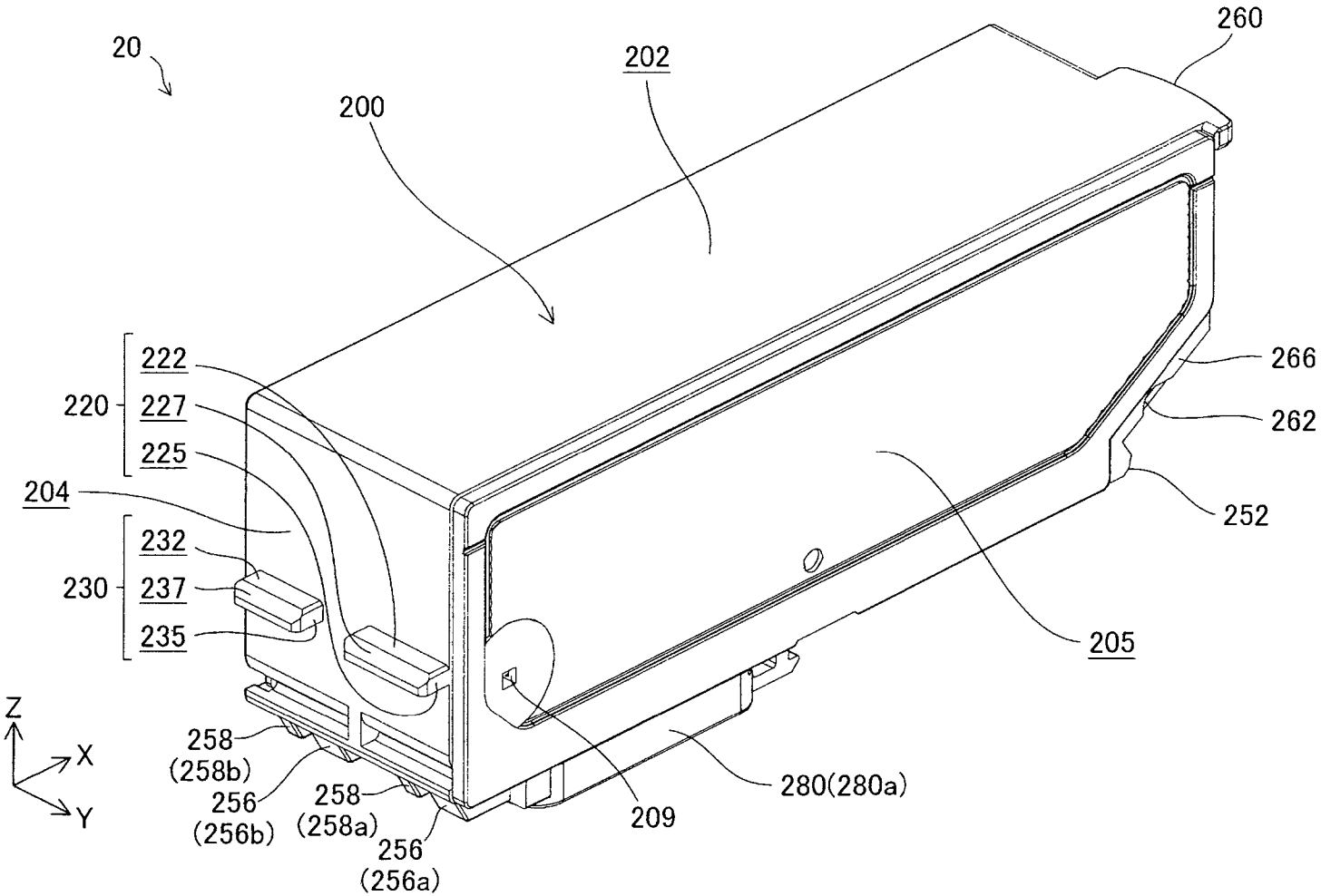
FIG. 8 is a perspective diagram illustrating a configuration of a cartridge.
Figure 9:
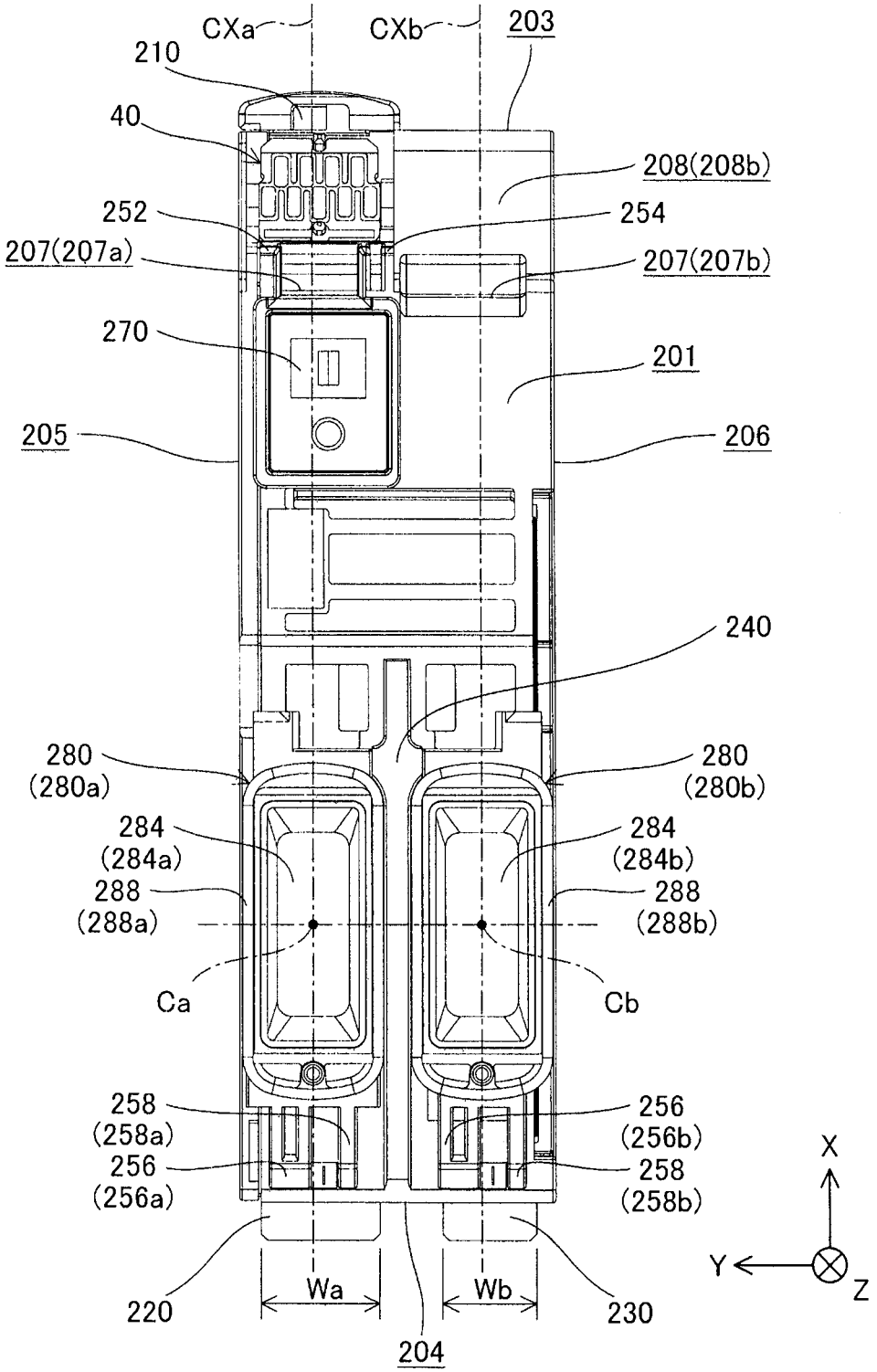
FIG. 9 is a bottom surface diagram illustrating a configuration of a cartridge.
Figure 10:
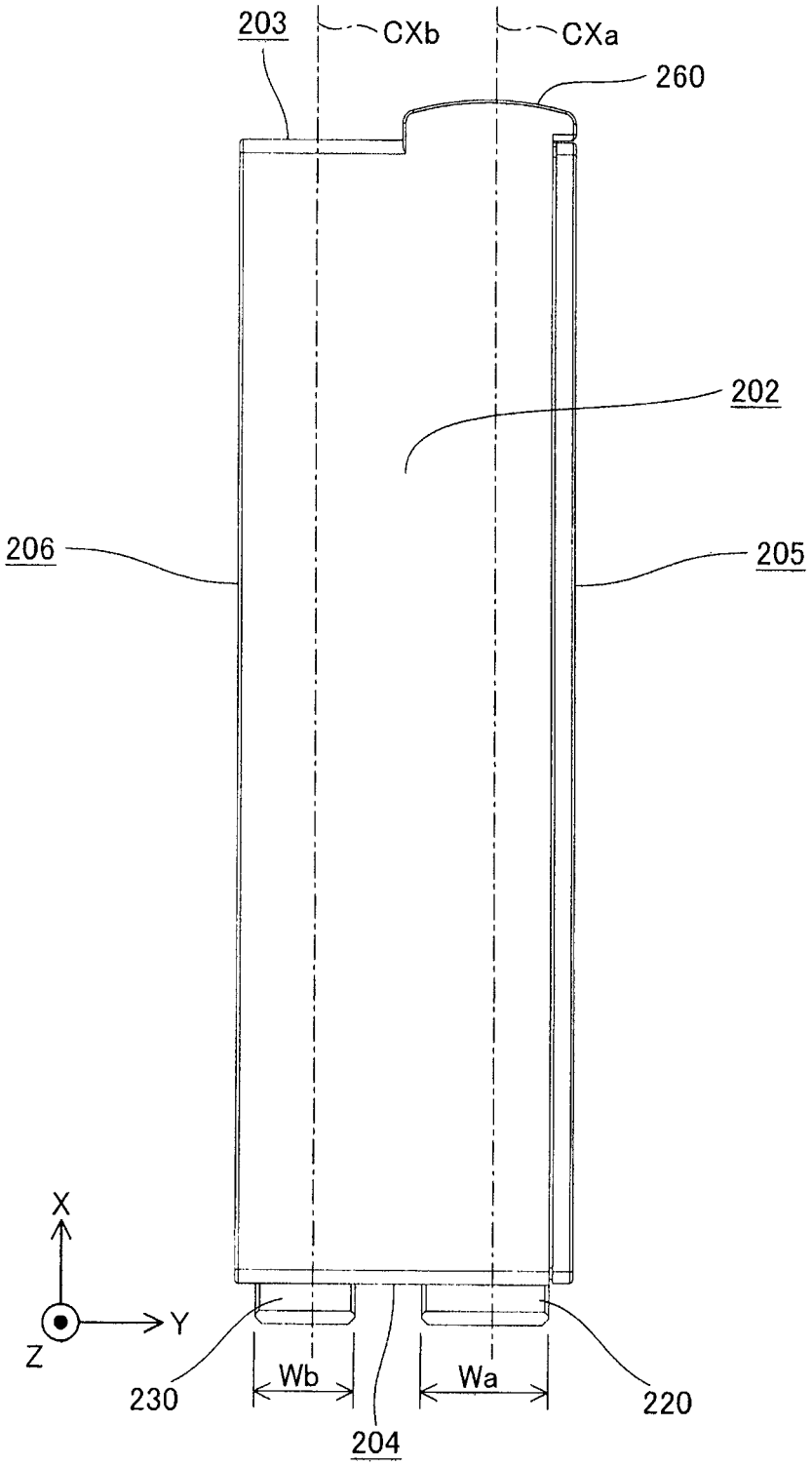
FIG. 10 is an upper surface diagram illustrating a configuration of a cartridge.
Figure 11:
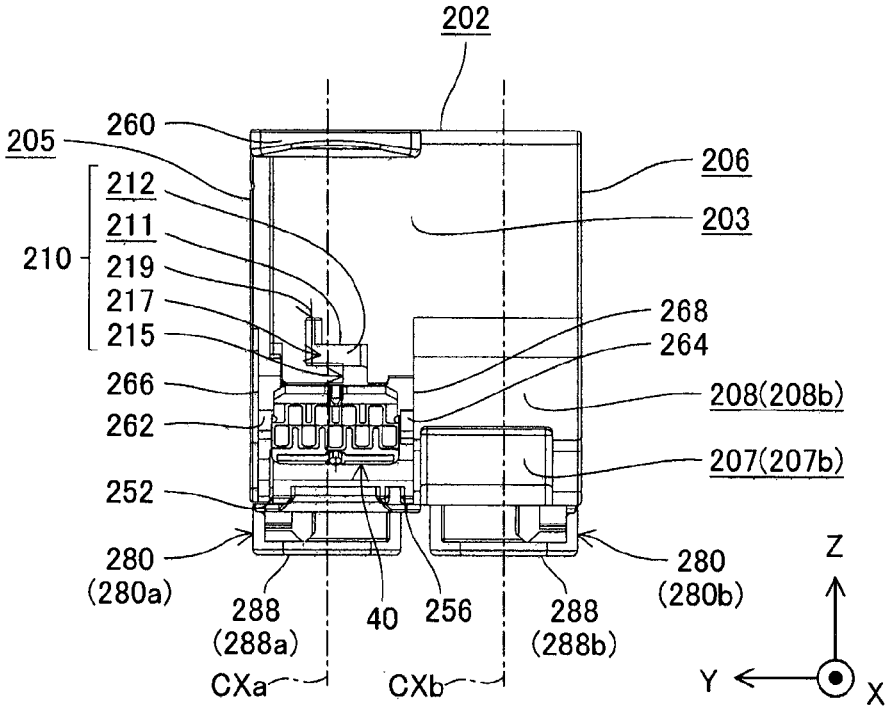
FIG. 11 is a front surface diagram illustrating a configuration of a cartridge.
Figure 12:
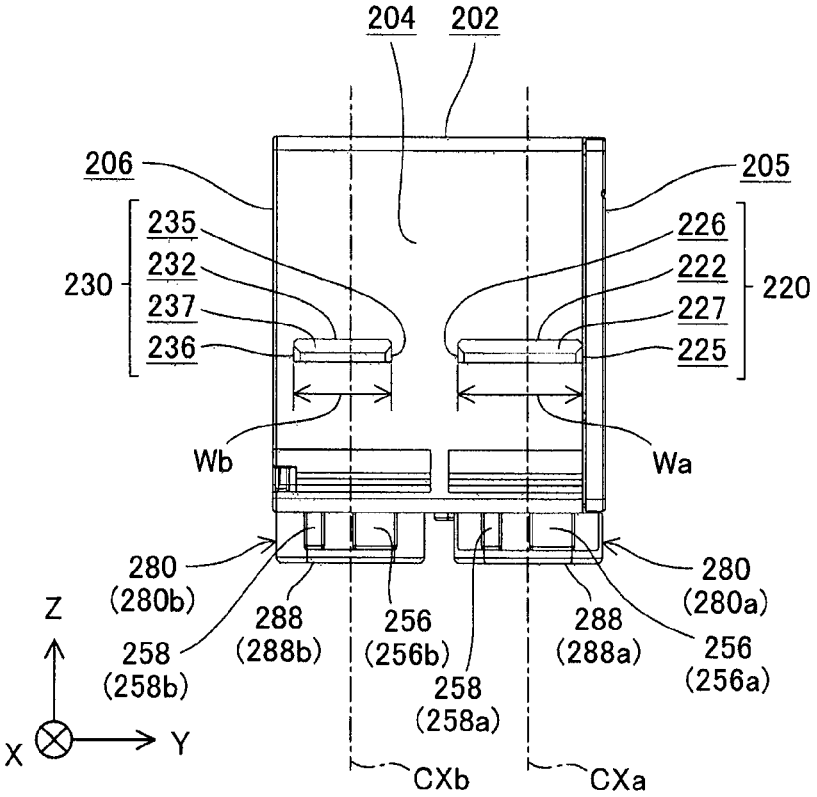
FIG. 12 is a rear surface diagram illustrating a configuration of a cartridge.
Figure 13:
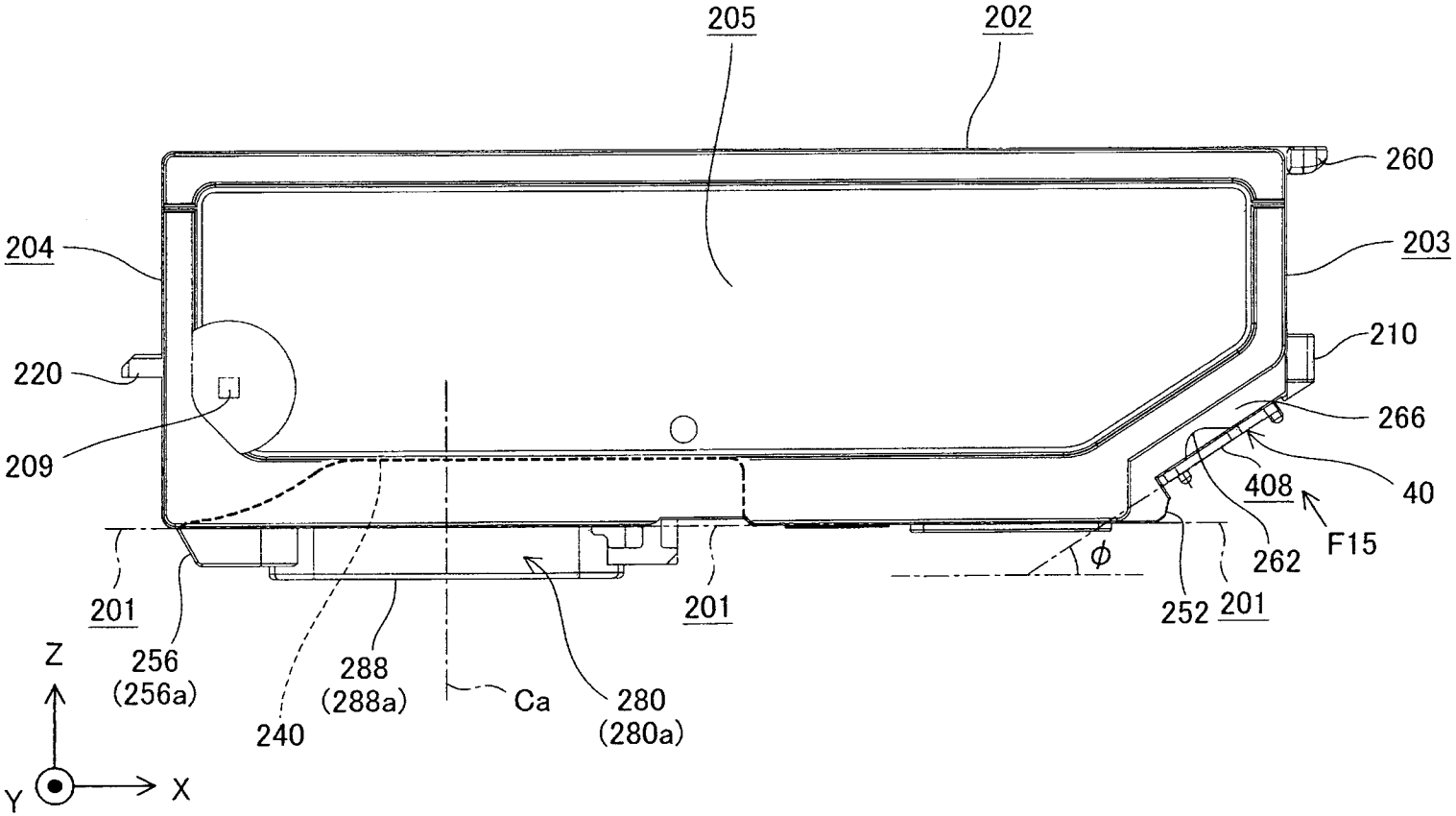
FIG. 13 is a left side surface diagram illustrating a configuration of a cartridge.
Figure 14:
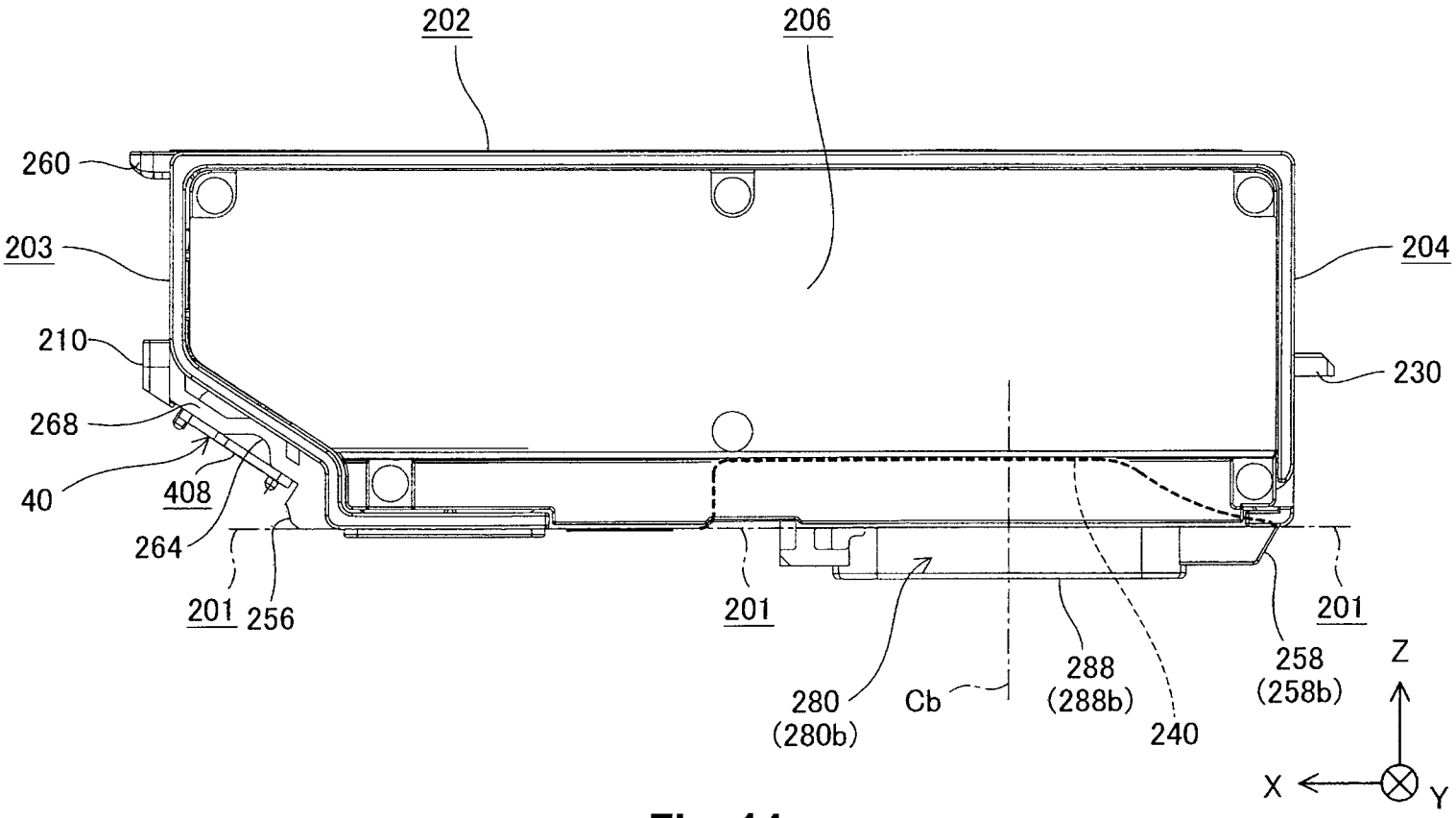
FIG. 14 is a right side surface diagram illustrating a configuration of a cartridge.

FIG. 7 and FIG. 8 are perspective diagrams illustrating the configuration of the cartridge 20. FIG. 9 is a bottom surface diagram illustrating the configuration of the cartridge 20. FIG. 10 is an upper surface diagram illustrating the configuration of the cartridge 20. FIG. 11 is a front surface diagram illustrating the configuration of the cartridge 20. FIG. 12 is a rear surface diagram illustrating the configuration of the cartridge 20. FIG. 13 is a left side surface diagram illustrating the configuration of the cartridge 20. FIG. 14 is a right side surface diagram illustrating the configuration of the cartridge 20.

In the explanation of the cartridge 20, the X axis, the Y axis, and the Z axis are axes on the cartridge to the cartridge 20 which is in the mounting state of being mounted on the holder 60. In the embodiment, the +X axial direction side is the front surface of the cartridge 20 in the mounting state where the cartridge 20 is mounted on the holder 60. In the embodiment, a mounting direction SD when the cartridge 20 is mounted on the holder 60 is the −Z axial direction.

In the explanation of the embodiment, a reference numeral "280" is used in cases when both of the two ink supply ports 280 in the cartridge 20 are being referred to, a reference numeral "280*a*" is used in cases indicating the ink supply port on the +Y axial direction side, and a reference numeral "280*b*" is used in cases indicating the ink supply port on the −Y axial direction side.

A central axis Ca shown in FIG. 9 and FIG. 13 corresponds to the central axis C of the ink supply pipe 640 which is connected to the ink supply port 280*a* in the mounting state where the cartridge 20 is mounted on the holder 60, and in the embodiment, is the central axis of the ink supply port 280*a*. A central plane CXa shown in FIG. 9 to FIG. 12 is a plane which passes through the central axis Ca and which is parallel to the Z axis and the X axis. That is, the central plane CXa is a plane which passes through the center of the length along the Y axis of the ink supply port 280*a* and is orthogonal to the Y axis.

A central axis Cb shown in FIG. 9 and FIG. 14 corresponds to the central axis C of the ink supply pipe 640 which is connected to the ink supply port 280*b*, and in the embodiment, is the central axis of the ink supply port 280*b*. A central plane CXb shown in FIG. 9 to FIG. 12 is a plane which passes through the central axis Cb and which is parallel to the Z axis and the X axis. That is, the central plane CXb is a plane which passes through the center of the length along the Y axis of the ink supply port 280*b* and is orthogonal to the Y axis. In the explanation of the embodiment, a reference numeral "CX" is used when both of the plane CXa and the plane CXb are being referred to.

As shown in FIG. 7 to FIG. 14, the cartridge 20 comprises an outer shell 200 with a rectangular body as a basis. The cartridge has a first surface 201, a second surface 202, a third surface 203, a fourth surface 204, a fifth surface 205, and a sixth surface 206 as six flat surfaces which configure the outer shell 200. In the embodiment, the cartridge 20 has a seventh surface 207 and an eighth surface 208 along with the six of the first surface 201 to the sixth surface 206. The ink containing section 290 is formed at the inner side of the first surface 201 to the eighth surface 208.

The first surface 201 to the eighth surface 208 are formed substantially as flat surfaces, it is not necessary for the entire area of the surface to be completely flat and there may be bumps on a portion of the surface. In the embodiment, the first surface 201 to the eighth surface 208 are the outer surfaces of an assembly which is assembled from a plurality of members. In the embodiment, the first surface 201 to the eighth surface 208 are formed by members with a plate form. In another embodiment, a portion of the first surface 201 to the eighth surface 208 may be formed by members with a film form (thin film form). The first surface 201 to the eighth surface 208 are made of resin and are made of a material (for example, polyacetal (POM)) which is possible to obtain rigidity higher than polypropylene (PP) in the embodiment.

In the embodiment, the length (length in the X axial direction), the width (length in the Y axial direction), and the height (length in the Z axial direction) of the cartridge 20 are ordered as length, height, and width when compared in terms of size. It is possible to arbitrarily change the size relationship of the length, the width, and the height of the cartridge 20, and for example, there may be the order of height, length, and width, or the height, the length, and the width may be the same.

The first surface 201 and the second surface 202 of the cartridge 20 are surfaces which are parallel to the X axis and the Y axis and have a positional relationship so as to oppose each other in the Z axial direction. The first surface 201 is positioned on the −Z axial direction side and the second surface 202 is positioned on the +Z axial direction side. The first surface 201 and the second surface 202 have a positional relationship so as to intersect with the third surface 203, the fourth surface 204, the fifth surface 205, and the sixth surface 206. Here, in the embodiment, the "intersecting" of two surfaces has the intent of any of the state such that two surfaces intersect by being linked to each other, an extended surface of one of the surfaces intersects with the other surface, and extended surfaces intersect with each other. In the embodiment, the first surface 201 configured the bottom surface of the cartridge 20 and the second surface 202 configures the upper surface of the cartridge 20 in the mounting state where the cartridge 20 is mounted on the holder 60.

The two ink supply ports 280 are provided on the first surface 201 as shown in FIG. 7 and FIG. 9. Each of the ink supply ports 280 protrude from the first surface 201 in the −Z axial direction and have opening edges 288 with an opening in a surface which is parallel to the X axis and the Z axis in an edge section in the −Z axial direction. In the explanation of the embodiment, a reference numeral "288" is used in cases when both of the opening edges of the ink supply ports 280 are being referred to, a reference numeral "288*a*" is used in cases indicating the opening edge of the ink supply port 280*a*, and a reference numeral "288*b*" is used in cases indicating the opening edge of the ink supply port 280*b*.

In the embodiment, the opening edges 288 of the ink support ports 280 are sealed by a sealing member (not shown) such as a cap or a film during shipping of the cartridge 20 from the factory. After this, the sealing member (not shown) which seals the opening edge 288 is removed from the cartridge 20 during mounting of the cartridge 20 on the holder 60.

In the embodiment, as shown in FIG. 9, the resin foam bodies 284 are provided on an inner side in the +Z axial direction side from the opening edges 288 at the inner side of the ink supply ports 280. In the explanation of the embodiment, a reference numeral "284" is used in cases when both of the foam resin bodies of the ink supply ports 280 are being referred to, a reference numeral "284*a*" is used in cases indicating the foam resin body of the ink supply port 280*a*, and a reference numeral "284*b*" is used in cases indicating the foam resin body of the ink supply port 280*b*.

In the embodiment, the ink supply ports 280 of the cartridge 20 protrude in the −Z axial direction with the central axis C of the ink supply pipe 640 in the holder 60 as the center. In another embodiment, the center of the ink supply port 280 may deviate from the central axis C of the ink supply pipe 640. In the embodiment, the opening edges 288 of the ink supply ports 280 viewed from the −Z axial direction to the +Z axial direction has line symmetrical contours to axes which are respectively parallel the X axis and the Y axis. In another embodiment, there may be contours which are not line symmetrical. In the embodiment, the opening edge 288 has a rectangular shape with rounded corners when the opening is viewed from the Z axial direction as shown in FIG. 9. In another embodiment, it may have shape such as a circle, an ellipse, an oval, a square, or a rectangle.

As shown in FIG. 7, FIG. 9, FIG. 13, and FIG. 14, a groove section 240 is provided between the two ink supply ports 28 in the first surface 201 in a position which corresponds to the partition plate 607 in the holder 60. As shown by the dashed line in FIG. 13 and FIG. 14, the groove section 240 is provided to be concave more to the +Z axial direction side than the first surface 201 and is configured so that it is adapted to receive the partition plate 607 when the ink supply ports 280 are connected to the ink supply pipe 640. The length of the groove section 240 along the X axis is larger than the length of the partition plate 607 along the X axis. The length of the groove section 240 along the Y axis is larger than the length of the partition plate 607 along the Y axis.

As shown in FIG. 7 and FIG. 9, an optical element 270 is provided on the first surface 201 in a position which cuts across the plane CXa. The optical element 270 is adapted to optically detect ink in the ink containing section 290 from the outside of the cartridge 20. In the embodiment, the optical element 270 includes a prism which is arranged to come into contact with the ink which is contained in the ink containing section 290. Light which is emitted toward the prism from the outside of the cartridge 20 passes through the prism when the vicinity of the prism is filled with ink. On the other hand, the light which is emitted toward the prism from the outside of the cartridge 20 is reflected by the prism when there is no ink in the vicinity of the prism. The printer 50 receives the light which is reflected by the prism using an optical sensor (not shown). In this manner, the presence or absence of ink in the ink containing section 290 can be detected based on the presence or absence of the reflected light from the prism. Here, the absence of ink includes a state where only little ink remains.

The third surface 203 and the fourth surface 204 of the cartridge 20 are surfaces which are parallel to the Y axis and the Z axis and have a positional relationship so as to oppose each other in the X axial direction. The third surface 203 is positioned on the +X axial direction side and the fourth surface 204 is positioned on the −X axial direction side. The third surface 203 and the fourth surface 204 have a positional relationship so as to intersect with the first surface 201, the second surface 202, the fifth surface 205, and the sixth surface 206. In the embodiment, the third surface 203 configures the front surface of the cartridge 20 and the fourth surface 204 configures the rear surface of the cartridge 20 in the mounting state where the cartridge 20 is mounted on the holder 60.

As shown in FIG. 7 and FIG. 11, the board side latching section 210 is provided on the third surface 203 in a position which cuts across the plane CXa. The board side latching section 210 is provided more to the +Z axial direction side and the +X axial direction side than the ink supply port 280 and the circuit board 40. The board side latching section 210 has a latching surface 211 which faces the +Z axial direction and is configured to limit movement of the cartridge 20 in the +Z axial direction by the terminal platform side latching section 810 which is positioned at the first latching location 810L being latched to the latching surface 211 due to the rotation of the lever 80.

In the embodiment, the board side latching section 210 has a latching surface 212 which faces the +X axial direction in addition to the latching surface 211 which faces the +Z axial direction and is configured to limit the movement of the cartridge 20 in the +Z axial direction and the +X axial direction by the terminal platform side latching section 810 which is positioned at the first latching position 810L being latched to the latching surface 211 and the latching surface 212 due to the rotation of the lever 80. Accordingly, it is possible to maintain the cartridge 20 in the designed mounting position in a more stable state.

In the embodiment, the board side latching section 210 is a convex section which protrudes from the third surface 203 in the +X axial direction. Accordingly, it is possible to easily form the board side latching section 210 in the third surface 203. In addition, it enables the user to easily identify the board side latching section 210 during mounting of the cartridge 20.

In the embodiment, the board side latching section 210 is provided closer to an edge 203*mz* on the −Z axial direction side in the third surface 203 than an edge 203*pz* on the +Z axial direction side in the third surface 203. In the embodiment, the −Z axial direction side of the board side latching section 210 is adjacent to the edge 203*mz* on the −Z axial direction side of the third surface 203, therefore, it is also adjacent to the circuit board 40 which is provided on the eighth surface. In another embodiment, the board side latching section 210 may be separated from the edge 203*mz* on the −Z axial direction side of the third surface 203 and may be closer to the edge 203*pz* on the +Z axial direction side of the third surface 203

In the embodiment, the board side latching section 210 has a part 215, a part 217, and a part 219 as shown in FIG. 7 and FIG. 11. The part 215 is formed in a shape which is linked to the −Z axial direction side of the part 217 and rises toward the part 217 from the third surface 203 and toward the +X axial direction side while heading toward the +Z axial direction. The part 217 is formed in a convex shape which interests with the plane CXa and which rises towards the +X axial direction from the third surface. The part 219 is formed in a convex shape which is linked to the +Z axial direction side of the part 217 and rises toward the +X axial direction side from the third surface 203. In the embodiment, the board side latching section 210 is a convex section in the shape of a letter L which protrudes from the third surface with an L shape where the two sides are respectively parallel to the Y axis and the Z axis, the part 217 configures a part which is parallel with the Y axis of the convex section with the L shape, and the part 219 configures a part which is parallel with the Z axis of the convex section with the L shape.

In the embodiment, the latching surface 211 of the board side latching section 210 is formed as a plane which faces the +Z axial direction in the part 217. That is, the latching surface 211 is a plane which is parallel to the X axis and the Y axis. In the embodiment, the latching surface 212 of the board side latching section 210 is formed as a plane which faces the +X axial direction in the part 217. That is, the latching surface 212 is a plane which is parallel to the Y axis and the Z axis.

In the embodiment, since the board side latching section 210 has the part 215 adjacent in the −Z axial direction side of the part 217 where the latching surface 211 is formed, it is possible to smoothly lead the terminal platform side latching section 810 in the holder 60 toward the latching surface 211 of the board side latching section 210 when the cartridge 20 is mounted on the holder 60.

In the embodiment, since the board side latching section 210 has the part 219 adjacent in the +Z axial direction side of the part 217 where the latching surface 211 is formed, it is possible to prevent the lever 80 from riding up on top of the +Z axial direction side of the latching surface 211 when the cartridge 20 is mounted on the holder 60.

In the embodiment, the length of the board side latching section 210 along the Y axis is larger than a length Wa of the supply port side latching section 220 along the Y axis as shown in FIG. 9. In the embodiment, the length of the board side latching section 210 along the Y axis is larger than the length of the circuit board 40 along the Y axis.

In the embodiment, a protruding section 260 is formed on the third surface 203. The protruding section 260 is formed in a shape such that the second surface 202 extends in the +X axial direction and protrudes from the third surface 203 in the +X axial direction. Since the protruding section 260 is formed on the cartridge 20, user can easily lift the cartridge 20 in the +Z axial direction with the supply port side latching section 220 as the rotation pivot by moving his or her finger from the operation section 830 of the lever 80 to the protruding section 260 when removing the cartridge 20 from the holder 60. In another embodiment, the protruding section 260 may be omitted from the third surface 203.

As shown in FIG. 8, FIG. 9, and FIG. 12, the supply port side latching section 220 is provided on the fourth surface 204 in a position which cuts across the plane CXa. The supply port side latching section 220 is provided more to the +Z axial direction side and the −X axial direction side than the ink supply port 280 and the circuit board 40. The supply port side latching section 220 has a latching surface 222 which faces the +Z axial direction and is configured to limit movement of the cartridge 20 in the +Z axial direction by the supply port side latching section 620 in the holder 60 being latched to the latching surface 222.

As shown in FIG. 8, FIG. 9, and FIG. 12, the supply port side latching section 230 is provided on the fourth surface 204 in a position which cuts across the plane CXb. The supply port side latching section 230 is provided more to the +Z axial direction side and the −X axial direction side than the ink supply port 280 and the circuit board 40. The supply port side latching section 230 has a latching surface 232 which faces the +Z axial direction and is configured to limit movement of the cartridge 20 in the +Z axial direction by the supply port side latching section 620 in the holder 60 being latched to the latching surface 232.

In the embodiment, the supply port side latching sections 220 and 230 are configured so as to function as the rotation pivot of the cartridge 20 to the holder 60 by being engaged with the supply pipe side latching section 620 when mounting the cartridge 20 on the holder 60. Accordingly, it is possible to easily perform attaching and detaching of the cartridge 20 to the holder 60.

In the embodiment, the supply port side latching sections 220 and 230 are convex sections which protrude to the −X axial direction from the fourth surface 204. Accordingly, it is possible to easily form the supply port side latching sections 220 and 230 in the fourth surface 204. In addition, it enables the user to easily identify the supply port side latching sections 220 and 230 when mounting the cartridge 20.

In the embodiment, the latching surface 222 of the supply port side latching section 220 is formed as a flat surface facing the +Z axial direction which configures a convex section which protrudes to the −X axial direction from the fourth surface 204, and the latching surface 232 of the supply port side latching section 230 is formed as a flat surface facing the +Z axial direction which configures a convex section which protrudes to the −X axial direction from the fourth surface 204. That is, the latching surfaces 222 and 223 are flat surfaces which are parallel to the X axis and the Y axis.

In the embodiment, the supply port side latching section 220 has an inclined surface 227 which is adjacent to the −X axial direction side of the latching surface 222 and the supply port side latching section 230 has an inclined surface 237 which is adjacent to the −X axial direction side of the latching surface 232. The inclined surfaces 227 and 237 are inclined toward the +Z axial direction and the −X axial direction. Accordingly, it is possible to smoothly lead the latching surfaces 222 and 232 toward the supply pipe side latching section 620 in the holder 60 when the cartridge 20 is mounted on the holder 60. In another embodiment, the inclined surfaces 227 and 237 may be omitted.

In the embodiment, the length Wa of the supply port side latching section 220 in the Y axial direction is substantially the same as the length of the circuit board 40 in the Y axial direction as shown in FIG. 9. In the embodiment, the length Wa along the Y axial direction of the supply port side latching section 220 is larger than a length Wb along the Y axial direction of the supply port side latching section 230 as shown in FIG. 9 and FIG. 12. That is, the distance between a side surface 225 on the +Y axial direction side and a side surface 226 on the −Y axial direction side in the supply port side latching section 220 is larger than the distance between a side surface 235 on the +Y axial direction side and a side surface 236 on the −Y axial direction side in the supply port side latching section 230. Accordingly, it is possible to prevent inclination of the cartridge 20 in the Y axial direction due to the supply port side latching section 230 without lowering operability when mounting the cartridge 20 on the holder 60 while preventing positional deviation of the cartridge 20 along the Y axis due to the supply port side latching section 220.

The fifth surface 205 and the sixth surface 206 of the cartridge 20 are surfaces which are parallel to the Z axis and the X axis and have a positional relationship so as to oppose each other in the Y axial direction. The fifth surface 205 is positioned on the +Y axial direction side and the sixth surface 206 is positioned on the −Y axial direction side. The fifth surface 205 and the sixth surface 206 have a positional relationship so as to intersect with the first surface 201, the second surface 202, the third surface 203, and the fourth surface 204. In the embodiment, the fifth surface 205 configures the left side surface of the cartridge 20 and the sixth surface 206 configures the right side surface of the cartridge 20 in the mounting state where the cartridge 20 is mounted on the holder 60.

As shown in FIG. 8 and FIG. 13, an air introduction port 209 is provided on the fifth surface 205. The air introduction port 209 communicates with a space in the inside of the outer shell 200. In the embodiment, air is introduced from the air introduction port 209 into the ink containing section 290 at a predetermined timing according to the consumption of the ink in the ink containing section 290. In another embodiment, air may be introduced from the air introduction port 209 into the ink containing section 290 at any time with decreasing the ink in the ink containing section 290. Furthermore, in another embodiment, the ink containing section 290 may be a closed space where air is not introduced.

As shown in FIG. 7, the seventh surface 207 of the cartridge 20 is configured as a corner portion which connects between the first surface 201 and the third surface 203 along with the eighth surface 208. The seventh surface 207 includes a seventh surface 207*a* which is provided closer to the +Y axial direction and a seventh surface 207*b* which is provided closer to the −Y axial direction. In the explanation of the embodiment, a reference numeral "207" is used in cases where both the seventh surface 207*a* and the seventh surface 207*b* are being referred to.

The seventh surface 207 is a surface which is formed to extend from the first surface 201 to the +Z axial direction side, links with the eighth surface 208 at the +Z axial direction side, and links with the first surface 201 at the −Z axial direction side. In the embodiment, the seventh surface 207 is a surface which is parallel to the Y axis and the Z axis and has a positional relationship which opposes the fourth surface 204.

As shown in FIG. 7, the eighth surface 208 of the cartridge 20 is configured as a corner portion which connects between the first surface 201 and the third surface 203 along with the eighth, surface 208. The eighth surface 208 includes an eighth surface 208*a* which is provided closer to the +Y axial direction and an eighth surface 208*b* which is provided closer to the −Y axial direction. In the explanation of the embodiment, a reference numeral "208" is used in cases where both the eighth surface 208*a* and the eighth surface 208*b* are being referred to.

The eighth surface 208 is a surface which is formed more to the +Z axial direction side than the seventh surface 207, links with the third surface 203 at the +Z axial direction side, and links with the seventh surface 207 at the −Z axial direction side. In the embodiment, the eighth surface 208 is inclined toward the −Z axial direction and the +X axial direction as shown in FIG. 7, FIG. 13, and FIG. 14. That is, the eighth surface is an inclined surface which links between the first surface 201 and the third surface 203 and is inclined to the first surface 201 and the third surface 203.

As shown in FIG. 9, the circuit board 40 is provided in a position which cuts across the plane CXa. As shown in FIG. 7 and FIG. 13, the circuit board 40 has a cartridge side inclined surface 408. The cartridge side inclined surface 408 is inclined towards the −Z axial direction and the +X axial direction to the first surface 201 and the third surface 203 when the circuit board 40 is provided on the eighth surface 208. The cartridge side terminals 430 are provided on the cartridge side inclined surface 480 and the cartridge side terminals 430 on the circuit board 40 in the cartridge 20 come into contact with the device side terminals 730 on the terminal platform 70 in the holder 60 when the cartridge 20 is mounted on the holder 60.

It is preferable for an angle ϕ where the cartridge side inclined surface 408 is inclined to a flat surface which is parallel to the X axis and the Y axis (the flat surface where the opening edge 288 of the ink supply port 280 is positioned) to be 25° to 40° as shown in FIG. 13. By the angle of the cartridge side inclined surface 408 being 25° or more, it is possible to secure a sufficient wiping amount. Wiping is scraping of the cartridge side terminals 430 on the cartridge side inclined surface 408 using the device side terminals 730 on the terminal platform 70 when the cartridge 20 is mounted on the holder 60. Then, the wiping amount is a length of which the cartridge side terminals 430 can scrape the device side terminals 730. Due to the wiping, it is possible to remove dust and dirt which has become attached onto the cartridge side terminals 430 and reduce connection defects between the cartridge side terminals 430 and the device side terminals 730. By the angle of the cartridge side inclined surface 408 being 40° C. or less, it is possible to secure sufficient components in the +Z axial direction which are included in the pressing force Pt to the circuit board 40 from the device side terminals 730 which are provided on the terminal platform 70.

In the embodiment, board side engaging sections 252 and 254 are provided on the seventh surface of the cartridge 20 as shown in FIG. 7, FIG. 9, and FIG. 11. The board side engaging section 252 of the cartridge 20 projects toward the +X axial direction of the seventh surface 207 closer to the +Y axial direction and the board side engaging section 254 of the cartridge 20 projects toward the +X axial direction of the seventh surface 207 closer to the −Y axial direction. The board side engaging sections 252 and 254 are branched off from each other on an axis which is parallel to the Y axis on the −Z axial direction side of the circuit board 40 and are configured to engage with an engaging section 665 when the engaging section 665 is interposed between the board side engaging section 252 and the board side engaging section 254 in the holder 60 shown in FIG. 4. Accordingly, it is possible to prevent positional deviation of the circuit board 40 to the holder 60 in the X axial direction and the Y axial direction and it enables the cartridge side terminals 430 to come into contact with the device side terminals 730 at the correct position. In the embodiment, the length of the board side engaging section 252 along the Y axis is different than the length of the board side engaging section 254 along the Y axis in order to prevent erroneous mounting of the cartridge 20 on the holder 60.

In the embodiment, board port side engaging sections 256 and 258 are provided on the first surface of the cartridge 20 as shown in FIG. 7, FIG. 9, and FIG. 12. The supply port side engaging section 256 projects from the first surface which faces the −Z axial direction to be adjacent to the −X axial direction side of the ink supply port 280 closer to the +Y axial direction, and the supply port side latching section 258 projects from the first surface which faces the −Z axial direction to be adjacent to the −X axial direction side of the ink supply port 280 closer to the −Y axial direction. The board port side engaging sections 256 and 258 are configured to engage with engaging sections (not shown) in the holder 60. Accordingly, it is possible to prevent positional deviation of the ink supply port 280 to the holder 60 in the X axial direction and the Y axial direction and it is possible to connect the ink supply port 280 to the holder 60 at the correct position. In the embodiment, the length of the supply port side engaging section 256 along the Y axis is different than the length of the supply port side latching section 258 along the Y axis in order to prevent erroneous mounting of the cartridge 20 on the holder 60. In the explanation of the embodiment, reference numerals "256 and 258" are used in cases when both of the supply port side engaging sections are being referred to, reference numerals "256*a* and 258*a*" are used in cases indicating the supply port side engaging section which is adjacent to the ink supply port 280*a*, and reference numerals "256*b* and 258*b*" are used in cases indicating the supply port side engaging section which is adjacent to the ink supply port 280*b*.

In the embodiment, a board side surface engaging section 262 which has a flat surface which is parallel to the Z axis and the X axis toward the +Y axial direction is provided adjacent to the +Y axial direction side of the circuit board 40 and a board side surface engaging section 264 which has a flat surface which is parallel to the Z axis and the Y axis toward the −Y axial direction is provided adjacent to the −Y axial direction side of the circuit board 40 in the cartridge 20 as shown in FIG. 7 and FIG. 11. The board side surface engaging sections 262 and 264 are configured to engage with the engaging sections 662 and 664 in the holder 60 shown in FIG. 4. Accordingly, it is possible to prevent positional deviation of the circuit board 40 to the holder 60 in the X axial direction and the Y axial direction, and it enables the cartridge side terminals 430 to come into contact with the device side terminals 730 at the correct position.

In the embodiment, a board side engaging section 266 which has a flat surface parallel to the Z axis and the Y axis toward the +Y axial direction is further provided on the +Y axial direction side of the board side surface engaging section 262 and a board side engaging section 268 which has a flat surface parallel to the Z axis and the Y axis toward the −Y axial direction is further provided on the −Y axial direction side of the board side surface engaging section 264 as shown in FIG. 7 and FIG. 11. The board side engaging sections 266 and 268 are configured to engage with the latching sections 666 and 668 in the holder 60 shown in FIG. 4. Accordingly, it is possible to prevent positional deviation of the circuit board 40 to the holder 60 in the X axial direction and the Y axial direction, and it enables the cartridge side terminals 430 to come into contact with the device side terminals 730 at the correct position.

Figure 15:
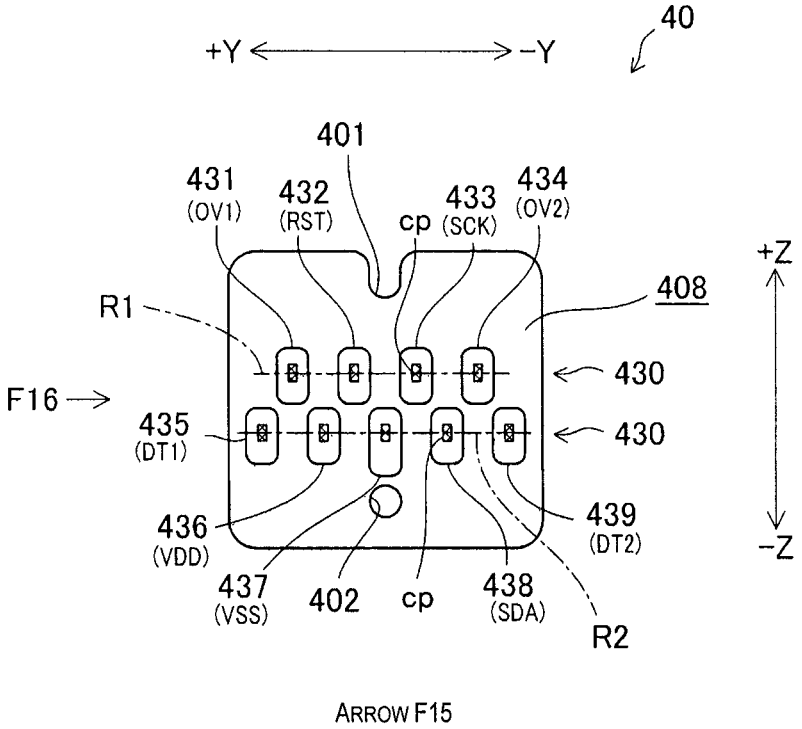
FIG. 15 is an explanatory diagram illustrating a detailed configuration of a circuit board of a cartridge.
Figure 16:
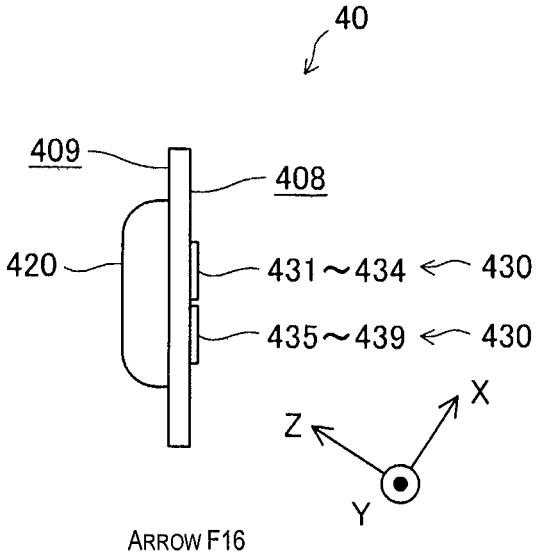
FIG. 16 is an explanatory diagram illustrating a detailed configuration of a circuit board of a cartridge.

FIG. 15 and FIG. 16 are explanatory diagrams illustrating a detailed configuration of the circuit board 40. FIG. 15 illustrates a configuration on the cartridge side inclined surface 408 of the circuit board 40 viewed from an arrow F15 in FIG. 13. FIG. 16 illustrates a configuration of the circuit board 40 viewed from an arrow F16 (+Y axial direction side) in FIG. 15.

In the embodiment, a boss groove 401 is provided on an edge portion in the +Z axial direction side of the circuit board 40 and a boss hole 402 is provided on an edge portion in the −Z axial direction side of the circuit board 40 as shown in FIG. 15. The circuit board 40 is fixed to the eighth surface 208 of the cartridge 20 using the boss groove 401 and the boss hole 402. In another embodiment, at least one of the boss groove 401 and the boss hole 402 may be omitted from the circuit board 40, and the circuit board 40 may be fixed to the eighth surface 208 using an adhesive agent or the circuit board 40 may be fixed using an engaging claw (not shown) which is provided on the eighth surface 208 side.

In the embodiment, nine cartridge side terminals 431 to 439 are provided on the cartridge side inclined surface 408 of the circuit board 40 as the cartridge side terminals 430 as shown in FIG. 15. The number of cartridge side terminals 430 in the circuit board 40 is not limited to nine, a change to an arbitrary number is possible, and there may be nine or less or may be nine or more. As shown in FIG. 16, it is preferable that the cartridge side terminals 431 to 439 be the same height from the cartridge side inclined surface 408 of the circuit board 40 as each other. In the explanation of the embodiment, a reference numeral "430" is used in cases when all of cartridge side terminals 431 to 439 are being referred to.

In the embodiment, a storage section 420 is provided on a rear surface 409 which is a side opposite to the cartridge side inclined surface 408 as shown in FIG. 16. In the embodiment, information relating to the ink in the cartridge 20 (for example, the remaining amount of ink and ink color) is stored in the storage device 420 of the circuit board 40.

Each of the cartridge side terminals 431 to 439 of the circuit board 40 has a contact portion cp which comes into contact with the device side terminals 730 which are provided on the terminal platform 70 of the holder 60. Out of the cartridge side terminals 431 to 439, four of the cartridge side terminals 431 to 434 are lined up along a terminal array R1 which is parallel to the Y axis on the +Z axial direction side and five of the cartridge side terminals 435 to 439 are lined up along a terminal array R2 which is parallel to the Y axis on the −Z axial direction side than the terminal array R1. Each of the contact portions cp of the cartridge side terminals 431 to 434 on the terminal array R1 are positioned on the terminal array R1 and each of the contact portions cp of the cartridge side terminals 435 to 439 on the terminal array R2 are positioned on the terminal array R2.

The cartridge side terminals 431 to 434 on the terminal array R1 are positioned more to the +Z axial direction side than the cartridge side terminals 435 to 439 on the terminal array R2 so that the cartridge side terminals 431 to 434 on the terminal array R1 and the cartridge side terminals 435 to 439 on the terminal array R2 do not overlap viewed from a direction along the Y axis. The cartridge side terminals 431 to 434 on the terminal array R1 and the cartridge side terminals 435 to 439 on the terminal array R2 are positioned to be different from each other so that the cartridge side terminals 431 to 434 on the terminal array R1 and the cartridge side terminals 435 to 439 on the terminal array R2 do not overlap viewed from a direction along the Z axial direction.

Five of the cartridge side terminals 432, 433, 436, 437, and 438 are electrically connected to the storage device 420. The cartridge side terminal 432 functions as a "reset terminal" which receives supply of a reset signal RST to the storage section 420. The cartridge side terminal 433 functions as a "clock terminal" which receives supply of a clock signal SCK to the storage section 420. The cartridge side terminal 436 functions as a "power source terminal" which receives supply of a power source voltage VDD (for example, standard 3.3 volts) to the storage section 420. The cartridge side terminal 437 functions as a "grounding terminal" which receives supply of a grounding voltage VSS (0 volts) to the storage section 420. The cartridge side terminal 438 functions as a "data terminal" which receives supply of a data signal SDA to the storage section 420.

Four of the cartridge side terminals 431, 434, 435, and 439 function as "mounting detection terminals" which are used for detection whether or not the cartridge 20 has been correctly mounted on the holder 60 from the holder 60 side. Each of the contact portions cp of the other cartridge side terminals 432, 433, 436, 437, and 438 exist in a rectangular region with each of the contact points cp of the four cartridge side terminals 431, 434, 435, and 439 as the four corners. In the embodiment, the four cartridge side terminals 431, 434, 435, and 439 are electrically connected to each other in an inner portion of the circuit board 40 and are electrically connected to a grounding line (not shown) on the printer 50 side via the cartridge side terminal 437 which functions as the grounding terminal when the cartridge 20 is mounted on the holder 60.

In the embodiment, the nine cartridge side terminals 431 to 439 in the circuit board 40 are electrically connected to the control section 510 of the printer 50 via the device side terminals 730 which are provided on the terminal platform 70 of the holder 60 in the mounting state where the cartridge 20 is mounted on the holder 60. Accordingly, it enables the control section 510 to perform detection of the mounting of the cartridge 20 and it is possible to perform reading and writing of information to the storage device 420 of the circuit board 40.

In the embodiment, the cartridge side terminal 437 which functions as the grounding terminal is configured so as to come in contact with the device side terminals 730 prior to the other cartridge side terminals 431 to 436, 438, and 439 when the cartridge 20 is mounted on the holder 60. Accordingly, it is possible to reduce defects due to a high voltage using the grounding function of the cartridge side terminal 437 even in a case where a high voltage which is not intended is applied to the cartridge 20 side.

In the embodiment, the cartridge side terminal 437 which functions as the grounding terminal is formed to be longer than the other cartridge side terminals 431 to 436, 438, and 439 in a direction along the Z axis. Accordingly, it enables contact between the cartridge side terminal 437 which functions as the grounding terminal and the device side terminals 730 to be more reliably executed before contact between the other cartridge side terminals 431 to 436, 438, and 439 and the device side terminals 730. In another embodiment, all of the cartridge side terminals 431 to 439 may be formed with the same size as each other.

Figure 17:
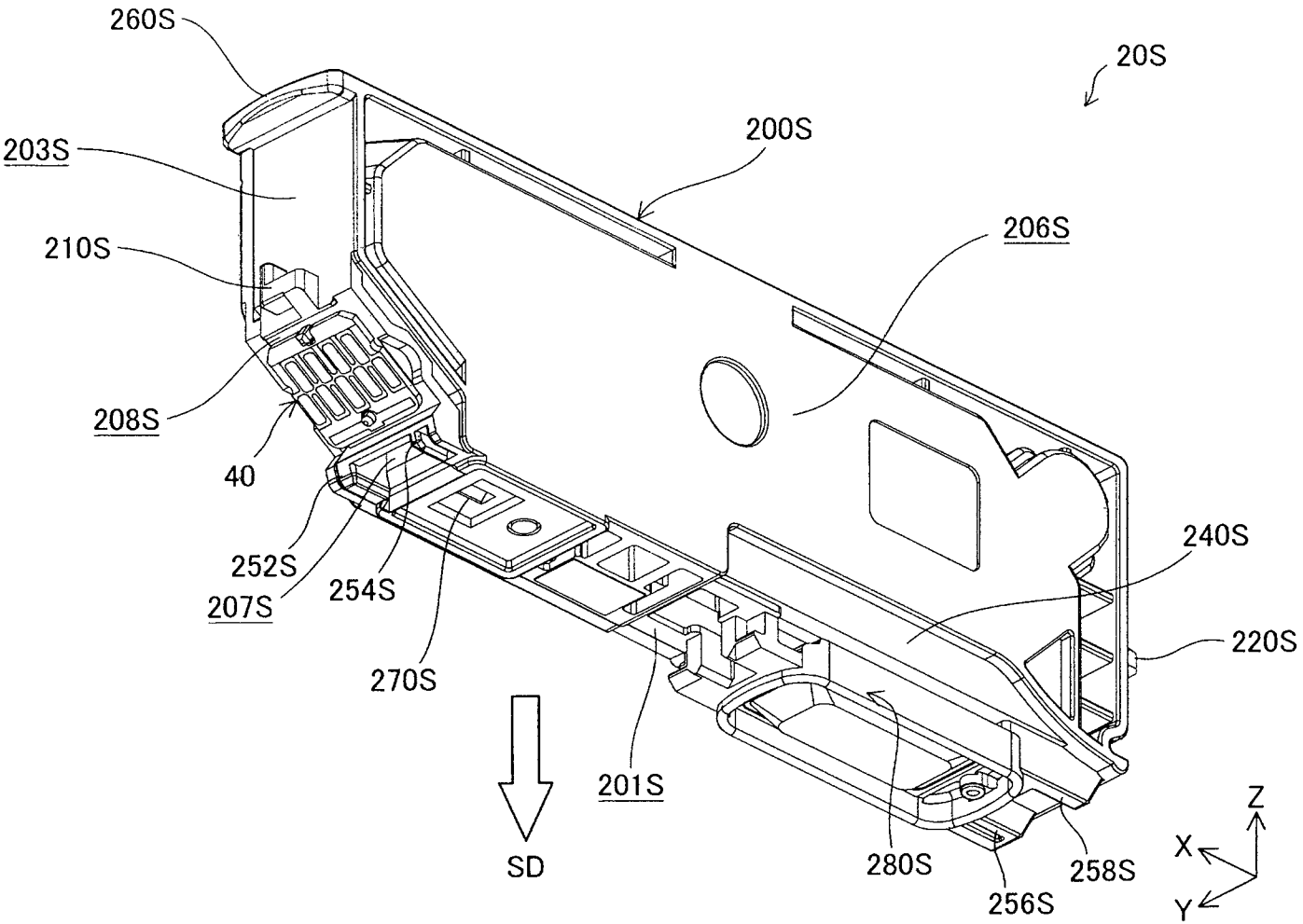
FIG. 17 is a perspective diagram illustrating another configuration of a cartridge.
Figure 18:
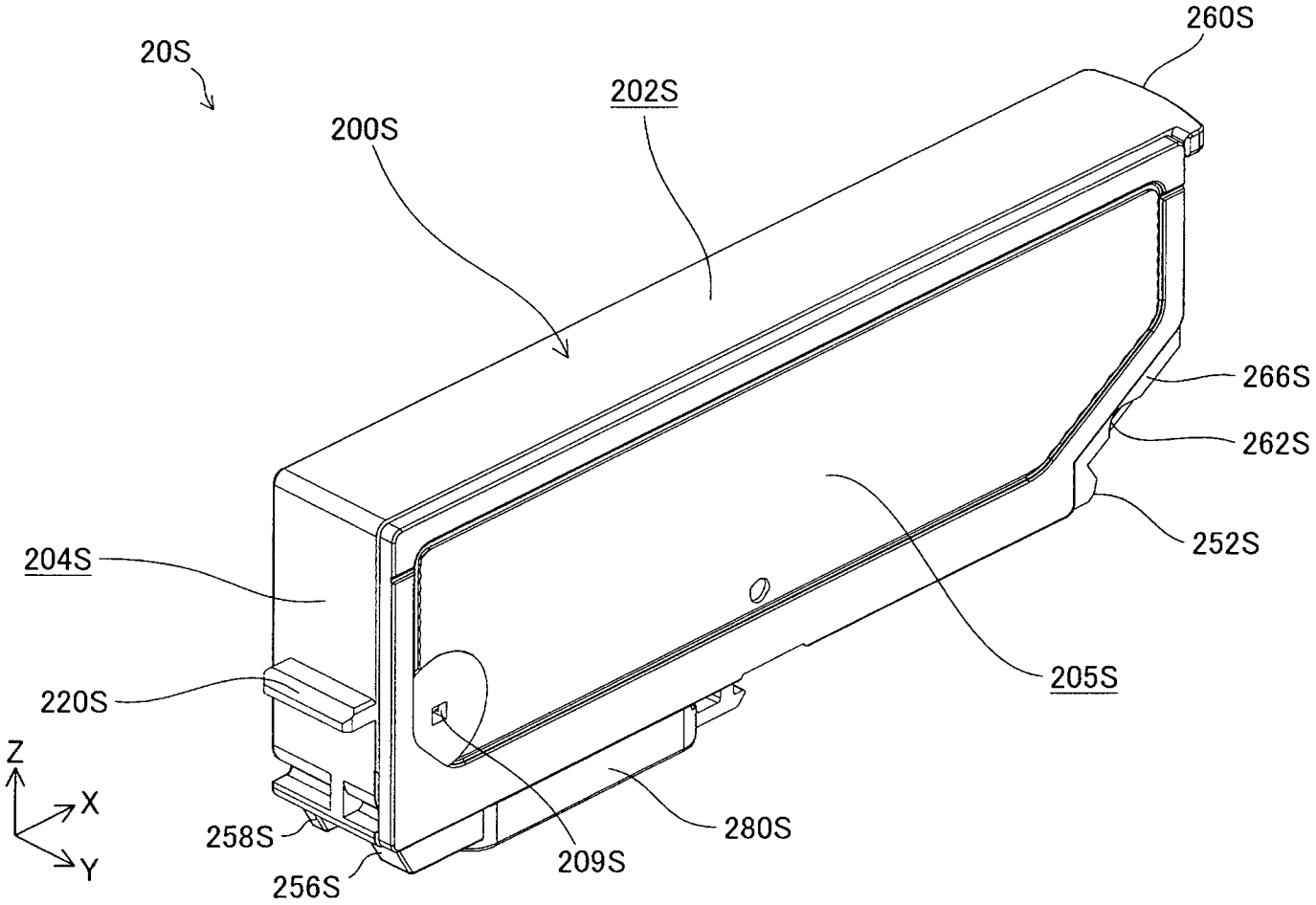
FIG. 18 is a perspective diagram illustrating another configuration of a cartridge.

FIG. 17 and FIG. 18 are perspective diagrams illustrating a configuration of a cartridge 20S. In the explanation of the cartridge 20S, a reference numeral where "S" is attached to the reference numeral is used to indicate the configuration of the cartridge 20 to configurations which are the same as or correspond to the configuration of the cartridge 20 and the description thereof is omitted.

The configuration of the cartridge 20S corresponds to a configuration with the plane CXa on the +Y axial direction side in the cartridge 20 as the center. The cartridge 20S comprises an outer shell 20S with a rectangular body as a basis. The cartridge 20S has a first surface 201S, a second surface 202S, a third surface 203S, a fourth surface 204S, a fifth surface 205S, and a sixth surface 206S as six flat surfaces which configure the outer shell 200S. In the embodiment, the cartridge 20S has a seventh surface 207S and an eighth surface 208S between the first surface 201S and the third surface 203S.

An optical element 270S, an ink supply port 280S, and supply port side engaging sections 256S and 258S are provided on the first surface 201S of the cartridge 20S. A board side latching section 210S is provided on the third surface 203S of the cartridge 20S. A supply port side latching section 220S is provided on the fourth surface 204S of the cartridge 20S. An air introduction port 209S is provided on the fifth surface 205S of the cartridge 20S.

A depression section 240S is provided on the sixth surface 206S of the cartridge 20S at a position which corresponds to the partition plate 607 of the holder 60. The depression section 240S is formed in a shape where a part closer to the −X axial direction out of the outer edge on the −Z axial direction side of the sixth surface 206S is depressed in the +Y axial direction and is configured so that a part on the +Y axial direction side of the partition plate 607 is received when the ink supply port 280S is connected to the ink supply pipe 640.

Board side engaging sections 252S and 254S are provided on the seventh surface 207S of the cartridge 20S. A circuit board 40S is provided on the eighth surface 208S of the cartridge 20S. The configuration of the circuit board 40S is the same as the circuit board 40 of the cartridge 20.

A-4. Detailed Configuration of Holder

Figure 19:
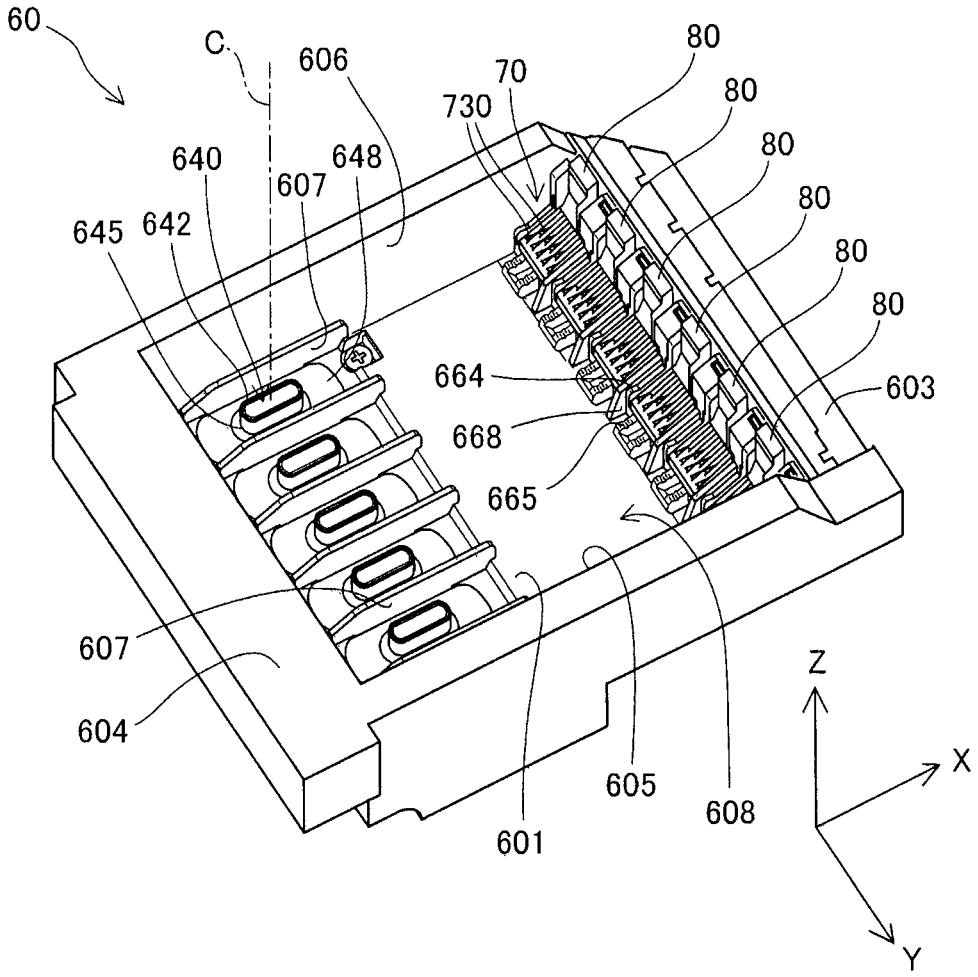
FIG. 19 is a perspective diagram illustrating a configuration of a holder.
Figure 20:
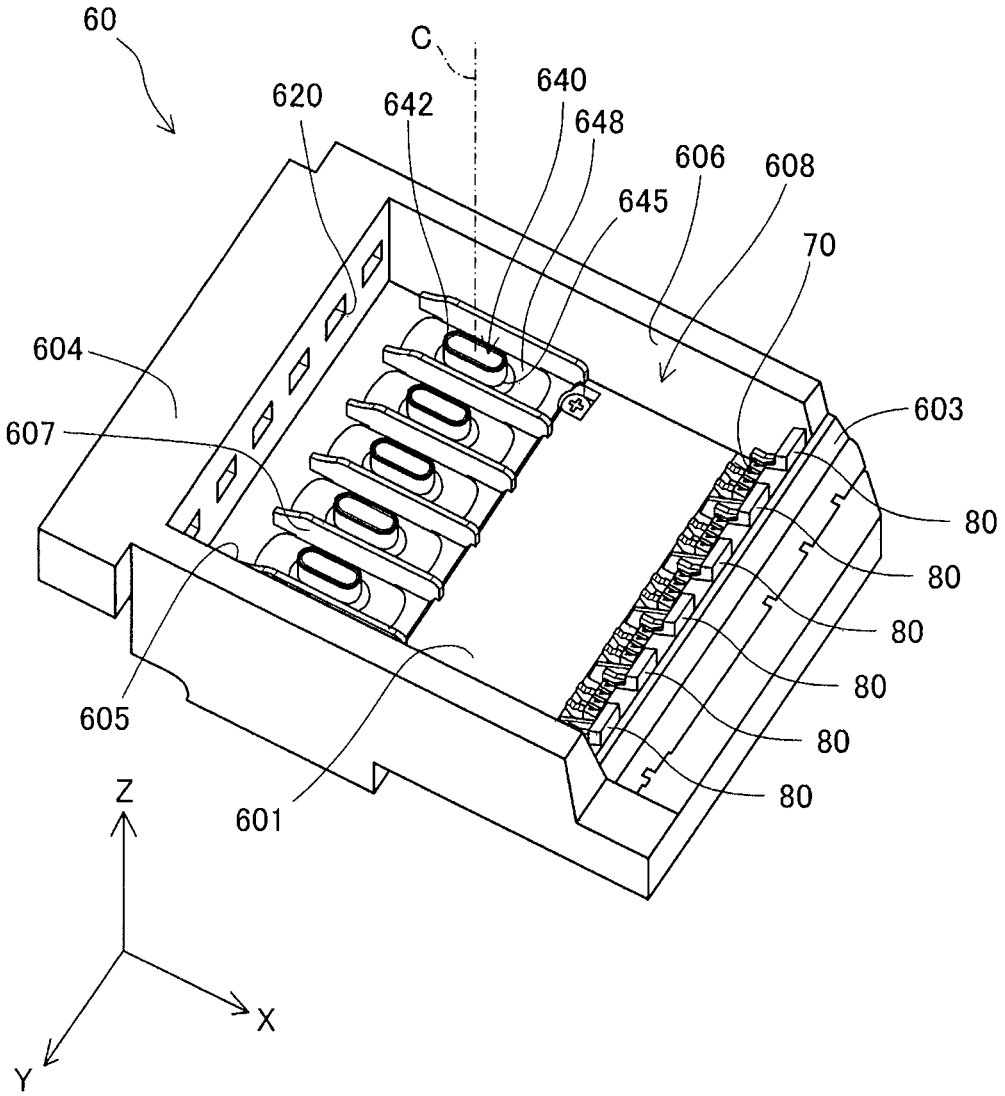
FIG. 20 is a perspective diagram illustrating a configuration of a holder.
Figure 21:
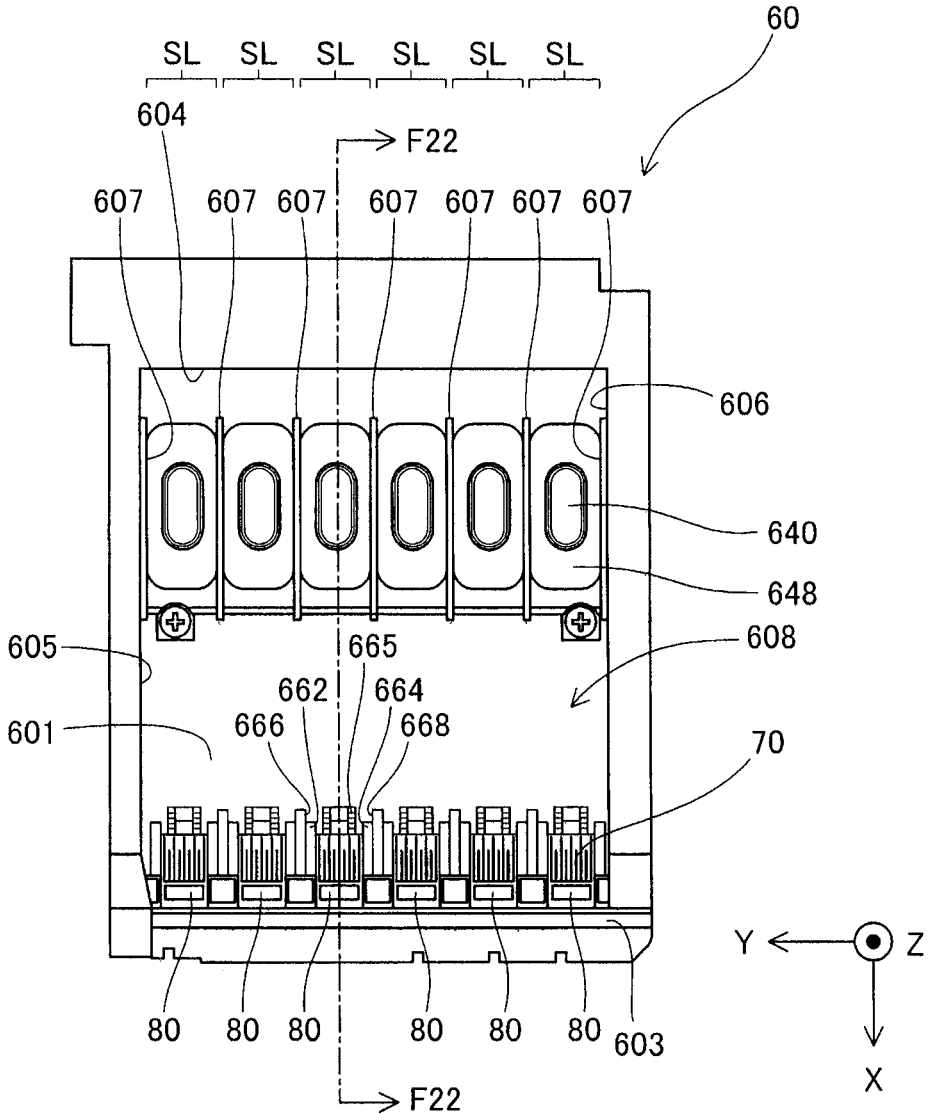
FIG. 21 is an upper surface diagram illustrating a configuration of a holder.
Figure 22:
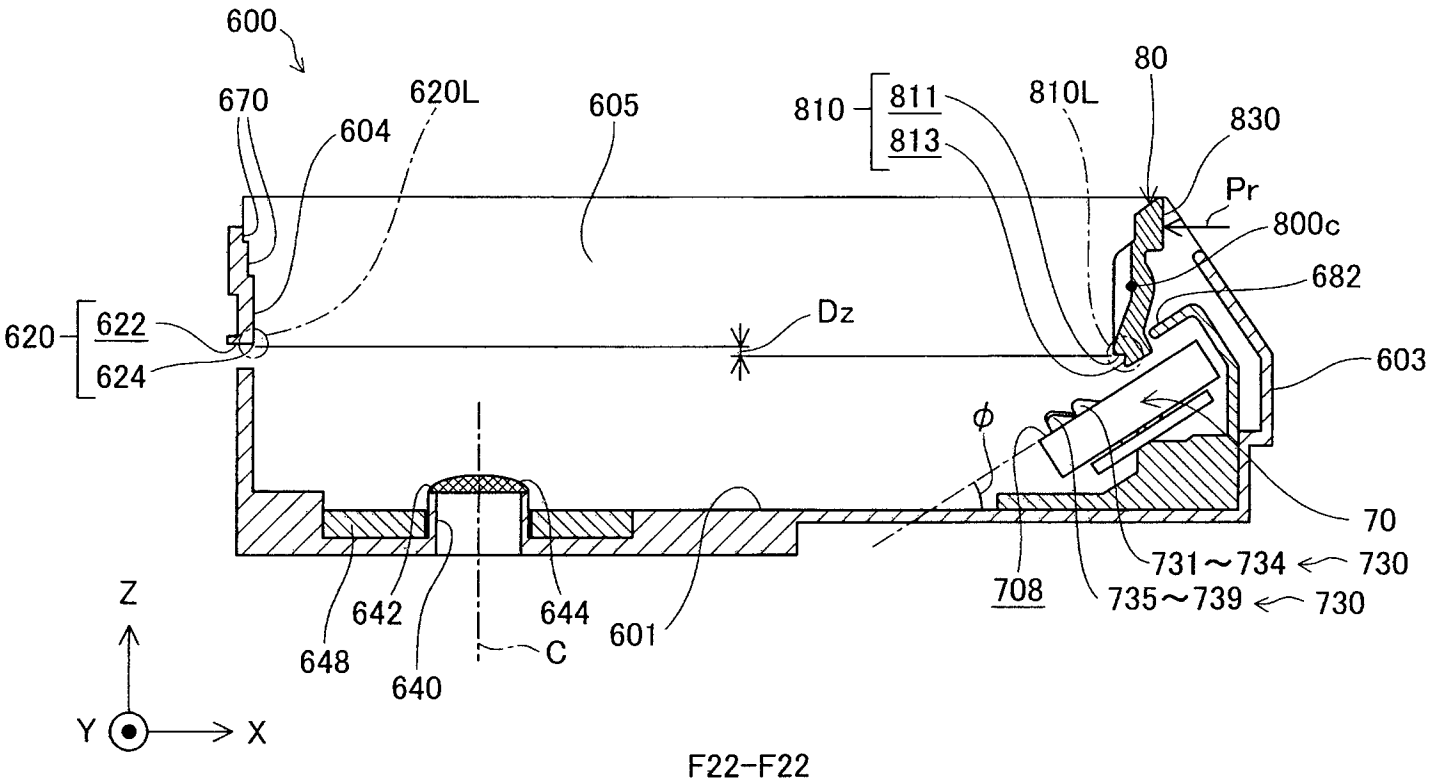
FIG. 22 is a cross-sectional diagram illustrating a cross section of a holder along an arrow in FIG. 21.

FIG. 19 and FIG. 20 are perspective diagrams illustrating a configuration of the holder 60. FIG. 21 is an upper surface diagram illustrating a configuration of the holder 60. FIG. 22 is a cross-sectional diagram illustrating a cross section of the holder 60 along an arrow F22-F22 in FIG. 21.

The holder 60 of the printer 50 has the five wall sections 601, 603, 604, 605, and 606 as wall surfaces which define the cartridge mounting space 608 as described above. In the embodiment, the five wall sections 601, 603, 604, 605, and 606 are formed by members with a plate shape. The five wall sections 601, 603, 604, 605, and 606 are made of resin and are made of a material (for example, modified polyphenylene ether (m-PPE)) where it is possible to obtain rigidity which is higher than polypropylene (PP) in the embodiment.

The wall section 601 of the holder 60 configures the bottom surface of a container body in the printer 50. The wall section 603 of the holder 60 rises up to the +X axial direction side of the wall section 601 and configures the front surface of the container body in the printer 50. The wall section 604 of the holder 60 rises up to the −X axial direction side of the wall section 601 and configures the rear surface of the container body in the printer 50. The wall section 605 of the holder 60 rises up to the −Y axial direction side of the wall section 601 and configures the left side surface of the container body in the printer 50. The wall section 606 of the holder 60 rises up to the +Y axial direction side of the wall section 601 and configures the right side surface of the container body being used in the printer 50. The wall section 603 and the wall section 604 have a positional relationship so as to oppose each other and the wall section 605 and the wall section 606 have a positional relationship so as to oppose each other.

The plurality of ink supply pipes 640 are provided on the wall section 601 of the holder as described above. The partition plate 607 projects between two of the ink supply pipes 640 which are adjacent to each other out of the plurality of ink supply pipes 640. In the embodiment, as described above, the porous filter 644 is provided on the tip end section 642 of the ink supply pipe 640 and the elastic member 648 is provided adjacent to the ink supply pipe 640 in the wall section 601. In the embodiment, the ink supply pipe 640 is provided closer to the wall section 604 (closer to the −X axial direction). In another embodiment, the ink supply pipe 640 may be provided closer to the wall section 603 (closer to the +X axial direction) or may be provided on the middle of the wall section 604 and the wall section 603.

The terminal platform 70 is provided in a position more to the wall section 603 side (the +X axial direction side) than the ink supply pipe 640 in the wall section 601 of the holder 60 to be adjacent to the wall section 601 and the wall section 603 as described above. As shown in FIG. 22, the terminal platform 70 has a device side inclined surface 708. The device side inclined surface 708 is inclined toward the +Z axial direction and the +X axial direction to the wall section 601 when the cartridge 20 is attached to the holder 60. The device side terminals 730 are provided on the device side inclined surface 708 and the device side terminals 730 on the terminal platform 70 of the holder 60 come into contact with the cartridge side terminals 430 on the circuit board 40 in the cartridge 20 when the cartridge 20 is mounted on the holder 60.

It is preferable for an angle $\phi$ where the device side inclined surface 708 of the terminal platform 70 is inclined to a flat surface which is parallel to the X axis and the Y axis (for example, the wall section 601) to be 25° to 40° as shown in FIG. 22 which is the same as the cartridge side inclined surface 408 of the cartridge 20. The device side inclined surface 708 of the terminal platform 70 is parallel to the cartridge side inclined surface 408 of the circuit board 40 in a mounting state where the cartridge 20 is mounted on the holder 60.

In the embodiment, nine device side terminals 731 to 739 are provided on the device side inclined surface 708 on the terminal platform 70 as the device side terminals 730 to correspond to the nine cartridge side terminals 431 to 439 on the circuit board 40 in the cartridge 20. The number of the device side terminals 730 is not limited to nine, a change to an arbitrary number is possible, and there may be nine or less or may be nine or more. In the explanation of the embodiment, a reference numeral "730" is used in cases when all of device side terminals 731 to 739 are being referred to.

Figure 23:
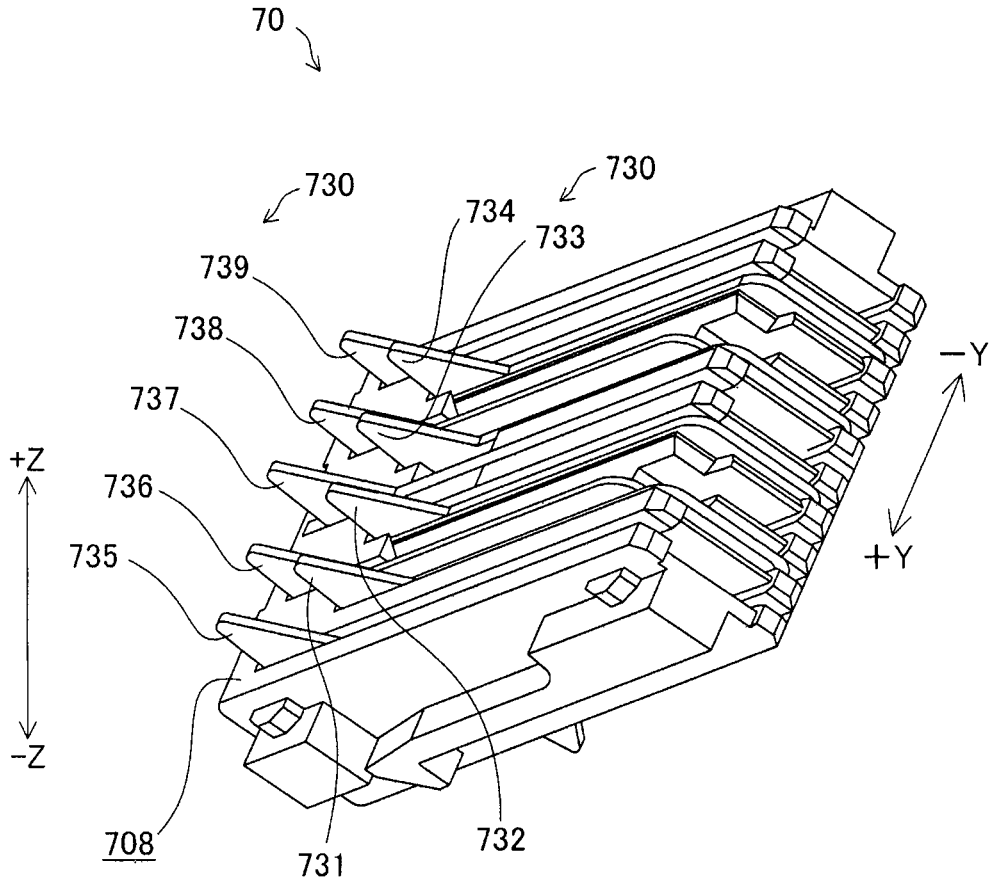
FIG. 23 is a perspective diagram illustrating a detailed configuration of a terminal platform.

FIG. 23 is a perspective diagram illustrating a detailed configuration of the terminal platform 70. FIG. 23 illustrates the terminal platform 70 removed from the holder 60. The nine device side terminals 731 to 739 on the terminal platform 70 are provided in positions which respectively correspond to the nine cartridge side terminals 431 to 439 on the circuit board 40 of the cartridge 20. Five device side terminals 735 to 739 are provided to line up along the Y axis on the −Z axial direction side of the device side inclined surface 708 of the terminal platform 70 and four device side terminals 731 to 734 are provided to line up along the Y axis on the +Z axial direction side of the five device side terminals 735 to 739.

The device side terminals 731 to 739 are formed by elastic members which have electrical conductivity. Each of the device side terminals 731 to 739 protrudes from the device side inclined surface 708 and the pressing force Pt is generated in a direction of pushing back to the cartridge side inclined surface 408 of the cartridge 20 (a direction toward the +Z axial direction side) in a mounting state where the cartridge 20 is mounted on the holder 60.

In the embodiment, the device side terminal 737 which is positioned in the center out of the nine device side terminals 731 to 739 in the Y axial direction is a "grounding terminal" which is electrically connected to a grounding line (not shown). The device side terminal 737 which is the grounding terminal comes into contact with the cartridge side terminal 437 shown in FIG. 15 in a mounting state where the cartridge 20 is mounted on the holder 60.

In the embodiment, the height with which the device side terminal 737 protrudes from the device side inclined surface 708 is larger than that of the other device side terminals 731 to 736, 738, and 739. Accordingly, the device side terminal 737 comes into contact with the cartridge side terminals 430 (the cartridge side terminal 437) prior to the other device side terminals 731 to 736, 738, and 739.

Returning to the explanation of FIG. 19 to FIG. 22, in the embodiment, the engaging section 665 is provided in a position on the −Z axial direction side and the −X axial direction side of the terminal platform 70 of the holder 60 as described above. The engaging section 665 is configured to engage with the board side engaging sections 252 and 254 so that the engaging section 665 is interposed between the board side engaging sections 252 and 254 of the cartridge 20. Accordingly, it is possible to prevent position deviation of the circuit board 40 to the terminal platform 70 and it is possible to prevent positional deviation of the device side terminals 731 to 739 and the cartridge side terminals 431 to 439.

In the embodiment, the engaging section 662 which has a flat surface which is parallel to the Z axis and the Y axis toward the −Y axial direction is provided adjacent to the +Y axial direction side of the terminal platform 70 of the holder 60 and the engaging section 664 which has a flat surface which is parallel to the Z axis and the Y axis toward the +Y axial direction is provided adjacent to the −Y axial direction side of the terminal platform 70 of the holder 60. The engaging sections 662 and 664 are configured so as to engage with the board side surface engaging sections 262 and 264 of the cartridge 20. Accordingly, it is possible to prevent position deviation of the circuit board 40 to the terminal platform 70 and it is possible to prevent positional deviation of the device side terminals 731 to 739 and the cartridge side terminals 431 to 439.

In the embodiment, the engaging section 666 which has a flat surface which is parallel to the Z axis and the Y axis toward the −Y axial direction is further provided on the +Y axial direction side of the engaging section 662 and the engaging section 668 which has a flat surface which is parallel to the Z axis and the Y axis toward the +Y axial direction is further provided on the −Y axial direction side of the engaging section 664. The engaging sections 666 and 668 are configured so as to engage with the board side surface engaging sections 266 and 268 of the cartridge 20. Accordingly, it is possible to prevent position deviation of the circuit board 40 to the terminal platform 70 and it is possible to prevent positional deviation of the device side terminals 731 to 739 and the cartridge side terminals 431 to 439.

The lever 80 is provided on the wall section 603 of the holder 60 so as to rotate. The lever 80 is configured with separate members to the five wall sections 601, 603, 604, 605, and 606 in the holder 60. The lever 80 is made of resin and is made of a material (for example, polyacetal (POM)) which is possible to obtain rigidity higher than polypropylene (PP) in the embodiment.

As shown in FIG. 22, the lever 80 has a rotation pivot 800*c* to the +Z axial direction side and the +X axial direction side of the device side terminals 731 to 739. The terminal platform side latching section 810 and the operation section 830 are provided on the lever 80. The terminal platform side latching section 810 is positioned to the −Z axial direction side of the rotation pivot 800*c* and the operation section 830 is positioned to the +Z axial direction side of the rotation pivot 800*c*.

The operation section 830 is configured to receive the operation force Pr toward the −X axial direction side from the user. In the embodiment, the operation section 630 is provided at an edge section on the +Z axial direction side of the lever 80. The lever 80 rotates in a counterclockwise direction when viewed from the +Y axial direction side with the rotation pivot 800*c* when the operation force Pr is applied to the operation section 830 by the user.

The terminal platform side latching section 810 is configured to latch together with the board side latching section 210 at the first latching position 810L which is positioned to the −Z axial direction side and the −X axial direction side of the rotation pivot 800*c*. In the embodiment, the terminal platform side latching section 810 is provided at an edge section on the −Z axial direction side of the lever 800. In the embodiment, the terminal platform side latching section 810 has a latching surface 811 and a latching surface 813. The latching surface 811 is a flat surface which faces the −Z axial direction in the first latching position 810L and is configured to latch together with the latching surface 211 of the board side latching section 210. The latching section 813 is a flat surface which faces the −X axial direction in the first latching position 810L and is configured to latch together with the latching surface 212 of the board side latching section 210.

In the embodiment, the lever 80 is configured so that the position of the terminal platform side latching section 810 is the first latching position 810L when the cartridge 20 is not mounted. In another embodiment, the waiting position of the lever 80 may be a position where the terminal platform side latching section 810 is on the −X axial direction side of the first latching position 810L or a position where the terminal platform side latching section 810 is on the −X axial direction side of the first latching position 810L.

In the embodiment, the elastic member 682 is provided to the −Z axial direction side and the +X axial direction side of the center pivot 800*c* of the lever 80. The elastic member 682 presses the lever 80 in a direction which pushes back the lever 80 due to elastic deforming by abutting against the lever 80 when the lever 80 is rotated in a rotation direction which moves the terminal platform side latching section 810 to the +X axial direction side of the first latching position 810L.

Figure 24:
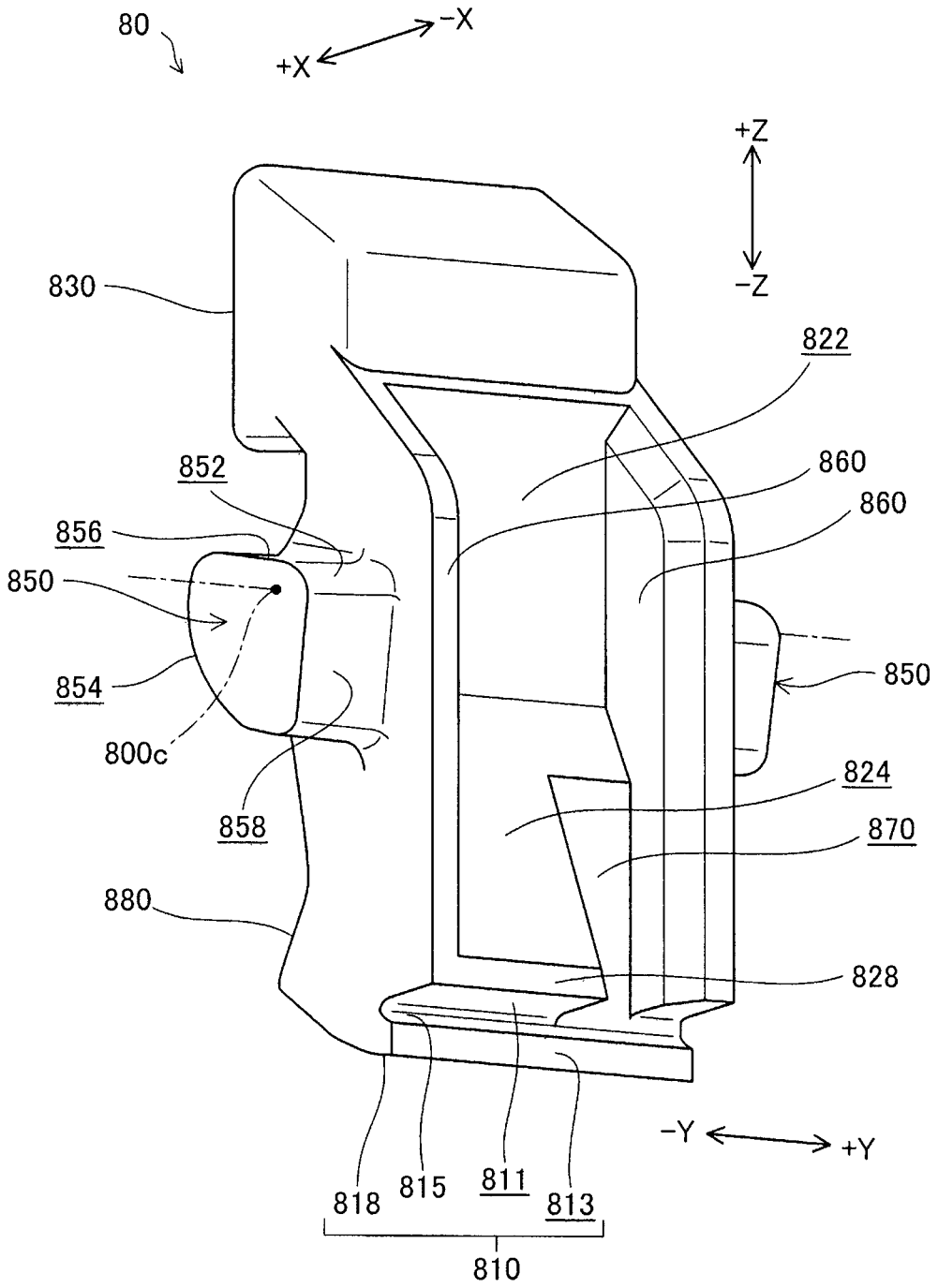
FIG. 24 is a perspective diagram illustrating a detailed configuration of a lever.

FIG. 24 is a perspective diagram illustrating a detailed configuration of the lever 80. As shown in FIG. 24, an operation section 830 is provided on an edge section on the +Z axial direction side of the lever 80 and the terminal platform side latching section 810 is provided on an edge section on the opposite side to the operation section 830 which interposes the rotation center 800*c*, that is, an edge section on the −Z axial direction side.

The latching surface 811 and the latching surface 813 which are two surfaces which intersect with each other are provided on the terminal platform side latching section 810. The latching surface 813 is at a position which is separated from the rotation center 800*c* by the latching surface 811 and is adjacent to an end section 818 on the −Z axial direction side of the lever 80.

In the embodiment, a groove section 815 is provided on a position where the latching surface 811 and the latching surface 813 intersect so that it is easy for the latching surface 811 and the latching surface 813 to engage with the board side latching section 210. In the embodiment, the groove section 815 is a shape which extends the latching surface 811 and where the latching surface 813 side is cut out.

The lever 80 has a pair of wall sections 860 which branch out in the Y axis direction. The pair of wall sections 860 rise up on a surface on the −X axial direction side of the lever 80. The pair of wall sections 860 is provided from the operation section 830 to the terminal platform side latching sections 810 from an edge section in the +Z axial direction across to an edge section in the −Z axial direction. The distance between the pair of wall sections 680 in the Y axial direction is larger than the length of the board side latching section 210 in the cartridge 20 in the Y axial direction. In the embodiment, outer surfaces of the pair of wall sections 860, that is, a surface on the −Y axial direction side on the wall section on the −Y axial direction side and a surface on the +Y axial direction side on the wall section on the +Y axial direction side, configure a portion of both side surfaces of the lever 80.

A flat surface 822 and an inclined surface 824 are formed between the pair of wall sections in order from the operation section 830 to the terminal platform side latching section 810. In the embodiment, the flat surface 822 is a flat surface which is parallel to the latching surface 813 and the inclined surface 824 is a flat surface which is linked to the flat surface 822 and is inclined so as to rise up gradually in the −X axial direction from the flat surface 822 to the terminal platform side latching section 810. In another embodiment, a surface edge section 828 may be formed between the inclined surface 824 and the latching surface 811 to be less inclined than the inclined surface 824. The pair of wall sections 860, the flat surface 822, the inclined surface 824, and the surface edge section 828 have a function as a guiding section when the cartridge 20 is mounted on the holder 60 and when the cartridge 20 is removed from the holder 60. The movement of the board side latching section 210 in the Y axial direction is limited by the pair of wall sections 860 during the attaching and detaching of the cartridge 20, therefore, it is possible to smoothly lead the cartridge 20 to the correct position in the holder 60 by the movement of the board side latching section 210 in the X axial direction being limited by the flat surface 822, the inclined surface 824, and the surface edge section 828, and it is possible to smoothly remove the cartridge 20 from the holder 60. In another embodiment, instead of the flat surface 822, the inclined surface 824, and the surface edge section 828, a smooth curved surface may be formed between the pair of wall sections 860 from the operation section 830 across to the terminal platform side latching section 810.

In the embodiment, a cut out surface 870 is provided to make the part 219 of the cartridge 20 escape. The cut out surface 870 is a portion of the inclined surface 824 which corresponds to the position of the part 219 provided to prevent the lever 80 riding up. In the embodiment, the cut out surface 870 is a flat surface which is parallel with the latching section 813 and is provided from the groove section 815 toward the rotation center 800*c*.

In the embodiment, an abutting section 880 is formed on a rear surface side of the terminal platform side latching section 810. The abutting section 880 is formed so that abutting is temporarily possible to the elastic section 682 of the holder 60 when the cartridge 20 is mounted on the holder 60 and when the cartridge 20 is removed from the holder 60.

A pair of rotation shaft sections 850 which establish the position of the rotation center 800*c* is provided on the outer side surface of the pair of wall sections 860. The pair of rotation shaft sections 850 is provided in a position substantially in the middle of the length of the lever 80 in the Z axial direction. One of the pair of rotation shaft sections 850 protrudes from the surface on the −Y axial direction side of the wall section on the −Y axial direction side in the −Y axial direction and the other of the pair of rotation shaft sections 850 protrudes from the surface on the +Y axial direction side of the wall section on the +Y axial direction side in the +Y axial direction. In the embodiment, the pair of rotation shaft sections 850 has shafts which have a fan shape cross section and has an inner side arc surface 852, an outer side arc surface 854, and radial side surfaces 856 and 858. The inner side arc surface 852 is a side surface of a part which corresponds to the center angle of the fan shape and the outer side arc surface 854 is a side surface of a part which corresponds to the arc of the fan shape. The arc which configures each of the inner side arc surface 852 and the outer side arc surface 854 has the rotation pivot 800*c* as a center. The radial side surfaces 856 and 858 are side surfaces of a part which corresponds to the radius of the fan shape. The radial side surface 856 is a flat surface substantially along the latching surface 811 and the radial side surface 858 is a flat surface substantially along the latching surface 813.

Figure 25:
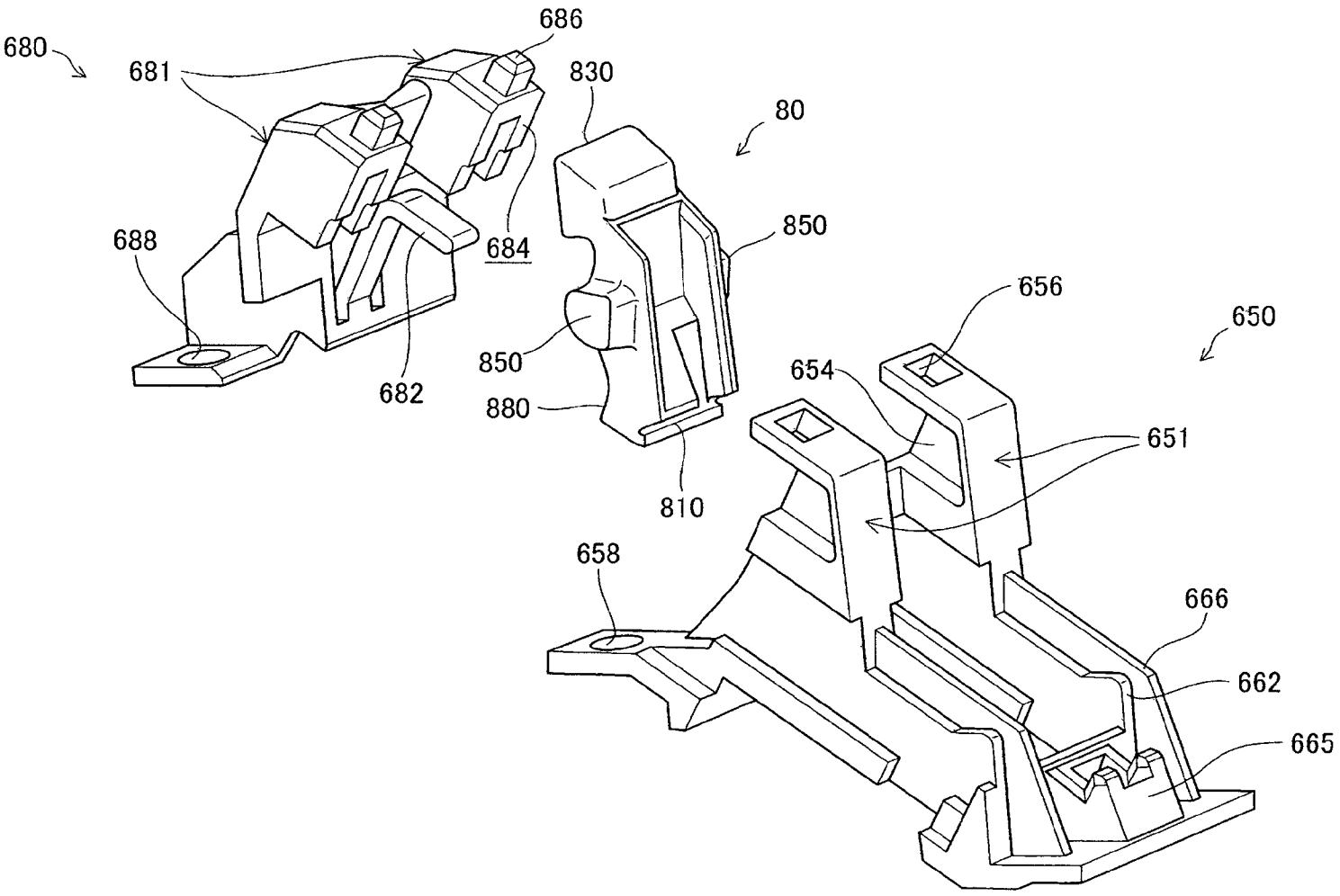
FIG. 25 is an exploded perspective diagram illustrating an assembly configuration of a lever to the holder.

FIG. 25 is an exploded perspective diagram illustrating an assembly configuration of the lever 80 to the holder 60. The lever 80 is assembled to the holder 60 so as to rotate by being held by a first holding member 650 and a second holding member 680. FIG. 25 illustrates a configuration of a portion for holding one lever 80 and not the entirety of the first holding member 650 and the second holding member 680. The first holding member 650 and the second holding member 680 are made of resin and are made of a material (for example, ABS resin) which is possible to obtain rigidity higher than polypropylene (PP) in the embodiment.

The first holding member 650 includes a pair of rising sections 651 and a through hole 658. In the embodiment, the engaging sections 662, 664, 665, 666, and 668 are provided on the first holding member 650. The pair of rising sections 651 in the first holding member 650 rise up with a gap between each other so that receiving of the lever 80 is possible. Shaft receiving sections 654 are provided on the pair of rising sections 651 respectively to receive the rotation shaft section 850 of the lever 80. In the embodiment, engaging holes 656 are provided on the pair of rising sections 651 respectively to engage with the second holding member 680.

The second holding member 680 includes a pair of rising sections 681 and a through hole 688. In the embodiment, the elastic member 682 is provided on the second holding member 680. The pair of rising sections 681 in the second holding member 680 rise up with a gap between each other which is the same as the pair of rising sections 651 in the first holding member 650. Blocking off surfaces 684, which block off the shaft receiving section 654 so that the rotation shaft section 850 of the lever 80 does not separate from the shaft receiving section 654, are provided on the pair of rising sections 681 respectively. In the embodiment, engaging convex sections 686 which engage with the engaging hole 656 of the first holding member 650 are provided on the pair of rising sections 681 respectively.

The lever 80 is placed between the pair of rising sections 651 due to each of the rotation shaft sections 850 of the lever 80 being inserted into the respective shaft receiving sections 654 of the pair of rising sections 651 in the first holding member 650 when the lever 80 is assembled in the holder 60. After this, each of the shaft receiving sections 654 where the rotation shaft section 850 of the lever 80 have been inserted are blocked off by the blocking off surfaces 684 of the second holding member 680 due to the first holding member 650 and the second holding member 680 being engaged. After this, it is possible to assemble the lever 80 to the holder 60 to rotate by the first holding member 650 and the second holding member 680 being latched together to the holder 60 using a screw using the through holes 658 and 688.

Returning to the explanation of FIG. 19 to FIG. 22, the supply pipe side latching section 620 is provided on the wall section 604 of the holder 60. The supply pipe side latching section 620 is configured so as to be latched to the supply port side latching section 220 at the second latching position 620L which is positioned to the +Z axial direction side and the −X axial direction of the ink supply pipe 640.

In the embodiment, the supply pipe side latching section 620 is a through hole with a size which can receive the supply port side latching section 220 and has the latching surface 622. The latching surface 622 is a flat surface which faces the −Z axial direction and is configured to be latched together with the latching surface 222 of the supply port side latching section 220. An edge section 624 on the +X axial direction side of the latching section 622 is a rotation pivot of the cartridge 20 to the holder 60 by engaging with the supply port side latching section 220 when attaching and detaching the cartridge 20.

As shown in FIG. 22, a space section 670 is provided on the wall section 604 of the holder 60 to the +Z axial direction of the supply pipe side latching section 620. The space section 670 forms a space on the wall section 604 in order to rotate the cartridge 20 with the supply pipe side latching section 620 as the rotation pivot when attaching and detaching the cartridge 20. In the embodiment, the space section 670 is a staggered section where the wall section 604 becomes lower in steps in the −X axial direction toward the +Z axial direction. In another embodiment, the space section 670 may be an inclined surface where the wall section 604 is continuously lower in the −X axial direction toward the +Z axial direction.

As shown in FIG. 22, the latching surface 811 of the terminal platform side latching section 810 which is positioned at the first latching position 810L is provided on the −Z axial direction side, that is, the wall section 601 side with the distance Dz from the latching surface 622 of the supply pipe side latching section 620. In other words, the latching section 622 is provided on the +Z axial direction side, that is, on the upper side of the holder 60 when the printer 50 is being used with the distance Dz from the latching surface 811 which is positioned at the first latching position 810L. Accordingly, it is possible to strengthen the latching of the board side latching section 210 and the terminal platform side latching section 810 in the mounting state where the cartridge 2Q is mounted on the holder 60.

A-5. Cartridge Attaching and Detaching Operation Regarding Holder

Figure 26:
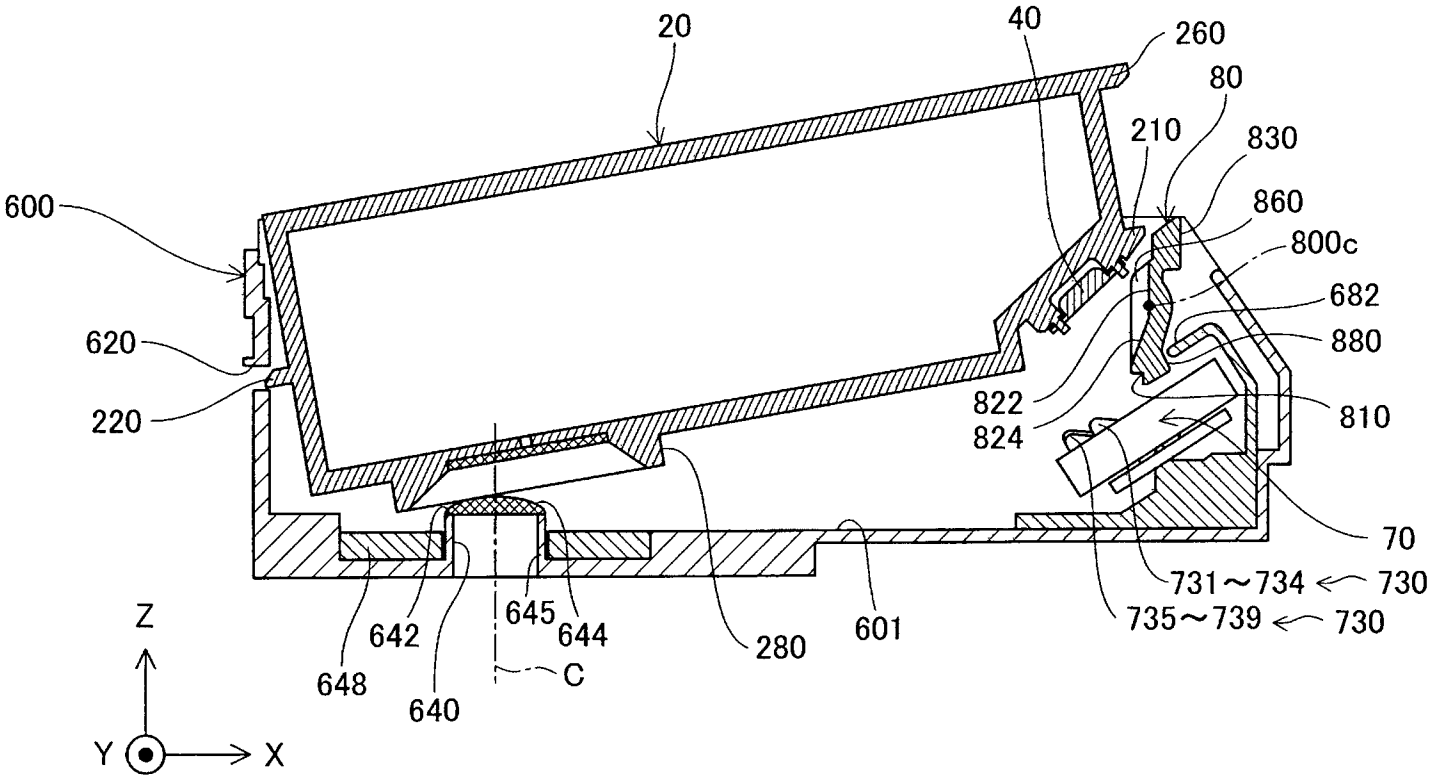
FIG. 26 is an explanatory diagram illustrating an attaching and detaching operation of a cartridge to a holder.
Figure 27:
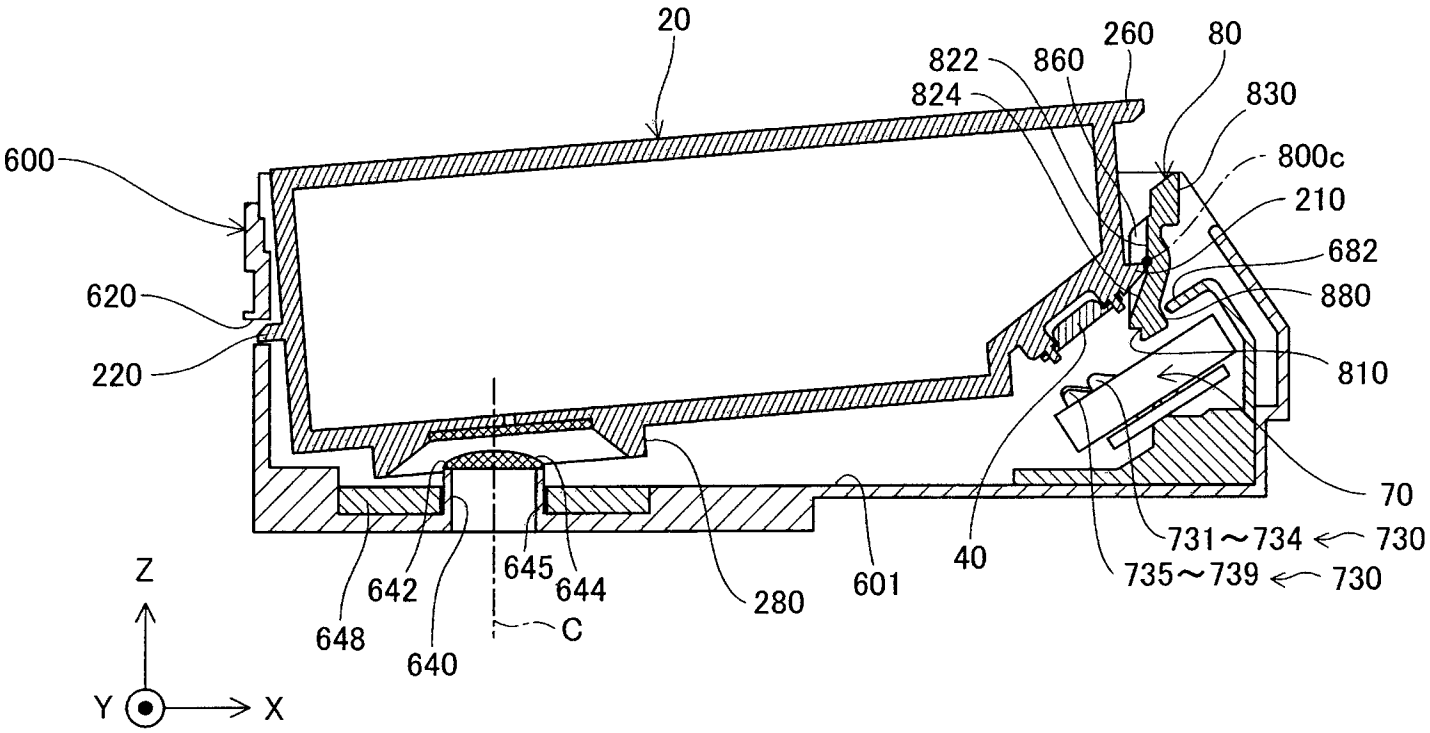
FIG. 27 is an explanatory diagram illustrating an attaching and detaching operation of a cartridge to a holder.
Figure 28:
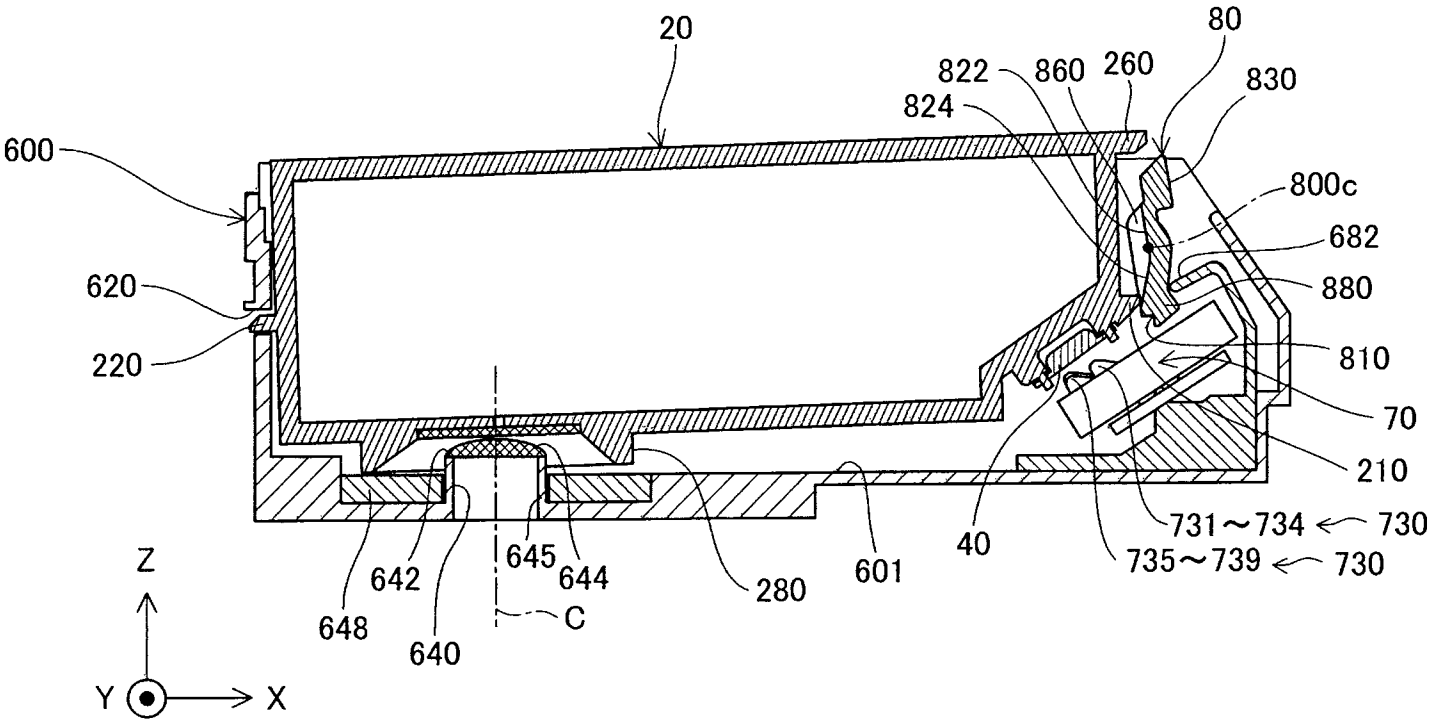
FIG. 28 is an explanatory diagram illustrating an attaching and detaching operation of a cartridge to a holder.

FIG. 26, FIG. 27, and FIG. 28 are explanatory diagrams illustrating an attaching and detaching operation of the cartridge 20 to the holder 60. The cartridge 20 and the holder 60 with a cross section in a position which corresponds to FIG. 5 are illustrated in FIG. 26 to FIG. 28.

As shown in FIG. 26, when the cartridge 20 is mounted on the holder 60, the cartridge 20 is moved into an inner portion of the holder 60 in the −Z axial direction from the supply port side latching section 220 side and the supply port side latching section 220 is inserted into the supply pipe side latching section 620. In the state shown in FIG. 26, the board side latching section 210 in the cartridge 20 is positioned in the +Z axial direction side of the terminal platform side latching section 810 which is in the lever 80 on the holder 60 side.

Next, from the state shown in FIG. 26, the cartridge 20 is rotated with the supply port side latching section 220 which is inserted in the supply pipe side latching section 620 as the rotation pivot in a clockwise direction viewed from the +Y axial direction side, that is, by the third surface 203 side being pushed toward the wall section 601 side in the holder 60. By doing this, as shown in FIG. 27, the board side latching section 210 progresses in the −Z axial direction with movement in the Y axial direction being limited by the board side latching section 210 being guided between the pair of wall sections 860 in the lever 80 and with movement in the X axial direction being limited by the board side latching section 210 coming in contact with the flat surface 822 between the pair of wall sections 860.

From the state shown in FIG. 27, the third surface 203 side of the cartridge 20 is further rotated by being pushed. By doing this, the board side latching section 210 is further pressed in the −Z axial direction and progresses from on the flat surface 822 of the lever 80 onto the inclined surface 824. Then, as shown in FIG. 28, the inclined surface 824 of the lever 80 comes closer to be parallel to the Z axis due to the lever 80 being rotated in a counterclockwise direction viewed from the +Y axial direction side. In the state shown in FIG. 28, the board side latching section 210 progresses in the −Z axial direction onto the inclined surface 824 which is closer to be parallel to the Z axis. At this time, in the embodiment, the abutting section 880 on a rear surface of the lever 80 abuts against the elastic member 682 and receives a pressing force, which presses to return the lever 80 in a clockwise direction viewed from the +Y axial direction, from the elastic member 682. The pressing force is an external force which includes components in the −Z axial direction. That is, the rotation area of the lever 80 is limited by the elastic member 682. A state, where the lever 80 is abutting against and is pressing the elastic member 682, is maintained from the state shown in FIG. 28 until the cartridge 20 is further pressed and the board side latching section 210 gets past the inclined surface 824 of the lever 80.

When the cartridge 20 is further rotated from the state shown in FIG. 28 and the board side latching section 210 has passed by the inclined surface 824 of the lever 80 and gets past the surface edge section 828, the lever 80 is returned to its original position and the terminal platform side latching section 810 moves to the first latching position 810L and is latched to the board side latching section 210 as shown in FIG. 5. In addition, the ink supply port 280 of the cartridge 20 is connected to the ink supply pipe 640, and the supply port side latching section 220 and the supply pipe side latching section 620 are engaged. Accordingly, the mounting of the cartridge 20 on the holder 60 is completed. In addition, by the cartridge 20 being correctly mounted in the designed mounting position, the cartridge side terminals 431 to 439 and the device side terminals 731 to 739 are electrically connected and transferring of signals between the cartridge 20 and the printer 50 is performed.

In addition, in the embodiment, at the same time as the board side latching section 210 passing by the inclined surface 824 of the lever 80 and getting past the surface edge section 828, the elastic member 682 is separated from the abutting section 880 on the rear surface of the lever 80. Accordingly, it is possible to impart a clicking sensation to the user when the cartridge 20 is mounted onto the holder 60.

In addition, in the embodiment, the elastic member 682 does not abut against the lever 80 and an external force can not be added when the cartridge 20 is mounted on the holder 60. Accordingly, it is possible to prevent a change in shape of the lever 80 due to consistent pressing by the elastic member 682.

In another embodiment, the elastic member 682 may abut against the lever 80 and press the lever 80 in a direction which includes components in the −X axial direction even when the cartridge 20 is mounted on the holder 60. Accordingly, it is possible to more strongly impart a clicking sensation to the user when the cartridge 20 is mounted on the holder 60. In another embodiment, the elastic member 682 may be omitted. Accordingly, it is possible to reduce the number of parts.

Next, an operation when the cartridge 20 is removed from the holder 60 will be described. When the cartridge 20 is removed from the holder 60, the user presses the operation section 830 of the lever 80 in the −X axial direction from the state shown in FIG. 5. That is, the operation force Pr toward the −X axial direction side is imparted onto the operation section 83 of the lever 80. By doing this, the terminal platform side latching section 810 moves in a direction which includes +X axial direction components with the rotation pivot 800*c* as a pivot. Accordingly, the engaging of the board side latching section 210 and the terminal platform side latching section 810 is released and there is the state shown in FIG. 28. After this, there is further a state in FIG. 26 from the state in FIG. 27 due to the third surface 203 side of the cartridge 20 being moved in the +Z axial direction while the cartridge 20 is rotated in the counterclockwise direction viewed from the +Y axial direction side with the supply port side latching section 220, which the user inserted into the supply pipe side latching section 620 by pinching the protruding section 260, as the rotation pivot. Finally, it is possible to remove the cartridge 20 from the holder 60 by pulling out the supply port side latching section 220 from the supply pipe side latching section 620 by the user pinching the cartridge 20.

A-6. Effects

According to the first embodiment as described above, it is not possible to mount the cartridge 20 on the holder 60 due to the cartridge 20 abutting against the partition plate 607 when the groove section 240 does not exist in the cartridge 20 in a position which corresponds to the partition plate 607 in the holder 60 due to the position of the two ink supply ports 280 in the cartridge 20 being deviated to the holder 60. As a result, it is possible to prevent position deviation of the two ink supply ports 280 to the holder 60 when the cartridge 20 is mounted pm the holder 60. In addition according to the first embodiment, the two ink supply ports 280 are positioned to the holder 60 when the partition plate 607 in the holder 60 is inserted in the groove section 240 of the cartridge 20. As a result, it is possible to prevent positional deviation of the two ink supply ports 280 after the cartridge 20 has been mounted on the holder 60.

In addition, according to the first embodiment, it is possible to suppress the action, where the pressing forces Ps and Pt from the holder 60 side to the ink supply port 280*a* and the cartridge side terminals 430 which intersects with the plane CXa work as forces where the cartridge 20 is inclined in the Y axial direction, due to the board side latching section 210 and the support port side latching section 220 which are latching sections which intersect with the plane CXa. As a result, it is possible to prevent positional deviation of the cartridge side terminals 430 to the holder 60 in addition to positional deviation of the two ink support ports 280 to the holder 60.

In addition, according to the first embodiment, it is possible to effectively prevent positional deviation of the cartridge side terminals 430 to the holder 60 using the board side latching section 210 which is positioned closer to the cartridge side terminals 430 than the ink supply ports 280. Furthermore, it is possible to further prevent position deviation of the cartridge side terminals 430 to the holder 60 since the board side latching section 210 is provided at a position which is adjacent to the circuit board 40.

In addition, according to the first embodiment, it is possible to effectively prevent positional deviation of the ink supply ports 280 to the holder 60 using the supply port side latching section 220 which is positioned closer to the ink supply ports 280 than the cartridge side terminals 430.

In addition, according to the first embodiment, it is possible to even further suppress the action, where the pressing forces Ps and Pt from the holder 60 side to the ink supply port 280*a* and the cartridge side terminals 430 which intersects with the plane CXa work as forces where the cartridge 20 is inclined in the Y axial direction, due to the other supply port side latching section 230 which intersects with the other plane CXb which is deviated in the Y axial direction to the plane CXa.

In addition, according to the first embodiment, since the length Wa of the supply port side latching section 220 along the Y axis is larger than the length Wb of the supply port side latching section 230 along the Y axis, it is possible to prevent inclination of the cartridge in the Y axial direction due to the supply port side latching section 230 without lowering operability when mounting the cartridge 20 on the holder 60 while preventing positional deviation of the cartridge along the Y axis due to the supply port side latching section 220.

In addition, according to the first embodiment, since the optical element 270 is provided on the first surface 201 in a position which cuts across the plane CXa, it is possible to prevent positional deviation of the optical element 280 to the holder 60 in addition to positional deviation of the two ink support ports 280 and the cartridge side terminals 430 to the holder 60.

A-7. Modified Example of First Embodiment

In the cartridge 20 of the embodiment described above, the optical element 270 is provided on the first surface 201 in a position which cuts across the plane CXa but the optical element 270 may be provided on the first surface 201 in a position which cuts across the plane CXb or respective optical elements 270 may be provided in respective positions in the first surface 201 which cut across the plane CXa and the plane CXb.

In the cartridge 20 of the embodiment described above, the board side latching section 210 is provided on the third surface 203 in a position which cuts across the plane CXa but the board side latching section 210 may be provided on the third surface 203 in a position which cuts across the plane CXb or respective board side latching sections 210 may be provided on the third surface 203 in respective positions which cut across the plane CXa and the plane CXb.

In the cartridge 20 of the embodiment described above, the circuit board 40 is provided on the eighth surface 208 in a position which cuts across the plane CXa but the circuit board 40 may be provided on the eighth surface 208 in a position which cuts across the plane CXb or respective circuit boards 40 may be provided on the eighth surface 208 in respective positions which cut across the plane CXa and the plane CXb.

In the cartridge 20 of the embodiment described above, the length Wa of the supply port side latching section 220 along the Y axis is larger than the length Wb of the supply port side latching section 230 along the Y axis but may be the same as the length Wb of the supply port side latching section 230 or may be smaller than the length Wb of the supply port side latching section 230.

B. Second Modified Example

Figure 29:
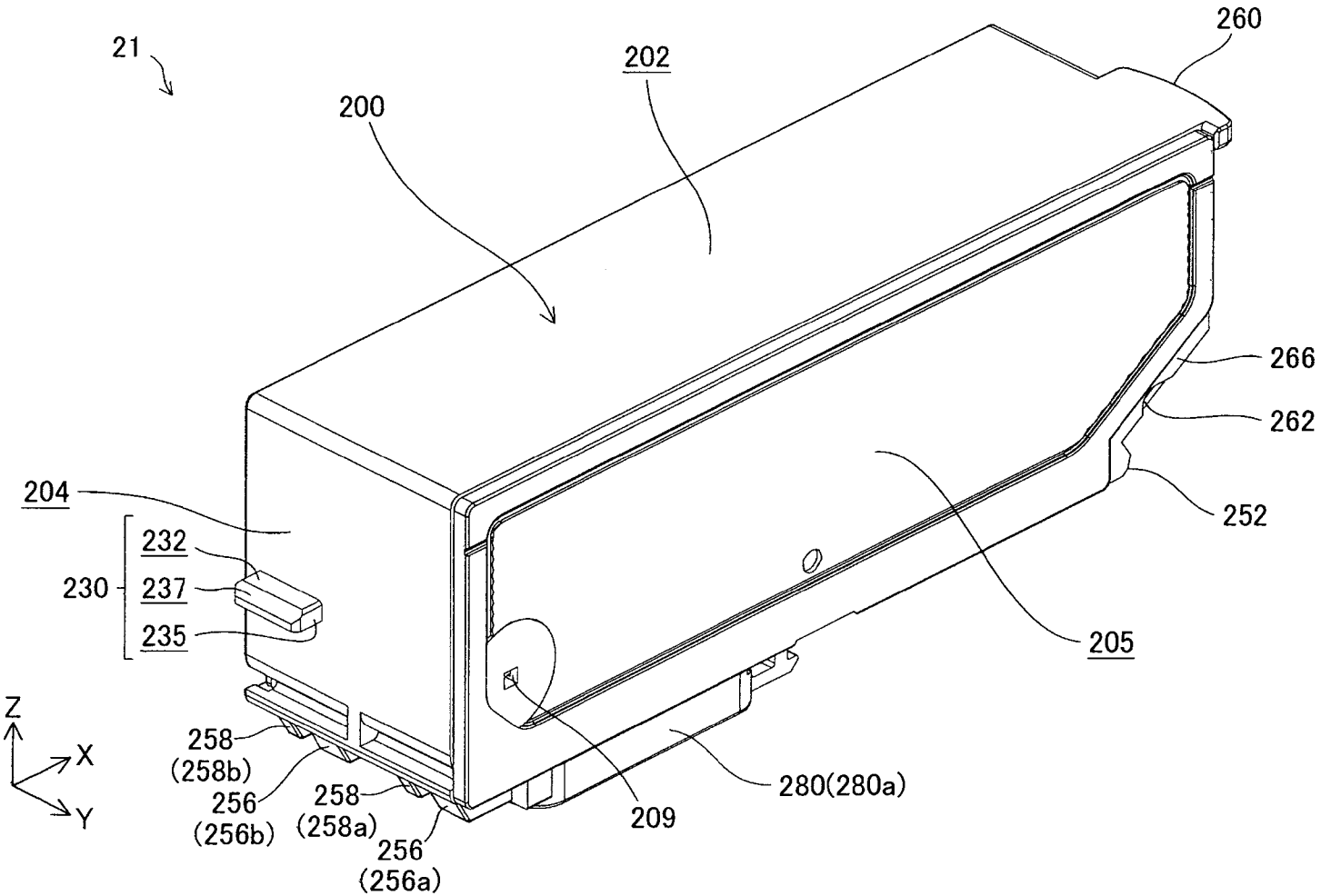
FIG. 29 is a perspective diagram illustrating a configuration of a cartridge according to a second embodiment.

FIG. 29 is a perspective diagram illustrating a configuration of a cartridge 21 according to a second embodiment. The second embodiment is the same as the first embodiment excluding the point where a cartridge 21 which is not provided with the supply port side latching section 220 is used. In the explanation of the second embodiment, the same reference numerals will be given to the configurations which are the same as the first embodiment and the description thereof will be omitted. The cartridge 21 of the second embodiment is the same as the cartridge 20 of the first embodiment excluding the point that the supply port side latching section 220 is not provided. The cartridge 21 is latched to the holder 60 by the board side latching section 210 and the supply port side latching section 230.

According to the second embodiment, it is possible to prevent positional deviation of the two ink supply ports 280 to the holder 60 when the cartridge 21 is mounted on the holder 60 since the groove section 240 is provided between the two ink supply sections 280 in the same manner as the first embodiment. In addition, it is possible to prevent positional deviation of the two ink supply ports 280 after the cartridge 21 is mounted on the holder 60.

In addition, according to the second embodiment, it is possible to prevent positional deviation of each section of the cartridge 21 to the holder 60 in the same manner as the first embodiment since the board side latching section 210 and the supply port side latching section 230 are provided.

C. Third Modified Example

Figure 30:
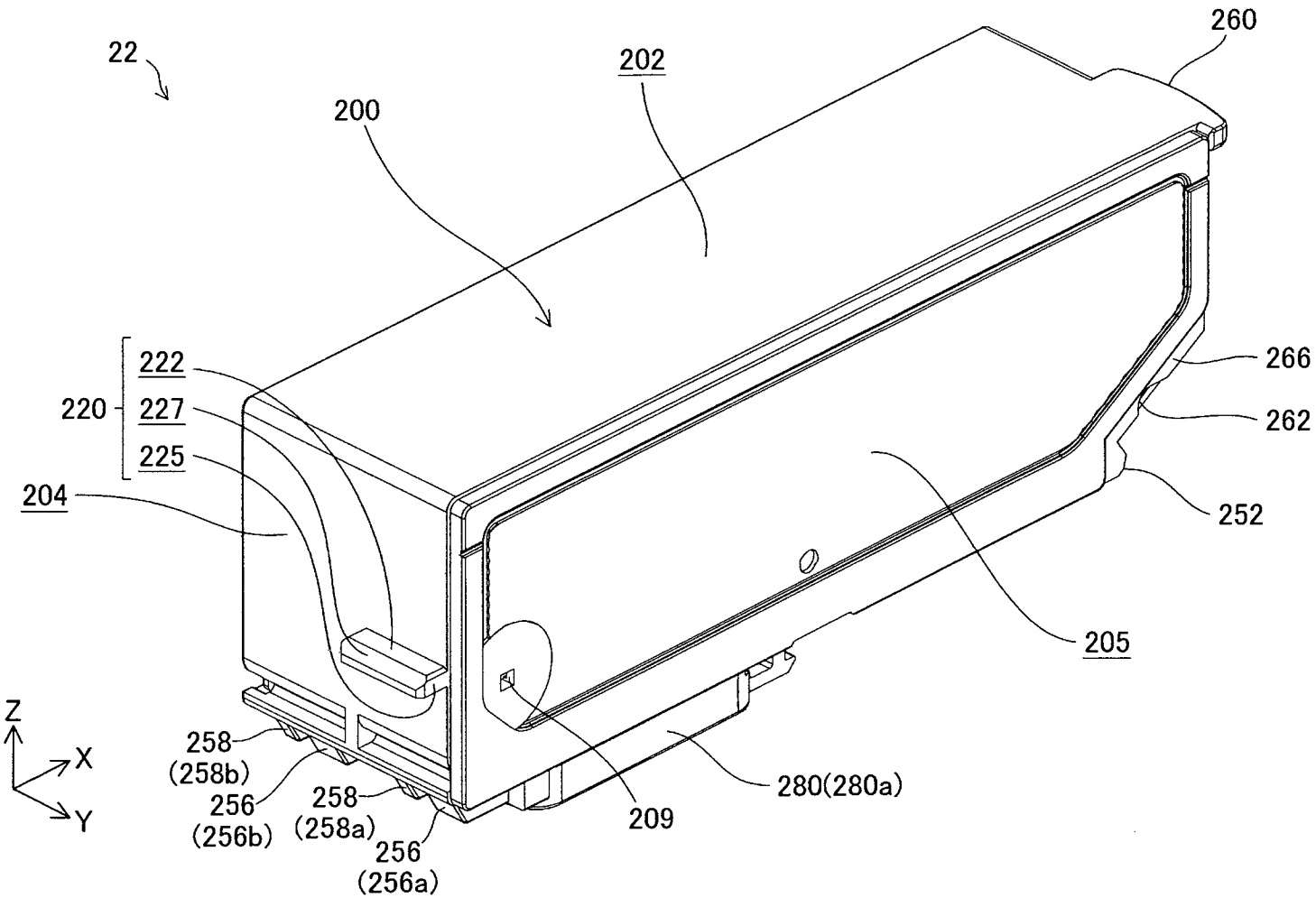
FIG. 30 is a perspective diagram illustrating a configuration of a cartridge according to a third embodiment.

FIG. 30 is a perspective diagram illustrating a configuration of a cartridge 22 according to a third embodiment. The third embodiment is the same as the first embodiment excluding the point where a cartridge 22 where the supply port side latching section 230 is not provided is used. In the explanation of the third embodiment, the same reference numerals will be given to the configurations which are the same as the first embodiment and the description thereof will be omitted. The cartridge 22 of the third embodiment is the same as the cartridge 20 of the first embodiment excluding the point that the supply port side latching section 230 is not provided. The cartridge 22 is latched to the holder 60 by the board side latching section 210 and the supply port side latching section 220.

According to the third embodiment, it is possible to prevent positional deviation of the two ink supply ports 280 to the holder 60 when the cartridge 22 is mounted on the holder 60 since the groove section 240 is provided between the two ink supply sections 280 in the same manner as the first embodiment. In addition, it is possible to prevent positional deviation of the two ink supply ports 280 after the cartridge 22 is mounted on the holder 60.

In addition, according to the third embodiment, it is possible to prevent positional deviation of each section of the cartridge 22 to the holder 60 in the same manner as the first embodiment since the board side latching section 210 and the supply port side latching sections 220 are provided.

D. Fourth Modified Example

Figure 31:
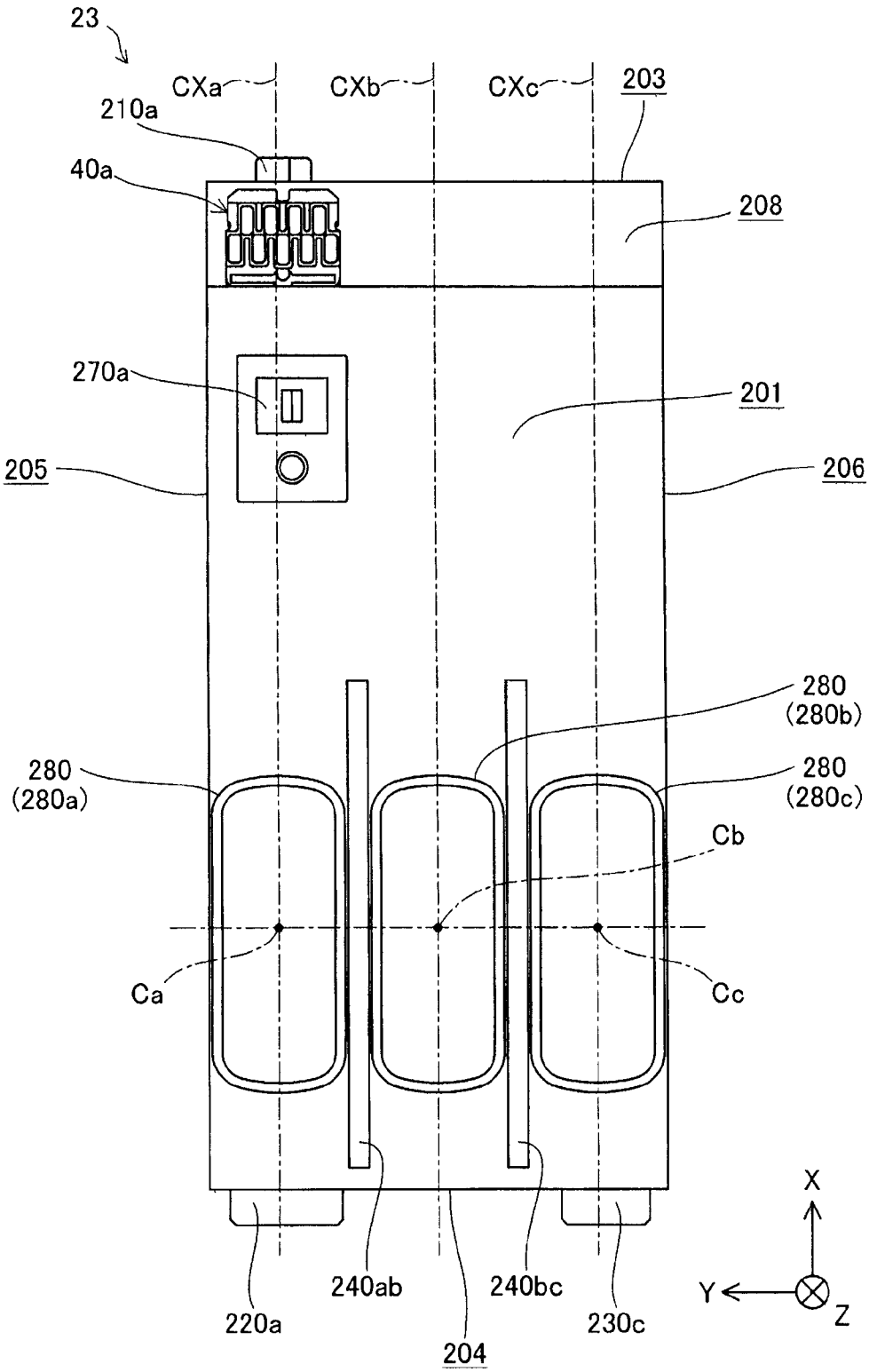
FIG. 31 is a bottom surface diagram illustrating a configuration of a cartridge according to a fourth embodiment.

FIG. 31 is a bottom surface diagram illustrating a configuration of a cartridge 23 according to a fourth embodiment. The fourth embodiment is the same as the first embodiment excluding the point where a cartridge 23 which has three ink supply ports 280 is used. In the explanation of the fourth embodiment, the same reference numerals will be given to the configurations which are the same as the first embodiment and the description thereof will be omitted.

The cartridge 23 of the fourth embodiment has three ink supply ports 280. In the fourth embodiment, it is possible to mount one of the cartridges 23 in three slots SL which are adjacent to each other in the holder 60. As shown in FIG. 31, three ink supply ports 280 are provided on the first surface 201 of the cartridge 23 in the fourth embodiment.

In the explanation of the embodiment, a reference numeral "280" is used in cases when all three three ink supply ports 280 in the cartridge 23 are being referred to. A reference numeral "280*a*" is used in cases indicating the ink supply port which is provided at the end on the +Y axial direction side of the arrangement of the three ink supply ports 280. A reference numeral "280*b*" is used in cases indicating the ink supply port which is provided at the center of the arrangement of the three ink supply ports 280. A reference numeral "280*c*" is used in cases indicating the ink supply port which is provided at the end on the −Y axial direction side of the arrangement of the three ink supply ports 280.

A central axis Ca shown in FIG. 31 corresponds to the central axis C of the ink supply pipe 640 which is connected to the ink supply port 280*a* in the mounting state where the cartridge 23 is mounted on the holder 60, and in the embodiment, is the central axis of the ink supply port 280*a*. A central plane CXa shown in FIG. 31 is a plane which passes through the central axis Ca and which is parallel to the Z axis and the X axis. That is, the central plane CXa is a plane which passes through the center of the length along the Y axis of the ink supply port 280*a* and is orthogonal to the Y axis.

A central axis Cb shown in FIG. 31 corresponds to the central axis C of the ink supply pipe 640 which is connected to the ink supply port 280*b* in the mounting state where the cartridge 23 is mounted on the holder 60, and in the embodiment, is the central axis of the ink supply port 280*b*. A central plane CXb shown in FIG. 31 is a plane which passes through the central axis Cb and which is parallel to the Z axis and the X axis. That is, the central plane CXb is a plane which passes through the center of the length along the Y axis of the ink supply port 280*b* and is orthogonal to the Y axis.

A central axis Cc shown in FIG. 31 corresponds to the central axis C of the ink supply pipe 640 which is connected to the ink supply port 280*c* in the mounting state where the cartridge 23 is mounted on the holder 60, and in the embodiment, is the central axis of the ink supply port 280*c*. A central plane CXc shown in FIG. 31 is a plane which passes through the central axis Cc and which is parallel to the Z axis and the X axis. That is, the central plane CXc is a plane which passes through the center of the length along the Y axis of the ink supply port 280*c* and is orthogonal to the Y axis.

In the fourth embodiment, a groove 240*ab* is provided between the ink supply port 280*a* and the ink supply port 280*b* and a groove 240*bc* is provided between the ink supply port 280*b* and the ink supply port 280*c* in the first surface 201 of the cartridge 23. The groove section 240*ab* and the groove section 240*bc* are provided in positions which correspond to the partition plate 607 in the holder 60, are provided to be concave more to the +Z axial direction than the first surface 201, and are configured to receive the partition plate 607 when the ink supply ports 280 are connected to the ink supply pipe 640 in the same manner as the groove section 240 of the first embodiment.

In the fourth embodiment, an optical element 270*a* is provided on the first surface 201 of the cartridge 23 in a position which cuts across the plane CXa. The configuration of the optical element 270*a* in the fourth embodiment is the same as the optical element 270 in the first embodiment except the position thereof.

In the fourth embodiment, a board side latching section 210*a* is provided on the third surface 203 of the cartridge 23 in a position which cuts across the plane CXa. The configuration of the board side latching section 210*a* in the fourth embodiment is the same as the board side latching section 210 in the first embodiment except the position thereof.

In the fourth embodiment, a supply port side latching section 220*a* is provided on the fourth surface 204 of the cartridge 23 in a position which cuts across the plane CXa and a supply port side latching section 230*c* is provided on the fourth surface 204 of the cartridge 23 in a position which cuts across the plane CXc. The configuration of the supply port side latching section 220*a* in the fourth embodiment is the same as the supply port side latching section 220 in the first embodiment except the position thereof. The configuration of the supply port side latching section 230*c* in the fourth embodiment is the same as the supply port side latching section 230 in the first embodiment except the position thereof.

In the fourth embodiment, a circuit board 40*a* is provided on the eighth surface 208 of the cartridge 23 in a position which cuts across the plane CXa. The configuration of the circuit board 40*a* in the fourth embodiment is the same as the circuit board 40 in the first embodiment except the position thereof.

According to the fourth embodiment described above, it is possible to prevent positional deviation of the three ink supply ports 280*a*, 280*b*, and 280*c* to the holder 60 when the cartridge 23 is mounted on the holder 60 since the groove sections 240*ab* and 240*bc* are provided respectively between the three ink supply ports 280*a*, 280*b*, and 280*c*. In addition, it is possible to prevent positional deviation of the three ink supply ports 280*a*, 280*b*, and 280*c* after the cartridge 23 is mounted on the holder 60.

In addition, according to the fourth embodiment, it is possible to prevent positional deviation of each section of the cartridge 23 to the holder 60 in the same manner as the first embodiment since the board side latching section 210*a*, the supply port side latching section 220*a*, and the supply port side latching sections 230*c* are provided on the cartridge 23.

As a modified example of the fourth embodiment, a cartridge may comprise four or more ink supply ports 280. Such cartridge may comprise two or more ink supply ports 280 and the groove sections 240 between the ink supply port 280*a* and the ink supply port 280*c* in the same manner as the ink supply port 280*b*. In another example, such cartridge may comprises one or more ink supply ports 280 and groove section 240 on at least one of the +Y axial direction side of the ink supply port 280*a* and the −Y axial direction side of the ink supply port 280*c*.

In the cartridge 23 of the embodiment described above, the optical element 270*a* is provided on the first surface 201 in a position which cuts across the plane CXa but the optical element 270 may be provided on the first surface 201 in a position which cuts across the plane CXb, the optical element 270 may be provided on the first surface 201 in a position which cuts across the plane CXc, or respective optical elements 270 may be provided on the first surface 201 in respective positions which cut across the plane CXa, the plane CXb, and the plane CXc.

In the cartridge 23 of the embodiment described above, the board side latching section 210*a* is provided on the third surface 203 in a position which cuts across the plane CXa but the board side latching section 210 may be provided on the third surface 203 in a position which cuts across the plane CXb, the board side latching section 210 may be provided on the third surface 203 in a position which cuts across the plane CXc, or respective board side latching sections 210 may be provided on the third surface 203 in respective positions which cut across the plane CXa, the plane CXb, and the plane CXc.

In the cartridge 23 of the embodiment described above, the supply port side latching section 230 is not provided on the fourth surface 204 in a position which cuts across the plane CXb but the supply port side latching section 230 may be provided on the fourth surface 204 in a position which cuts across the plane CXb.

In the cartridge 23 of the embodiment described above, the circuit board 40*a* is provided on the eighth surface 208 in a position which cuts across the plane CXa but the circuit board 40 may be provided on the eighth surface 208 in a position which cuts across the plane CXb, the circuit board 40 may be provided on the eighth surface 208 in a position which cuts across the plane CXc, or respective circuit boards 40 may be provided on the eighth surface 208 in respective positions which cut across the plane CXa, the plane CXb, and the plane CXc.

E. Fifth Modified Example

Figure 32:
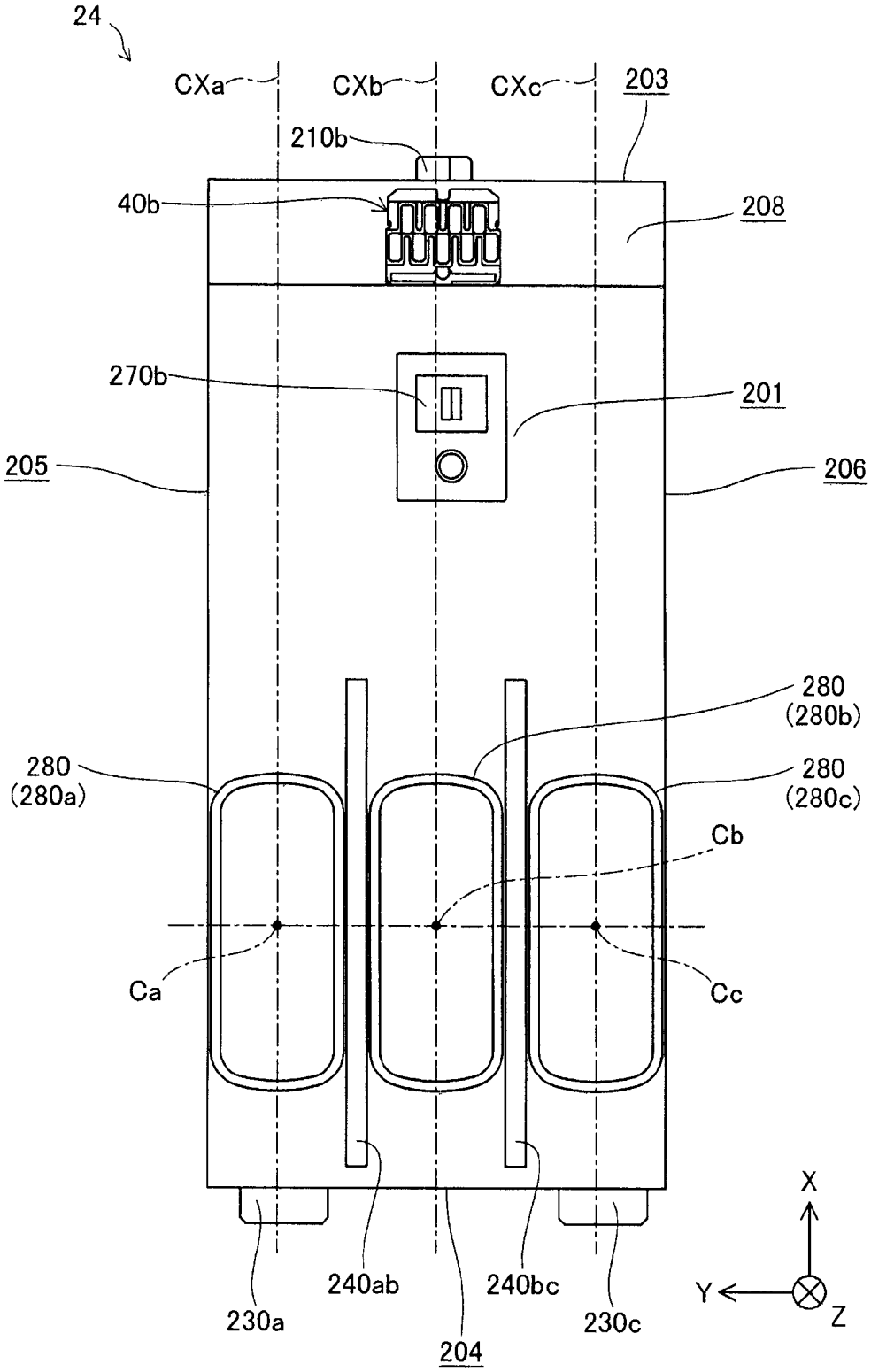
FIG. 32 is a bottom surface diagram illustrating a configuration of a cartridge according to a fifth embodiment.

FIG. 32 is a perspective diagram illustrating a configuration of a cartridge 24 according to a fifth embodiment. The fifth embodiment is the same as the first embodiment excluding the point where a cartridge 24 which has three ink supply ports 280 is used. In the explanation of the fifth embodiment, the same reference numerals will be given to the configurations which are the same as the first embodiment and the description thereof will be omitted.

The cartridge 24 of the fifth embodiment has three ink supply ports 280. In the fifth embodiment, it is possible to mount one of the cartridges 24 in three slots SL which are adjacent to each other on the holder 60. As shown in FIG. 32, three ink supply ports 280 are provided on the first surface 201 of the cartridge 24 in the fifth embodiment.

In the explanation of the embodiment, a reference numeral "280" is used in cases when all of the three ink supply ports 280 in the cartridge 24 are being referred to. A reference numeral "280*a*" is used in cases indicating the ink supply port which is provided at the end on the +Y axial direction side of the arrangement of the three ink supply ports 280. A reference numeral "280*b*" is used in cases indicating the ink supply port which is provided at the center of the arrangement of the three ink supply ports 280. A reference numeral "280*c*" is used in cases indicating the ink supply port which is provided at the end on the −Y axial direction side of the arrangement of the three ink supply ports 280. The central axes Ca, Cb, and Cc and the planes CXa, CXb, and CXc shown in FIG. 32 are the same as in the fourth embodiment.

In the fifth embodiment, a groove 240*ab* is provided between the ink supply port 280*a* and the ink supply port 280*b* and a groove 240*bc* is provided between the ink supply port 280*b* and the ink supply port 280*c* in the first surface 201 of the cartridge 24 in the same manner as the fourth embodiment. The groove section 240*ab* and the groove section 240*bc* are provided in positions which correspond to the partition plate 607 in the holder 60, are provided to be concave more to the +Z axial direction than the first surface 201, and are configured to receive the partition plate 607 when the ink supply ports 280 are connected to the ink supply pipe 640 in the same manner as the groove section 240 of the first embodiment.

In the fifth embodiment, an optical element 270*b* is provided on the first surface 201 of the cartridge 24 in a position which cuts across the plane CXb. The configuration of the optical element 270*b* in the fifth embodiment is the same as the optical element 270 in the first embodiment except the position thereof.

In the fifth embodiment, a board side latching section 210*b* is provided on the third surface 203 of the cartridge 24 in a position which cuts across the plane CXb. The configuration of the board side latching section 210*b* in the fifth embodiment is the same as the board side latching section 210 in the first embodiment except the position thereof.

In the fifth embodiment, a supply port side latching section 230*a* is provided on the fourth surface 204 of the cartridge 24 in a position which cuts across the plane CXa and a supply port side latching section 230*c* is provided on the fourth surface 204 of the cartridge 24 in a position which cuts across the plane CXc. The configurations of the supply port side latching section 230*a* and the supply port side latching section 230*c* in the fifth embodiment are the same as the supply port side latching section 230 in the first embodiment except the position thereof.

In the fifth embodiment, a circuit board 40*b* is provided on the eighth surface 208 of the cartridge 24 in a position which cuts across the plane CXb. The configuration of the circuit board 40*b* in the fifth embodiment is the same as the circuit board 40 in the first embodiment except the position thereof.

According to the fifth embodiment described above, it is possible to prevent positional deviation of the three ink supply ports 280*a*, 280*b*, and 280*c* to the holder 60 when the cartridge 24 is mounted on the holder 60 since the groove sections 240*ab* and 240*bc* are provided respectively between the three ink supply ports 280*a*, 280*b*, and 280*c*. In addition, it is possible to prevent positional deviation of the three ink supply ports 280*a*, 280*b*, and 280*c* after the cartridge 24 is mounted on the holder 60.

In addition, according to the fifth embodiment, it is possible to prevent positional deviation of each section of the cartridge 24 to the holder 60 in the same manner as the first embodiment since the board side latching section 210*b*, the supply port side latching section 230*a*, and the supply port side latching sections 230*c* are provided on the cartridge 24.

As a modified example of the fifth embodiment, a cartridge may comprise four or more ink supply ports 280 by providing one or more ink supply ports 280 and groove sections 240 at least between the ink supply port 280*a* and the ink supply port 280*b* or between the ink supply port 280*b* and the ink supply port 280*c*. In addition, a cartridge may comprises four or more ink supply ports 280 by providing one or more ink supply ports 280 and groove section 240 on at least one of the +Y axial direction side of the ink supply port 280*a* or the −Y axial direction side of the ink supply port 280*c*.

In the cartridge 24 of the embodiment described above, the optical element 270*b* is provided on the first surface 201 in a position which cuts across the plane CXb but the optical element 270 may be provided on the first surface 201 in a position which cuts across the plane CXa, the optical element 270 may be provided on the first surface 201 in a position which cuts across the plane CXc, or respective optical elements 270 may be provided on the first surface 201 in respective positions which cut across the plane CXa, the plane CXb, and the plane CXc.

In the cartridge 24 of the embodiment described above, the board side latching section 210*b* is provided on the third surface 203 in a position which cuts across the plane CXb but the board side latching section 210 may be provided on the third surface 203 in a position which cuts across the plane CXa, the board side latching section 210 may be provided on the third surface 203 in a position which cuts across the plane CXc, or respective board side latching sections 210 may be provided on the third surface 203 in respective positions which cut across the plane CXa, the plane CXb, and the plane CXc.

In the cartridge 24 of the embodiment described above, the supply port side latching section 220 is not provided on the fourth surface 204 in a position which cuts across the plane CXb but the supply port side latching section 220 may be provided on the fourth surface 204 in a position which cuts across the plane CXb.

In the cartridge 24 of the embodiment described above, the circuit board 40*b* is provided on the eighth surface 208 in a position which cuts across the plane CXb but the circuit board 40 may be provided on the eighth surface 208 in a position which cuts across the plane CXa, the circuit board 40 may be provided on the eighth surface 208 in a position which cuts across the plane CXc, or respective circuit boards 40 may be provided on the eighth surface 208 in respective positions which cut across the plane CXa, the plane CXb, and the plane CXc.

F. Sixth Modified Example

Figure 33:
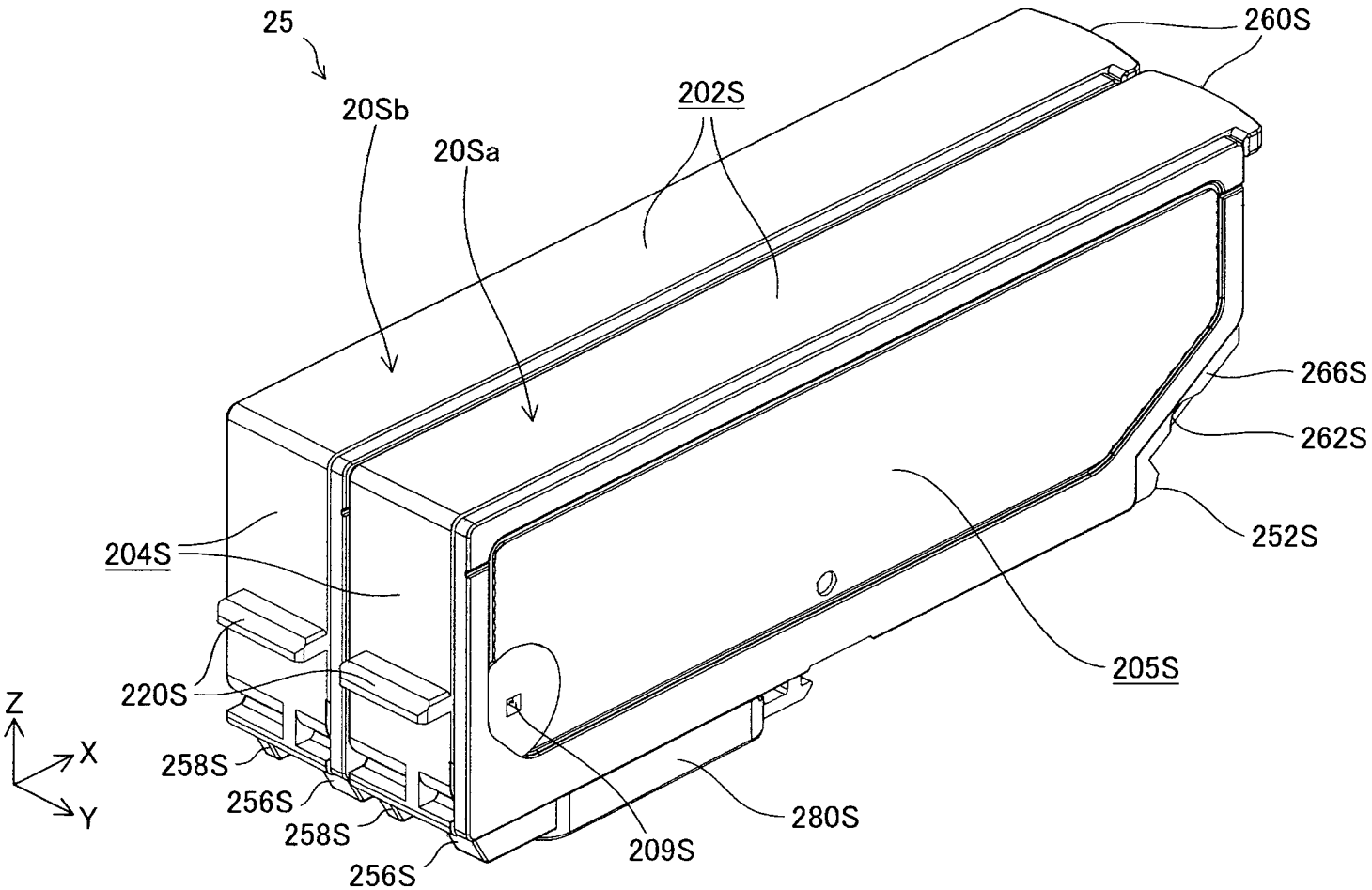
FIG. 33 is a perspective diagram illustrating a configuration of a cartridge according to a sixth embodiment.

FIG. 33 is a perspective diagram illustrating a configuration of a cartridge 25 according to a sixth embodiment. The sixth embodiment is the same as the first embodiment excluding the point where a cartridge 25 where two of the cartridges 20S are connected is used. In the explanation of the sixth embodiment, the same reference numerals will be given to the configurations which are the same as the first embodiment and the description thereof will be omitted.

The cartridge 25 of the sixth embodiment is prepared as two cartridges 20Sa and 20Sb which are equivalent to the cartridge 20S which is described in the first embodiment and a sixth surface 206S of the cartridge 20Sa and a fifth surface 205S of the cartridge 20Sb are connected using, for example, a claw, a screw, adhesive, doubled-sided tape, or the like. In the cartridge 25, a structure which is equivalent to the groove section 240 in the first embodiment is formed between an ink supply port 280S in the cartridge 20Sa and an ink supply port 280S in the cartridge 20Sb using a depression section 240S of the cartridge 20Sa and the fifth surface 205S of the cartridge 20Sb.

According to the sixth embodiment, it is possible to prevent positional deviation of the two ink supply ports 280S to the holder 60 when the cartridge 25 is mounted on the holder 60 in the same manner as the first embodiment since the structure which is equivalent to the groove section 240 is provided between the two ink supply ports 280S. In addition, it is possible to prevent positional deviation of the two ink supply ports 280S after the cartridge 25 is mounted on the holder 60.

In addition, according to the sixth embodiment, it is possible to prevent positional deviation of each section of the cartridge 25 to the holder 60 in the same manner as the first embodiment since the board side latching section 210S and the supply port side latching section 220S are provided.

As a modified example of the sixth embodiment, a cartridge may comprise three or more ink supply ports 280S by connecting three or more of the cartridges 20S in the same manner as the cartridge 25. In addition, the board side latching section 210S may be omitted from one of the two cartridges 20Sa and 20Sb which configure the cartridge 25. In addition, the supply port side latching section 220S may be omitted from one of the two cartridges 20Sa and 20Sb which configure the cartridge 25. In addition, the circuit board 40S may be omitted from one of the two cartridges 20Sa and 20Sb which configure the cartridge 25.

G. Modified Example

Embodiments of the invention have been described above but the invention is not limited to these embodiments and various aspects are naturally possible within a scope which does not depart from the gist of the invention.

G-1. Modified Example of Board Side Latching Section

Figure 34:
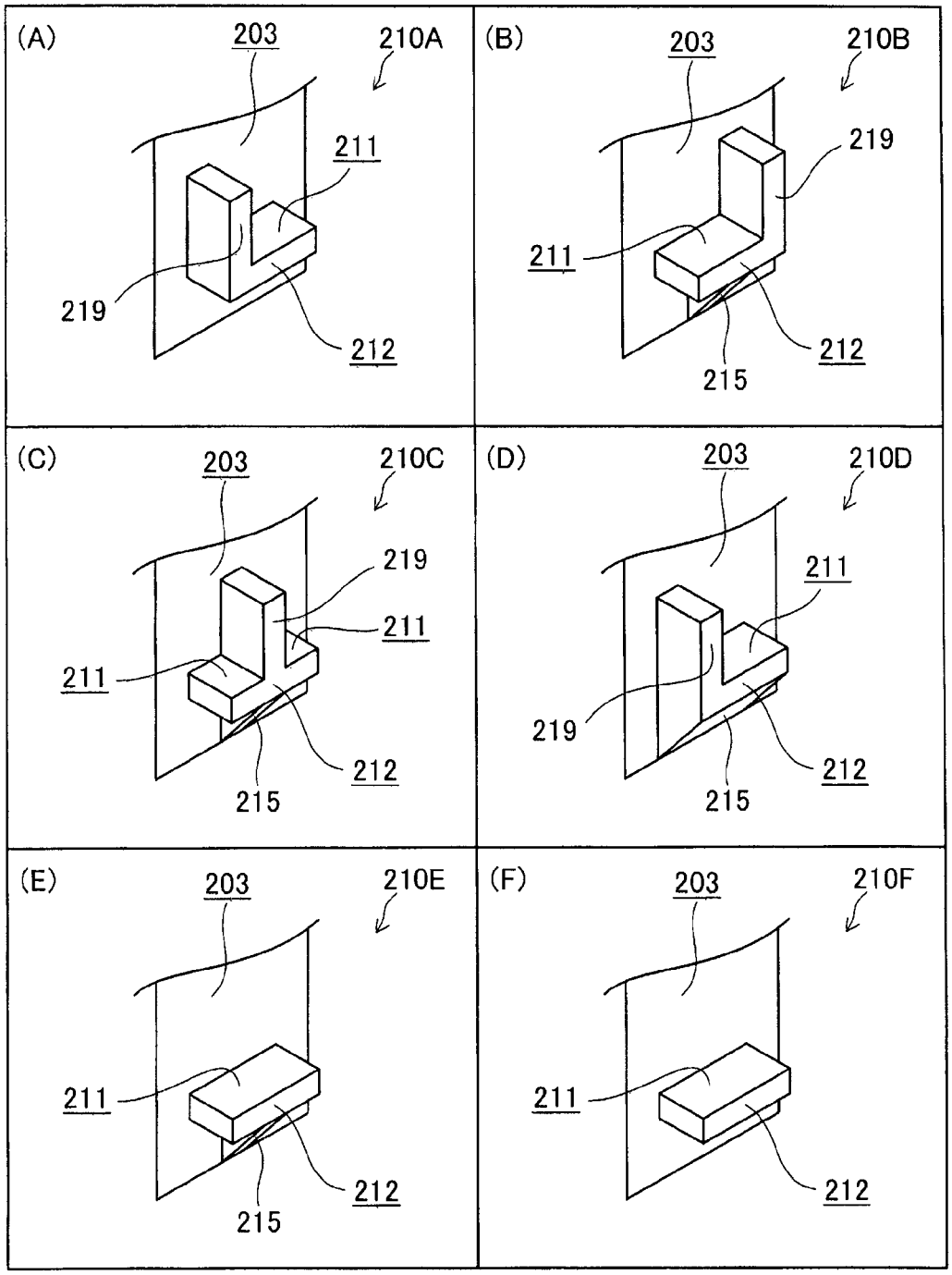
FIG. 34 includes diagrams (A) to (F) that are explanatory diagrams illustrating a modified example of a board side latching section.

FIG. 34 includes diagrams (A) to (F) that are explanatory diagrams illustrating a modified example of a board side latching section 210. In FIG. 34, board side latching sections 210A to 210F with six shapes which are different are respectively illustrated in FIG. 34(A) to FIG. 34(F).

The board side latching section 210A in FIG. 34(A) is the same as in the first embodiment excluding the point where the part 215 is omitted. A lever which corresponds to the board side latching section 210A is the same as the lever 80 in the first embodiment.

The board side latching section 210B in FIG. 34(B) is the same as in the first embodiment excluding the point where the part 219 is formed on the −Y axial direction side. A lever which corresponds to the board side latching section 210B is the same as the lever 80 in the first embodiment excluding the point where the position of the cut out surface 870 is on the −Y axial direction side.

The board side latching section 210C in FIG. 34(C) is the same as in the first embodiment excluding the point where the part 219 is provided on the center in the Y axial direction. A lever which corresponds to the board side latching section 210C is the same as the lever 80 in the first embodiment excluding the point where the position of the cut out surface 870 is in the center in the Y axial direction.

The board side latching section 210D in FIG. 34(D) is the same as in the first embodiment excluding the point where the part 215 is formed on the entire surface of an edge section on the −Z axial direction side. A lever which corresponds to the board side latching section 210D is the same as the lever 80 in the first embodiment.

The board side latching section 210E in FIG. 34(E) is the same as in the first embodiment excluding the point where the part 219 is omitted. A lever which corresponds to the board side latching section 210E may be the same as the lever 80 in the first embodiment or may be a configuration where the cut out surface 870 is omitted from the lever 80 in the first embodiment.

The board side latching section 210F in FIG. 34(F) is the same as in the first embodiment excluding the point where the part 215 and the part 219 are omitted. A lever which corresponds to the board side latching section 210F may be the same as the lever 80 in the first embodiment or may be a configuration where the cut out surface 870 is omitted from the lever 80 in the first embodiment.

Figure 35:
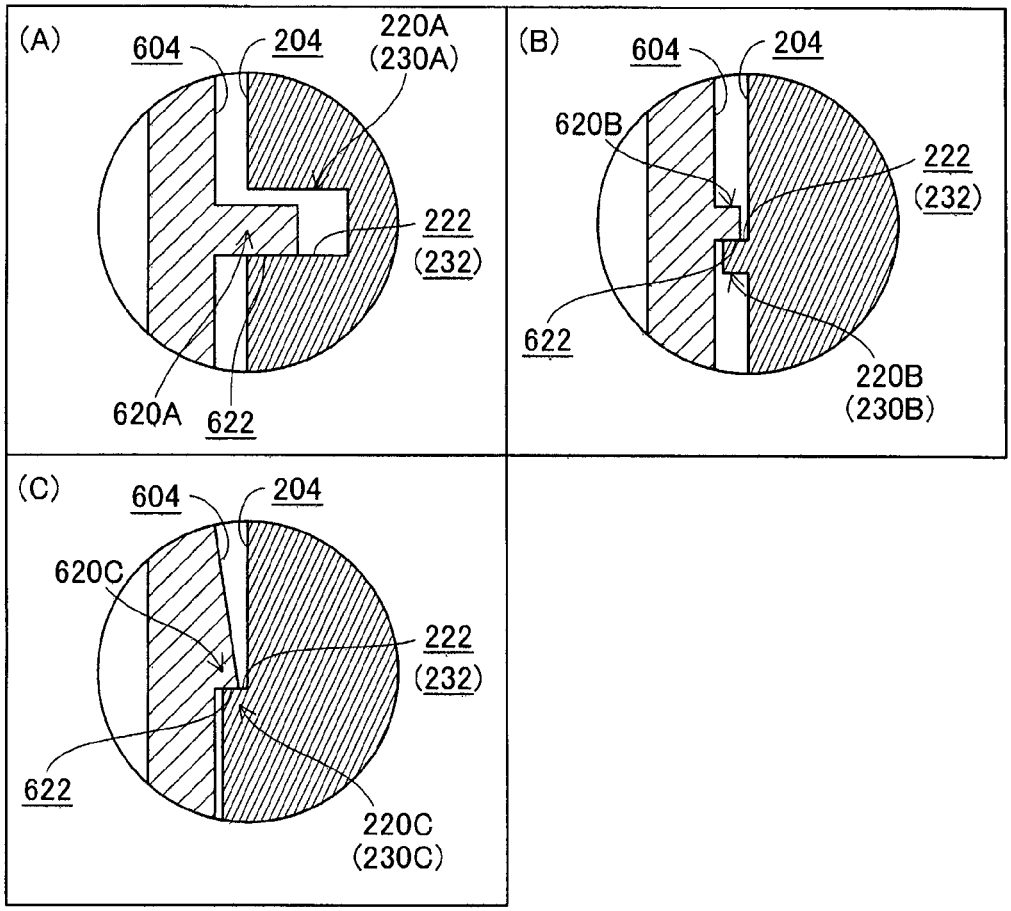
FIG. 35 includes diagrams (A) to (C) that are explanatory diagrams illustrating a modified example of supply port side latching sections and a supply pipe side latching section.

G-2. Modified Example of Supply Port Side Latching Section and Supply Pipe Side Latching Section:

FIG. 35 includes diagrams (A) to (C) that are explanatory diagrams illustrating a modified example of supply port side latching sections and a supply pipe side latching section 620. Supply port side latching sections 220A to 220C, supply port side latching sections 230A to 230C, and supply pipe side latching sections 620A to 620C with three shapes which are different are respectively illustrated in FIG. 35(A) to FIG. 35(C).

The supply port side latching section 220A in FIG. 35(A) forms a concave shape from the fourth surface 204 toward the +X axial direction and has the latching surface 222 on the −Z axial direction side of the concave shape. The supply port side latching section 230A in FIG. 35(A) forms a concave shape from the fourth surface 204 toward the +X axial direction and has the latching surface 232 on the −Z axial direction side of the concave shape. The supply pipe side latching section 620A in FIG. 35(A) forms a convex shape from the wall section 604 toward the +X axial direction in a position which corresponds to the supply port side latching sections 220A and 230A and has the latching surface 622 on the −Z axial direction side of the convex shape.

The supply port side latching section 220B in FIG. 35(B) is the same as the supply port side latching section 220 in the first embodiment. The supply port side latching section 230B in FIG. 35(B) is the same as the supply port side latching section 230 in the first embodiment. The supply pipe side latching section 620B in FIG. 35(B) forms a convex shape from the wall section 604 toward the +X axial direction in a position which corresponds to the supply port side latching section 220A and has the latching surface 622 on the −Z axial direction side of the convex shape.

The supply port side latching section 220C in FIG. 35(C) is formed with the −Z axial direction side of the fourth surface 204 as a large step on the −X axial direction side and has the latching surface 222 on the step. The supply port side latching section 230C in FIG. 35(C) is formed with the −Z axial direction side of the fourth surface 204 as a large step on the −X axial direction side and has the latching surface 232 on the step. The supply pipe side latching section 620C in FIG. 35(C) is formed with the +Z axial direction side of the wall section 604 as a large step on the +X axial direction side and has the latching surface 622 on the step.

G-3. Modified Examples of Outer Appearance of Cartridge

FIG. 36(A) to FIG. 36(H) are explanatory diagrams illustrating modified examples of an outer appearance of a cartridge. Eight modified examples which are different in terms of the outer appearance of the cartridge are each illustrated in FIG. 36(A) to FIG. 36(H). In the explanation of the modified examples, the same reference numerals are given to configurations which are the same as the cartridge 20 in the embodiment and the description thereof is omitted.

Figure 36A:
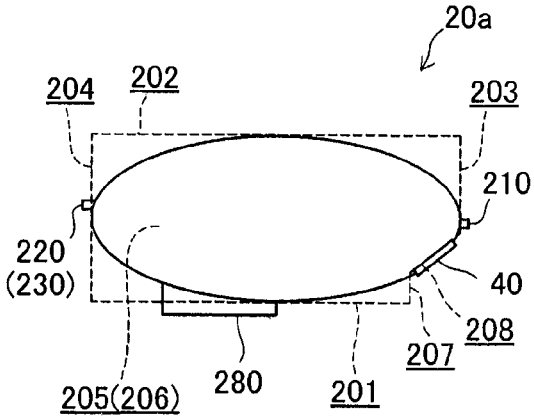
FIG. 36A is an explanatory diagram illustrating a modified example of an outer appearance of a cartridge.

The outer shell of a cartridge 20*a* in FIG. 36A has a side surface which is an elliptical shape or an oval shape. The board side latching section 210 and the circuit board 40 are provided on the front surface side of the cartridge 20*a*. The ink supply port 280 is formed on the bottom surface side of the cartridge 20*a*. The supply port side latching sections 220 and 230 are formed on the rear surface side of the cartridge 20*a*. The cartridge 20*a* has a constant width when the cartridge 20*a* is viewed from the front surface side.

Figure 36B:
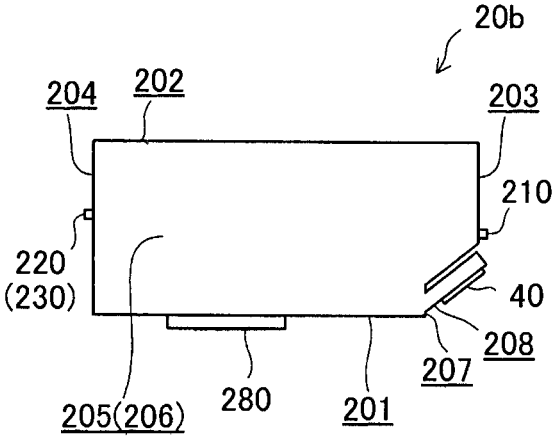
FIG. 36B is an explanatory diagram illustrating a modified example of an outer appearance of a cartridge.

A cartridge 20*b* in FIG. 36B is the same as the cartridge 20 of the embodiment excluding the point where the eighth surface 208 is not connected to the −Z axial direction side of the third surface 203.

Figure 36C:
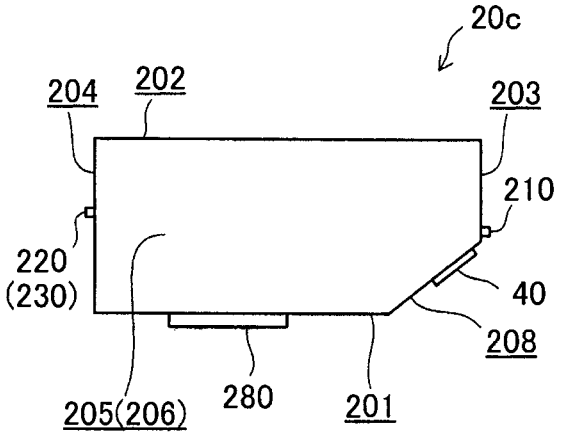
FIG. 36C is an explanatory diagram illustrating a modified example of an outer appearance of a cartridge.

A cartridge 20*c* in FIG. 36C is the same as the cartridge 20 of the first embodiment excluding the point where the seventh surface 207 is omitted by extending the eighth surface 208 to the first surface 201.

Figure 36D:
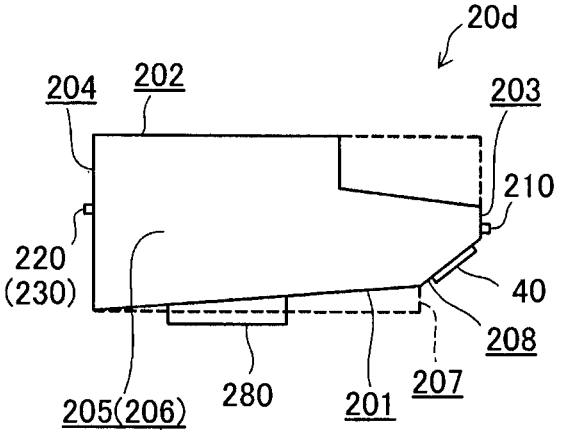
FIG. 36D is an explanatory diagram illustrating a modified example of an outer appearance of a cartridge.

A cartridge 20*d* in FIG. 36D is the same as the cartridge 20 of the first embodiment excluding a part where the second surface 202 and the third surface 203 intersect is cut out, and the point where the seventh surface 207 is omitted by the first surface 201 being inclined to the eighth surface 208.

Figure 36E:
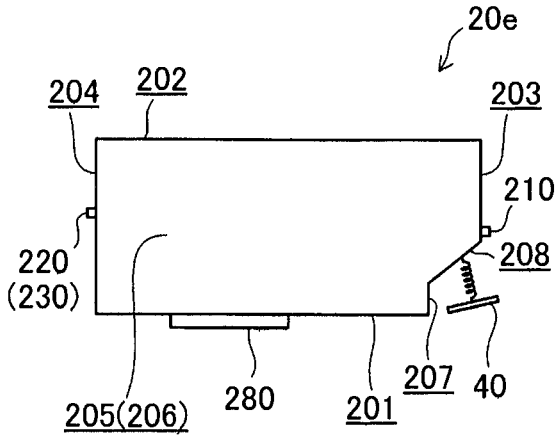
FIG. 36E is an explanatory diagram illustrating a modified example of an outer appearance of a cartridge.

A cartridge 20*e* in FIG. 36E is the same as the cartridge 20 of the first embodiment excluding the point where the circuit board 40 is attached to the eighth surface 208 via a spring.

Figure 36F:
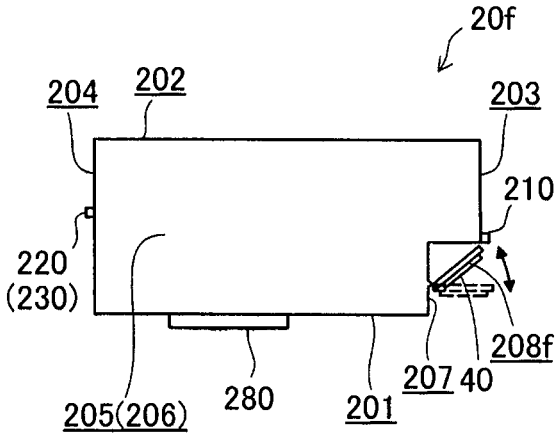
FIG. 36F is an explanatory diagram illustrating a modified example of an outer appearance of a cartridge.

A cartridge 20*f* in FIG. 36F is the same as the cartridge 20 of the first embodiment excluding the point where a surface 208*f* which is equivalent to the eighth surface 208 is configured to be movable to the seventh surface 207 and the circuit board 40 is provided on the eighth surface 208*f*.

Figure 36G:
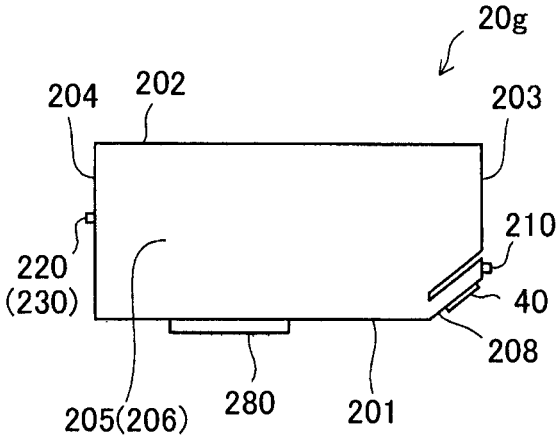
FIG. 36G is an explanatory diagram illustrating a modified example of an outer appearance of a cartridge.

A cartridge 20*g* in FIG. 36G is the same as the cartridge 20 of the first embodiment excluding the point where the eighth surface 208 is not linked to the −Z axial direction side of the third surface 203, the board side latching section 210 is provided adjacent to the circuit board 40 and not the third surface 203, and the seventh surface 207 is omitted by extending the eighth surface 208 to the first surface 201

Figure 36H:
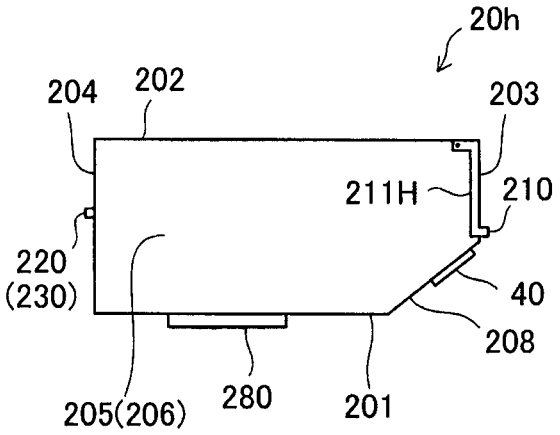
FIG. 36H is an explanatory diagram illustrating a modified example of an outer appearance of a cartridge.

The cartridge 20*h* in FIG. 36H is the same as the cartridge 20 of the first embodiment excluding the point where an extending member 211*h* is provided and the seventh surface 207 is omitted by extending the eighth surface 208 to the first surface 201. The extending member 211 is configured as the third surface 203. One edge of the extending member 211*h* is provided on the second surface 202 so as to rotate and the board side latching section 210 is provided on the other edge of the extending member 211*h*.

In any of the cartridges 20*a* to 20*h* which are the respective modified examples in FIG. 36A to FIG. 36H, each of the board side latching section 210, the supply port side latching sections 220 and 230, the ink supply port 280, and the circuit board 40 are provided in positions which correspond to the cartridge 20 of the first embodiment. Accordingly, any of the cartridges 20*a* to 20*h* which are the respective modified examples are compatible with the cartridges 20 in the first embodiment.

As is understood from each of the modified examples in FIG. 36A to FIG. 36H, various modified examples can be considered in regard to the shape of the outer appearance of the cartridge. Even in a case where the shape of the outer appearance of the cartridge has a shape other than a shape which is substantially rectangular, it is possible to consider, for example, six surfaces which are substantially rectangular in a virtual manner as shown by dotted lines in FIG. 36A and FIG. 36D, that is, the first surface 201 (the bottom surface), the second surface 202 (the upper surface), the third surface 203 (the front surface), the fourth surface 204 (the rear surface), the fifth surface 205 (the left side surface), and the sixth surface 206 (the right side surface) shown in FIG. 7 and FIG. 8. In the specifications, the term "surface" (plane) is used with a meaning which encompasses both a plane in a virtual manner (a virtual plane, a plane which does not actually exist) and an actual surface such as described in FIG. 7 and FIG. 8. In addition, in the specifications, the term "surface" is used with the meaning which encompasses both a plane and a curved plane.

G-4. Cartridge Using Adaptor

Figure 37:
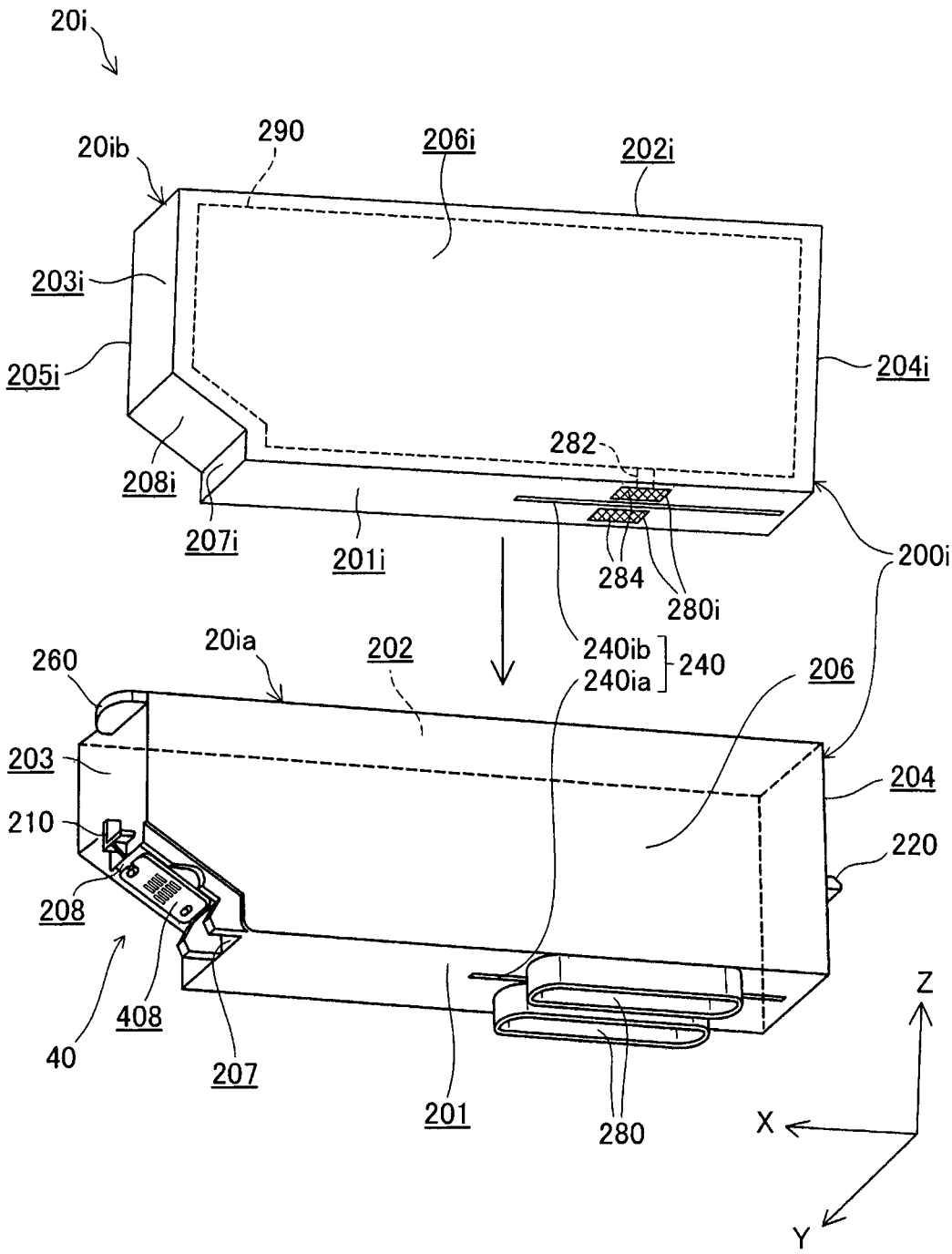
FIG. 37 is an explanatory diagram illustrating a configuration of a cartridge which uses an adapter.

FIG. 37 is a perspective diagram illustrating a configuration of a cartridge 20*i* which uses an adapter. The cartridge 20*i* is configured to be separate an adaptor 20*ia* and a containing member 20*ib*. The containing member 20*ib* has the ink containing section 290 which contains the printing material in an inner portion thereof. In a case where there is no longer any printing material in the ink containing section 290, it is possible to exchange the containing member 20*ib* with a new containing member 20*ib* or replenish the printing material in the ink containing member 290. When performing exchanging of the containing member 20*ib* or replenishing of the printing material, it is possible to reuse the adaptor 20*ia*. The cartridge 20*i* in FIG. 37 is compatible with the cartridge 20 of the first embodiment shown in FIG. 7.

An outer shell 200*i* of the cartridge 20*i* is configured from a combination of the outer shell of the adaptor 20*ia* and the outer shell of the containing member 20*ib*. The containing member 20*ib* has the ink flow path 282 and the foam resin body 284 in addition to the ink containing section 290.

The containing member 20*ib* of the cartridge 20*i* comprises a second surface 202*i* which is equivalent to the second surface 202 of the cartridge 20*i*. The containing member 20*ib* comprises a first surface 201*i*, a third surface 203*i*, a fourth surface 204*i*, a fifth surface 205*i*, a sixth surface 206*i*, a seventh surface 207*i*, and an eighth surface 208*i* which respectively correspond to the first surface 201 and the third to the eighth surfaces 203 to 208 of the cartridge 20*i*.

The first surface 201*i* and the second surface 202*i* oppose each other in the Z axial direction, the first surface 201*i* is positioned on the −Z axial direction side, and the second surface 202*i* is positioned on the +Z axial direction side. The third surface 203*i* and the fourth surface 204*i* oppose each other in the X axial direction, the third surface 203*i* is positioned on the +X axial direction side, and the fourth surface 204*i* is positioned on the −X axial direction side. The fifth surface 205*i* and the sixth surface 206*i* oppose each other in the Y axial direction, the fifth surface (not shown) is positioned on the +Y axial direction side, and the sixth surface 206*i* is positioned on the −Y axial direction side. The seventh surface 207*i* and the eighth surface 208*i* form connection surfaces which connect the first surface 201*i* and the third surface 203*i*. Two containing member side supply ports 280*i* are provided on the first surface 201*i* in order to supply ink to the two ink supply ports 280 which are provided on the adaptor 20*ia*. The foam resin bodies 284 are provided in each of the two containing member side supply ports 280*i*. A concave section 240*ib* for configuring the groove section 240 is provided between the two containing member side supply ports 280*i*. The concave section 240*ib* is provided to be concave more to the +Z axial direction side than the first surface 201*i*.

The seventh surface 207*i* is a surface which intersects at a right angle with the first surface 201*i*. The seventh surface 207*i* is a surface (YZ flat surface) which is parallel to the Y axis and the Z axis. The seventh surface 207*i* as a step surface is a surface which rises up to the first surface 201*i*. That is, the seventh surface 207*i* is a surface which extends from the first surface 201*i* in the +Z axial direction. The seventh surface

207*i* is positioned at the −X axial direction side and the −Z axial direction side to the eighth surface 208*i*

The eighth surface 208*i* is a surface which is connected to the seventh surface 207*i* and the third surface 203*i*. The eighth surface 208*i* is an inclined surface which is inclined toward a direction which includes components in the +X axial direction and the −Z axial direction. The eighth surface 208*i* is a surface which is inclined to the first surface 201*i* and the third surface 203*i*. The eighth surface 208*i* is a surface which intersects at a right angle with the fifth surface 205*i* and the sixth surface 206*i*. The eighth surface 208*i* is inclined to the XY plane and the YZ plane and intersects at a right angle to the XZ plane.

The adaptor 20*ia* of the cartridge 20*i* comprises surfaces which are equivalent to the first surface 201, the third surface 203, the fourth surface 204, the fifth surface 205, the sixth surface 206, the seventh surface 207, and the eighth surface 208 of the cartridge 20*i*. The surface which is equivalent to the second surface 202 of the cartridge 20*i* out of the surfaces of the adaptor 20*ia* is an opening. A space which receives the containing member 20*ib* is provided on an inner portion of the adaptor 20*ia*. The ink supply ports 280 are provided on the first surface 201 of the adaptor 20*ia*. A slit 240*ia* for configuring the groove section 240 is provided on the first surface 201 in between the two ink supply ports 280. The slit 240*ia* which is provided on the first surface 201 of the adaptor 20*ia* and the groove section 240*ib* which is provided on the containing member 20*ib* are both provided in positions which correspond to the partition plate 607 (refer to FIG. 19 to FIG. 21) in the holder 60 (refer to FIG. 19 to FIG. 21). Then, the groove section 240 is formed by combining the slit 240*ia* which is provided on the first surface 201 of the adaptor 20*ia* and the groove section 240*ib* which is provided on the containing member 20*ib*. As such, the partition plate 607 (refer to FIG. 19 to FIG. 21) can be received in the groove section 240 when the ink supply sections 280 are connected to the ink supply pipe 640 (refer to FIG. 19 to FIG. 21).

The configuration of the cartridge 20*i* of FIG. 37 is the same as the cartridge 20 of the first embodiment which is shown in FIG. 7 including the modified examples excluding the point that the adaptor 20*ia* and the containing member 20*ib* are separable as described above. Here, in another embodiment or another modified example, a separable configuration of the containing member and the adaptor may be adopted as with the cartridge 20*i* of FIG. 35. Here, the dimensions and ratios of each section in the cartridge 20*i* of FIG. 37 may be dimensions and ratios which are the same as the first embodiment even though there are parts which are different to the first embodiment.

Figure 38:
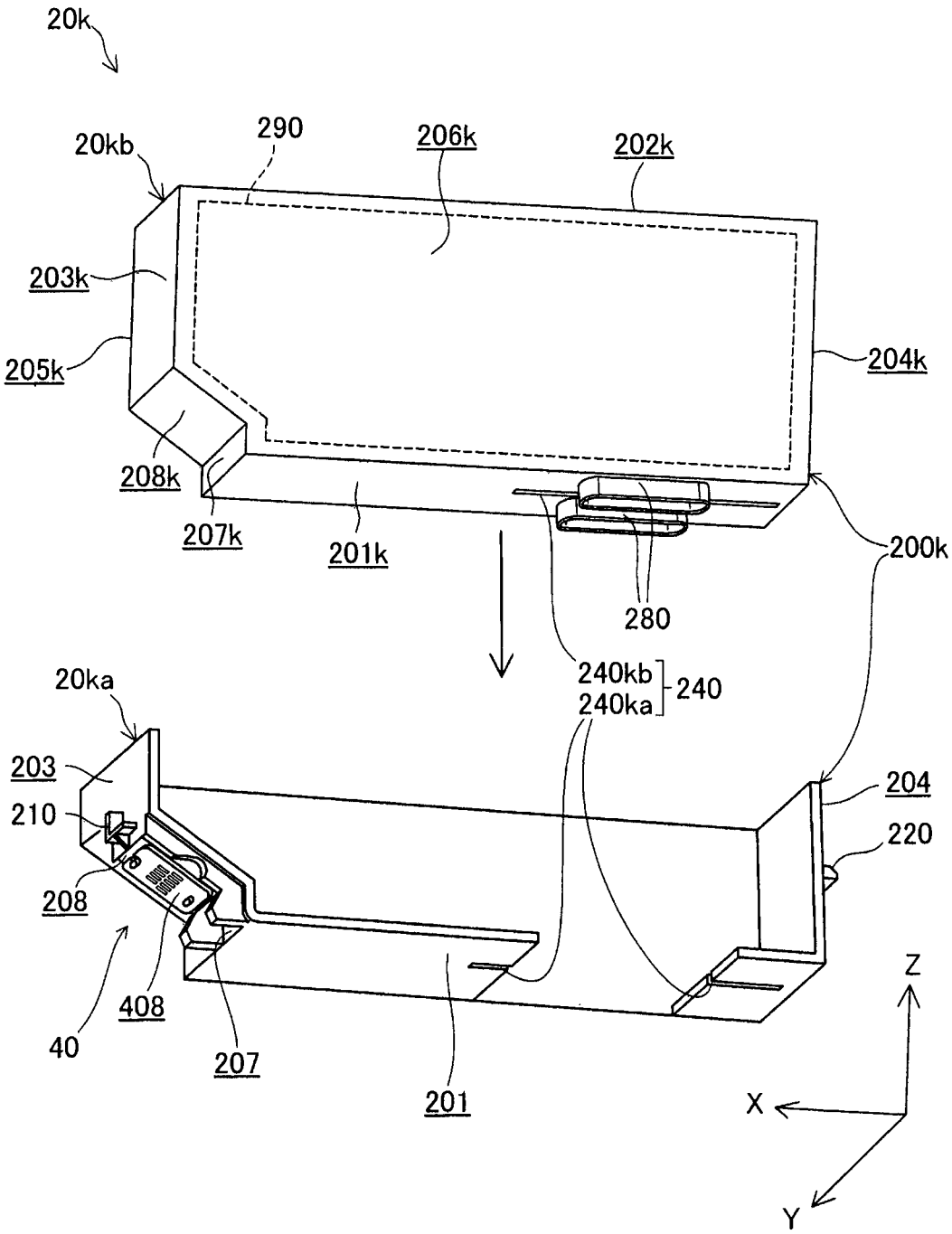
FIG. 38 is an explanatory diagram illustrating a configuration of a cartridge which uses an adapter.

FIG. 38 is a perspective diagram illustrating a configuration of a cartridge 20*k* which uses an adapter. The cartridge 20*k* is configured to be separate an adaptor 20*ka* and a containing member 20*kb*. The containing member 20*kb* has the ink containing section 290 which contains the printing material in an inner portion thereof. In a case where there is no longer any printing material in the ink containing section 290, it is possible to exchange the containing member 20*kb* with a new containing member 20*kb* or replenish the printing material in the ink containing member 290. When performing exchanging of the containing member 20*kb* or replenishing of the printing material, it is possible to reuse the adaptor 20*ka*. The cartridge 20*k* in FIG. 38 is compatible with the cartridge 20 of the first embodiment shown in FIG. 7.

An outer shell 200*k* of the cartridge 20*k* is configured from a combination of the outer shell of the adaptor 20*ka* and the outer shell of the containing member 20*kb*. The containing member 20*kb* has the ink containing section 290 and the ink supply port 280.

The containing member 20*kb* of the cartridge 20*k* comprises a second surface 202*k* and a sixth surface 206*k* which are respectively equivalent to the second surface 202 and the sixth surface 206 of the cartridge 20*k*. The containing member 20*kb* comprises a first surface 201*k*, a third surface 203*k*, a fourth surface 204*k*, a fifth surface 205*k*, a seventh surface 207*k*, and an eighth surface 208*k* which respectively correspond to the first surface 201, the third surface 203, the fourth surface 204, the fifth surface 205, the seventh surface 207, and the eighth surface 208 of the cartridge 20*k*.

The first surface 201*k* and the second surface 202*k* oppose each other in the Z axial direction, the first surface 201*k* is positioned on the −Z axial direction side, and the second surface 202*k* is positioned on the +Z axial direction side. The third surface 203*j* and the fourth surface 204*k* oppose each other in the X axial direction, the third surface 203*k* is positioned on the +X axial direction side, and the fourth surface 204*k* is positioned on the −X axial direction side. The fifth surface 205*k* and the sixth surface 206*k* oppose each other in the Y axial direction, the fifth surface (not shown) is positioned on the +Y axial direction side, and the sixth surface 206*k* is positioned on the −Y axial direction side. The seventh surface 207*k* and the eighth surface 208*k* form connection surfaces which connect the first surface 201*k* and the third surface 203*k*. A concave section 240*kb* for configuring the groove section 240 is provided on the first surface 201*k* between the two containing member side supply ports 280. The concave section 240*kb* is provided to be concave more to the +Z axial direction side than the first surface 201*k*.

The seventh surface 207*k* is a surface which intersects at a right angle with the first surface 201*k*. The seventh surface 207*k* is a surface (YZ plane) which is parallel to the Y axis and the Z axis. The seventh surface 207*k* as a step surface is a surface which rises up to the first surface 201*k*. That is, the seventh surface 207*k* is a surface which extends from the first surface 201*k* in the +Z axial direction. The seventh surface 207*k* is positioned at the −X axial direction side and the −Z axial direction side to the eighth surface 208*k*.

The eighth surface 208*k* is a surface which is connected the seventh surface 207*k* and the third surface 203*k*. The eighth surface 208*k* is an inclined surface which is inclined toward a direction which includes components in the +X axial direction and the −Z axial direction. The eighth surface 208*k* is a surface which is inclined to the first surface 201*k* and the third surface 203*k*. The eighth surface 208*k* is a surface which intersects at a right angle with the fifth surface 205*k* and the sixth surface 206*k*. The eighth surface 208*k* is inclined to the XY plane and the YZ plane and intersects at a right angle to the XZ plane.

The adaptor 20*ka* of the cartridge 20*k* comprises surfaces which are equivalent to the first surface 201, the third surface 203, the fourth surface 204, and the fifth surface 205 of the cartridge 20*k*. The surfaces which are equivalent to the second surface 202 and the sixth surface 206 of the cartridge 20*k* out of the surfaces of the adaptor 20*ka* are openings. A space which receives the containing member 20*kb* is provided on an inner portion of the adaptor 20*ka*. The adaptor 20*ka* has an opening in a portion of the first surface 201 and is connected to the ink supply pipe 640 by the ink supply port 280 of the containing member 20*kb* being exposed via the opening.

A slit 240*ka* for configuring the groove section 240 is provided on the first surface 201 in a position which is equivalent to being between the two ink supply ports 280, that is, in a position which corresponds to the concave section 240*kb* which is provided on the first surface 201*k* of the containing member 20*kb*. The slit 240*ka* which is provided on the first surface 201 of the adaptor 20*ka* and the groove section 240*kb* which is provided on the containing member 20*kb* are both provided in positions which correspond to the partition plate 607 (refer to FIG. 19 to FIG. 21) in the holder 60 (refer to FIG. 19 to FIG. 21). Then, the groove section 240 is formed by combining the slit 240*ka* which is provided on the first surface 201 of the adaptor 20*ka* and the groove section 240*kb* which is provided on the containing member 20*kb*. As such, the partition plate 607 (refer to FIG. 19 to FIG. 21) can be received in the groove section 240 when the ink supply sections 280 are connected to the ink supply pipe 640 (refer to FIG. 19 to FIG. 21).

The configuration of the cartridge 20*k* in FIG. 38 is the same as the cartridge 20 of the embodiment which is shown in FIG. 7 including the modified examples excluding the point that the adaptor 20*ka* and the containing member 20*kb* are separable as described above. Here, In another embodiment or another modified example, a separable configuration of the containing member and the adaptor may be adopted as with the cartridge 20*k* of FIG. 38. Here, the dimensions and ratios of each section in the cartridge 20*k* of FIG. 38 may be the same dimensions as the first embodiment even though there are portions which are different to the embodiment.

Figure 39:
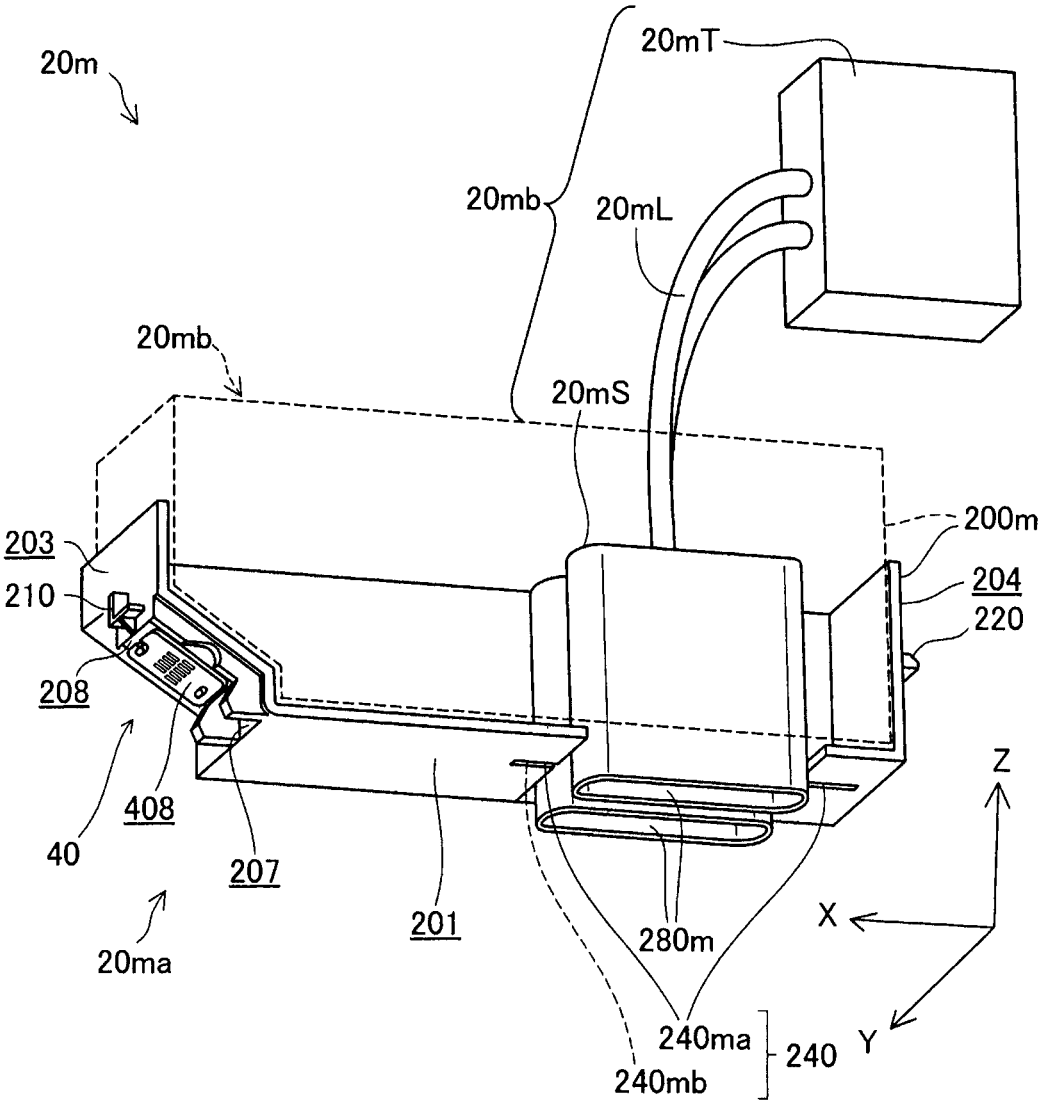
FIG. 39 is an explanatory diagram illustrating a configuration of a cartridge which uses an adapter.

FIG. 39 is a perspective diagram illustrating a configuration of a cartridge 20*m* which uses an adapter. The cartridge 20*m* comprises an adaptor 20*ma*, an external tank 20*m*T, a tube 20*m*L, and an auxiliary adaptor 20*m*S. The adaptor 20*ma* of the cartridge 20*m* includes modified examples and has the same configuration as the adaptor 20*ka* in FIG. 36.

The external tank 20*m*T of the cartridge 20*m* contains the printing material (ink) in an inner portion thereof. In the embodiment, the external tank 20*m*T is disposed on the outside of the printer 50 shown in FIG. 1. The printing material of the external tank 20*m*T is supplied to the auxiliary adaptor 20*m*S via the tube 20*m*L. The auxiliary adaptor 20*m*S of the cartridge 20*m* has two ink supply ports 280*m* which are equivalent to the ink supply port 280.

The external tank 20*m*T, the auxiliary adaptor 20*m*S and the tube 20*m*L function as a containing member 20*mb* where the ink is contained. That is, it is possible to interpret the cartridge 20*m* in FIG. 39 as having the containing member 20*mb* as shown by the dotted line in the diagram. An outer shell 200*m* of the cartridge 20*m* is configured from a combination of the outer shell of the adaptor 20*ma* and the outer shell of the virtual containing member 20*mb*. A concave section or space 240*mb* which configures the groove section 240 is provided between the two ink supply ports 280 of the auxiliary adaptor 20*m*S. In addition, a slit 240*ma* for configuring the groove section 240 is provided on the first surface 201 of the adaptor 20*ma*. The slit 240*ma* which is provided on the first surface 201 of the adaptor 20*ma* and the concave section or space 240*mb* which is provided on the auxiliary adaptor 20*m*S are both provided in positions which correspond to the partition plate 607 (refer to FIG. 19 to FIG. 21) in the holder 60 (refer to FIG. 19 to FIG. 21). Then, the groove section 240 is formed by combining the slit 240*ma* which is provided on the first surface 201 of the adaptor 20*ma* and the concave section or space 240*mb* which is provided on the auxiliary adaptor 20*m*S. As such, the partition plate 607 (refer to FIG. 19 to FIG. 21) can be received in the groove section 240 when the ink supply sections 280 are connected to the ink supply pipe 640 (refer to FIG. 19 to FIG. 21).

In this manner, the cartridge 20*m* in FIG. 39 can be considered to have the configuration where the adaptor 20*ma* and the containing member 20*mb* can be separated in the same manner as the cartridge 20*i* of FIG. 37 and the cartridge 20*k* of FIG. 38. In a case where there is no longer any printing material in the external tank 20*m*T, it is possible to exchange the external tank 20*m*T with a new external tank 20*m*T or replenish the printing material in the external tank 20*m*T. When performing exchanging of the external tank 20*m*T or replenishing of the printing material, it is possible to reuse the adaptor 20*ma*. The cartridge 20*m* in FIG. 39 is compatible with the cartridge 20 of the first embodiment shown in FIG. 7.

The configuration of the cartridge 20*m* in FIG. 39 is the same as the cartridge 20 of the first embodiment which is shown in FIG. 7 including the modified examples excluding the point where the adaptor 20*ma* and the containing member 20*mb* are separable as described above. Here, in another embodiment or another modified example, a separable configuration of the containing member and the adaptor may be adopted as in cartridge 20*m* of FIG. 39.

G-5. Modified Examples of Circuit Board and Terminal Formation

In the embodiment described above, the circuit board 40 is provided on the cartridge 20. In another embodiment, the circuit board 40 need not be provided on the cartridge 20. That is, the cartridge side terminals 430 may be directly formed on the eighth surface 208. In this case, the cartridge side inclined surface 408 is a portion of the eighth surface 208.

In addition, a portion of wiring and the storage device 420 which are formed on the circuit board 40 may be provided on a surface other than the surface of the eighth surface 208. For example, the wiring, the storage device 420, and the cartridge side terminals 431 to 439 may be provided on a flexible printing board with an area which is larger than the circuit board 40 and a portion of the wiring and the storage section 420 may be disposed on the fifth surface 205 which is adjacent to the eighth surface so that the cartridge side terminals 430 are arranged on the eighth surface by folding over the flexible printing board.

In addition, the arrangement of the cartridge side terminals and the device side terminals need not be in two rows and may be one row or may be three or more rows. In addition, the formation and the arrangement of the cartridge side terminals 430 are not limited to the formation and the arrangement shown in FIG. 15.

Figure 40A:
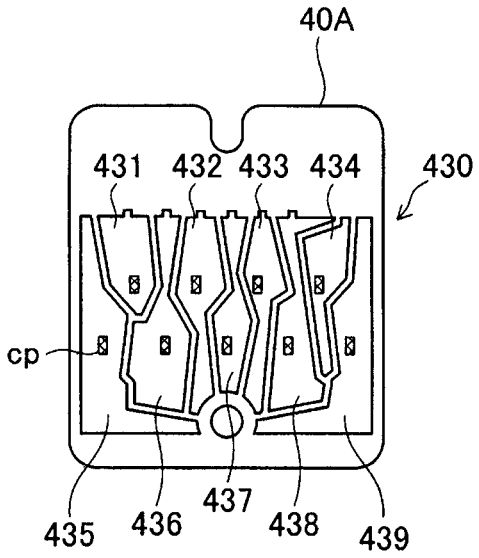
FIGS. 40A to 40C are diagrams illustrating modified examples of terminal formations.
Figure 40B:
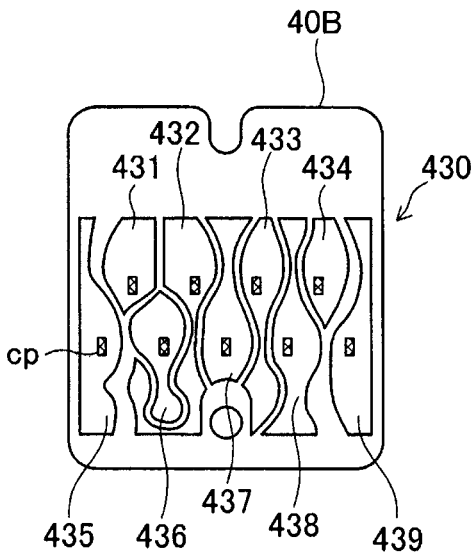
Figure 40C:
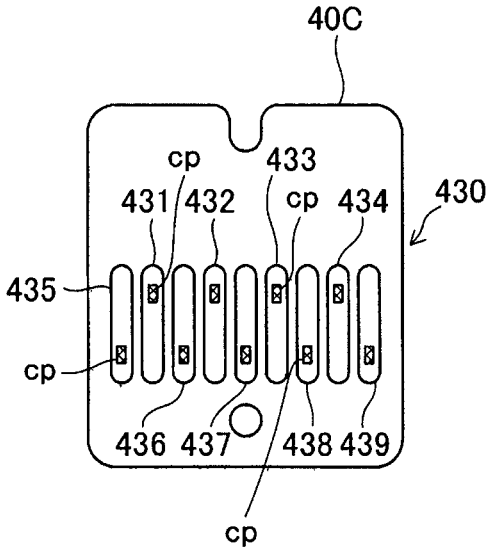

FIG. 40A to FIG. 40C are diagrams illustrating modified examples of the cartridge side terminals 430. Circuit boards 40A, 40B, and 40C which are modified examples shown in FIGS. 40A-40C are the same as the circuit board 40 in FIG. 15 excluding the point where the surface formation of the cartridge side terminals 430 is different.

In the circuit board 40A of FIG. 40A, the surface formation of the cartridge side terminals 431 to 439 is not substantially a rectangle as with the circuit board 40 in FIG. 15 and is an irregular polygon shape.

In the circuit board 40B of FIG. 40B, the surface formation of the cartridge side terminals 431 to 439 is not substantially a rectangle as with the circuit board 40 in FIG. 15 and is an irregular formation which is surrounded by lines and curves.

In the circuit board 40C of FIG. 40C, the surface formation of the cartridge side terminals 431 to 439 are straight line forms with a certain width and have the same formations. The cartridge side terminals 431 to 439 are lined up in one row in the width direction. The cartridge side terminals (the mounting detection terminals) 435 and 439 are respectively disposed on both sides of the arrangement of the lines of the cartridge side terminals 431 to 439. The cartridge side terminal (the mounting detection terminal) 431 is disposed between the cartridge side terminal (the mounting detection terminal) 435 and the cartridge side terminal (the power source terminal) 436. The cartridge side terminal 434 (the mounting detection terminal) is disposed between the cartridge side terminal 439 (the mounting detection terminal) and the cartridge side terminal (the data terminal) 438.

In the circuit boards 40A, 40B, and 40C which are the modified examples shown in FIGS. 40A-40C, the disposing of the contact portion cp with the device side terminals 730 which correspond to the cartridge side terminals 431 to 439 is the same as the embodiment of FIG. 15. In this manner, various modifications of the surface formation of each of the terminals are possible as long as the disposing of the contact portions cp is the same.

G-6. Modified Example of Holder

Figure 41:
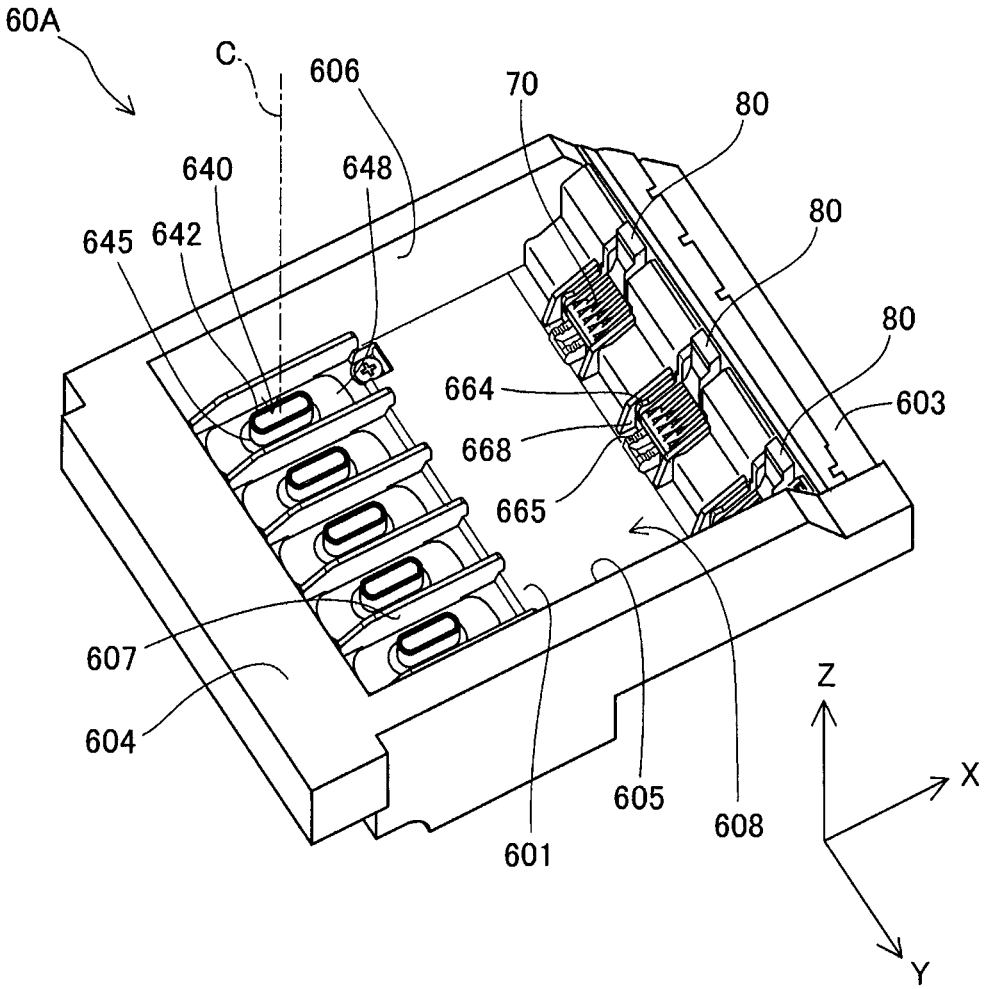
FIG. 41 is an explanatory diagram illustrating a configuration of a holder in a modified example.

FIG. 41 is an explanatory diagram illustrating a configuration of a holder 60A in a modified example. The holder 60A is the same as the holder 60 of the first embodiment excluding the point where the slot SL where the terminal platform 70 and the lever 80 are provided and the slot SL where the terminal platform 70 and the lever 80 are omitted are arranged alternately. The holder 60A is configured from six of the slots SL in the same manner as the holder 60 in the first embodiment and one of the ink supply pipes 640 is provided for each of the slots SL.

The holder 60A is adapted to mount the cartridge 20 (FIG. 7) of the first embodiment, the cartridge 21 (FIG. 29) of the second embodiment, and the cartridge 22 (FIG. 30) of the third embodiment. It is not possible to mount the cartridge 20S (FIG. 17) of the first embodiment on the holder 60A individually in the slot SL where the terminal platform 70 and the lever 80 are omitted in the holder 60A, but it is possible to mount a combination of a plurality of the cartridges 20S as in the cartridge 25 (FIG. 33) of the sixth embodiment on the holder 60A.

The holder 60A in FIG. 41 is one example of the holder. At least one of the terminal platform 70 and the lever 80 which are not necessary with relation to the cartridge may be omitted as in the holder 60A in FIG. 41, in another embodiment and another modified example. In addition, from the same point of view, the supply pipe side latching sections which are not necessary with relation to the cartridge may be omitted in another embodiment and another modified examples

H. Other Modified Examples

The invention is not limited to the embodiments, applied examples, or modified examples described above and it is possible to realize the invention with various configurations in a scope which does not depart from the gist thereof. For example, it is possible to appropriately perform replacing or combining of the technical characteristics in the embodiments, applied examples, and modified examples which correspond to the technical characteristics in each of the aspects described in the section of the Disclosure of the Invention in order to solve a portion or all of the problems described above or to achieve a portion or all of the effects described above. In addition, it is possible to appropriately omit technical characteristics if described as not being essential in the specifications.

For example, instead of the storage device, another electronic device may be mounted on the cartridge. In addition, it is not necessary for each type of member in the embodiment described above to each be configured as independent members and a plurality of the members may be configured as an integrated member as required. In addition, an integrated member in the embodiment described above may be configured by combining a plurality of members.

The invention is not limited to an ink jet printer or an ink cartridge thereof and it is possible to also apply the invention to an arbitrary liquid ejection device which ejects a liquid other than ink and a liquid containing container thereof. For example, it is possible to apply the invention to the following various types of liquid ejection devices and liquid containing containers thereof.

- Image recording devices such as a facsimile device
- Colorant material ejection devices which are used in manufacturing color filters which are used in image display devices such as liquid crystal displays
- Electrode material ejection devices which are used in forming electrodes such as in organic EL (Electro Luminescent) displays and field emission displays (FED)
- Liquid ejection devices which eject a liquid which includes a bioorganic material which is used in manufacturing biochips
- Sample ejection devices as precision pipettes
- Lubricating oil ejection devices
- Resin liquid ejection devices
- Liquid ejection devices which eject lubricating oil in a pin-point manner in precision machinery such as clocks and cameras
- Liquid ejection devices which eject a transparent resin liquid such as an ultraviolet curing resin liquid onto a board in order to form a small semispherical lens (an optical lens) which is used in optical communication elements or the like
- Liquid ejection devices which eject an acid or alkali etching liquid in order to carry out etching of a board or the like
- Other arbitrary liquid ejection devices which are provided with a liquid ejection head which discharges liquid droplets in small amounts.

Here, "liquid droplet" refers to a state of a liquid which is discharged from the liquid ejection device and includes liquid bodies with particle shapes and liquid bodies with teardrop shapes as well as liquid bodies which draw out a trail with a thread shape. In addition, it is sufficient if the "liquid" referred to here is a material which is able to be ejected from the liquid ejection device. For example, it is sufficient if the "liquid" is when a substance is in a liquid phase, and materials in a liquid state such as materials with a liquid state where the viscosity is high or low and materials with a liquid state such as sols, gel water, other inorganic solvents, organic solvents, solutions, liquid resins, and liquid metals (metal fusion liquids) are included as "liquids". In addition, not only liquids as one state of a substance but where particles of a functional material which are formed as a solid material such as a pigment or metal particles are dissolved, dispersed, or mixed in a solvent are included as "liquids". In addition, ink as described in the embodiments described above, liquid crystals, or the like are given as representative examples of the liquid. Here, various types of liquid compositions such as typical water-based inks, oil-based inks, shell inks, and hot melt inks are included as ink.

What is claimed is:

1. A cartridge configured to be mounted in a holder including a first and second ink supply pipes, the cartridge comprising:

a first surface and a second surface parallel to a first and second axes and opposing each other in a direction along a third axis, the first to third axes being orthogonal to each other;

a third surface and a fourth surface parallel to the second and third axes and opposing each other in a direction along the first axis;

a fifth surface and a sixth surface which intersect with each surface of the first surface to the fourth surface and opposing each other, the first surface to the six surface configuring an outer shell of the cartridge;

a printing material containing section configured to contain a printing material, the printing material containing section being formed at inner side of the outer shell of the cartridge;

a first printing material supply port provided on the first surface, projecting from the first surface in a direction along the third axis, and configured to supply the printing material from the printing material containing section to the first ink supply pipe;

a second printing material supply port provided on the first surface, Projecting from the first surface in a direction along the third axis, and configured to supply the printing material from the printing material containing section to the second ink supply pipe;

a groove section provided in the first surface to be concave toward the second surface from the first surface, and provided between the first and second printing material supply ports;

an inclined surface linking between the first surface and the third surface and being inclined to the first surface and the third surface;

a circuit board with cartridge side terminals provided on the inclined surface:

a first supply port side latching section provided on the fourth surface, and a second supply port side latching section provided on the fourth surface, wherein the first supply port side latching section and the circuit board are provided at a position which cuts across a first plane CX that passes through a center of the first printing material supply port and that is orthogonal to the second axis, the second supply port side latching section is provided at a position which cuts across a second plane CX that passes through a center of the second printing material supply port and that is orthogonal to the second axis, and a length of the first supply port side latching section in a direction along the second axis is larger than a length of the second supply port side latching section in a direction along the second axis.

2. The cartridge according to claim 1, further comprising:

a board side latching section provided on the third surface and provided in a position which cuts across the first plane CX.

3. The cartridge according to claim 2, wherein the hoard side latching section is provided at a position adjacent to the circuit board.

4. The cartridge according to claim 1, further comprising:

a third printing material supply port provided on the first surface, projecting from the first surface in a direction along the third axis, and configured to supply the printing material from the printing material containing section to the holder, and a third supply port side latching section provided on the fourth surface, wherein the third supply port side latching section is provided at a position which cuts across a third plane CX that passes through a center of the third printing material supply port and that is orthogonal to the second axis.

5. The cartridge according to claim 1, further comprising:

an optical element adapted to optically detect the printing material in the printing material containing section from the outside of the cartridge, wherein the optical element is provided on the first surface in a position which cuts across the first plane CX.

6. A printing material supply system comprising:

a printing device having the holder; and a cartridge according to claim 1 mounted on the holder and supplying a printing material to the holder, wherein the holder includes a partition plate projecting in a plate shape between the first and second printing material supply pipes, and the partition plate is inserted into the groove section when the cartridge is mounted on the printing device.

7. A cartridge configured to be mounted in a holder including a first and second ink supply pipes, the cartridge comprising:

a first surface and a second surface parallel to a first and second axes and opposing each other in a direction along a third axis, the first to third axes being orthogonal to each other;

a third surface and a fourth surface parallel to the second and third axes and opposing each other in a direction along the first axis;

a fifth surface and a sixth surface which intersect with each surface of the first surface to the fourth surface and opposing each other, the first surface to the six surface configuring an outer shell of the cartridge;

a printing material containing section configured to contain a black printing material, the printing material containing section being formed at inner side of the outer shell of the cartridge;

a first printing material supply port provided on the first surface, projecting from the first surface in a direction along the third axis, and configured to supply the black printing material from the printing material containing section to the first ink supply pipe;

a second printing material supply port provided on the first surface, projecting from the first surface in a direction along the third axis, and configured to supply the black printing material from the printing material containing section to the second ink supply pipe; and a groove section provided in the first surface to be concave toward the second surface from the first surface, and provided between the first and second printing material supply ports.

8. The cartridge according to claim 7, further comprising:

an inclined surface linking between the first surface and the third surface and being inclined to the first surface and the third surface;

a circuit board with cartridge side terminals provided on the inclined surface; and a board side latching section provided on the third surface and provided in a position which cuts across the first plane CX, wherein the board side latching section and the circuit board are provided at a position which cuts across a first plane CX that passes through a center of the first printing material supply port and that is orthogonal to the second axis.

* * * * *